US006035826A

United States Patent [19]

Matsuoka

[11] Patent Number: 6,035,826

[45] Date of Patent: Mar. 14, 2000

[54] CRANK ANGLE DETECTING APPARATUS OF INTERNAL COMBUSTION ENGINE

[75] Inventor: Yuji Matsuoka, Nagoya, Japan

[73] Assignee: Toyota Jidosha Kabushiki Kaisha, Toyota, Japan

[21] Appl. No.: 09/161,526

[22] Filed: Sep. 28, 1998

[30] Foreign Application Priority Data

Sep. 30, 1997 [JP] Japan ..... 9-266931
Nov. 28, 1997 [JP] Japan ..... 9-328756

[51] Int. Cl.[7] ..... F02P 5/00

[52] U.S. Cl. ..... 123/406.62; 123/406.63; 123/617

[58] Field of Search ..... 123/406.58, 406.61, 123/406.62, 406.63, 612, 617

[56] References Cited

U.S. PATENT DOCUMENTS

| | | | |
|---|---|---|---|
| 4,259,723 | 3/1981 | Fujisawa et al. | 123/406.63 |
| 4,926,822 | 5/1990 | Abe et al. | 123/406.62 |
| 5,305,220 | 4/1994 | Schoggl | 123/406.63 |
| 5,329,904 | 7/1994 | Kokubo et al. | 123/406.62 |
| 5,353,635 | 10/1994 | Saiki et al. . | |
| 5,469,823 | 11/1995 | Ott et al. | 123/406.62 |
| 5,671,714 | 9/1997 | Fukui et al. | 123/406.62 |

FOREIGN PATENT DOCUMENTS

| | | |
|---|---|---|
| 7-301142 | 11/1995 | Japan . |
| 8-291757 | 11/1996 | Japan . |
| 9-32620 | 2/1997 | Japan . |
| 9-49453 | 2/1997 | Japan . |

*Primary Examiner*—Erick R. Solis
*Attorney, Agent, or Firm*—Oliff & Berridge, PLC

[57] ABSTRACT

A crank angle detecting apparatus for an internal combustion engine includes a crankshaft operationally coupled to pistons. A crank rotor provided on the crankshaft has a plurality of angular segments, each angular segment includes a group of teeth of different lengths as measured in the circumferential direction of the crankshaft, the group of teeth in each angular segment having a distinct combination. A magnetic sensor faces the teeth for detecting passage of the teeth when the crank rotor rotates. An ECU (electric control unit) receives signals from the magnetic sensor and generates a crank angle signal, wherein the crank angle signal changes in accordance with the combination of the teeth. A camshaft includes a first one hundred eighty degree segment and a second one hundred eighty degree segment. The ECU detects rotation of the camshaft for generating a cam angle signal, wherein the cam angle signal indicates which one of the first and second one hundred eighty degree segments corresponds to a currently detected portion of the camshaft. The ECU discriminates the angular position of the crankshaft, which is indicative of the current point in the engine cycle, based on stored changes of the crank angle signal and of the cam angle signal.

33 Claims, 42 Drawing Sheets

Fig.4(a) crank rotor

Fig.7(a) cam rotor

(about 120° CA)
S1
S2
S3
S4
t1
t2
t3
t4
Fig.9(a) T1
Fig.9(b) T3
Fig.9(c) T2 most (retarded)
Fig.9(d) T4 most (retarded)
Fig.9(e) T2 most (advanced)
Fig.9(f) T4 most (advanced)

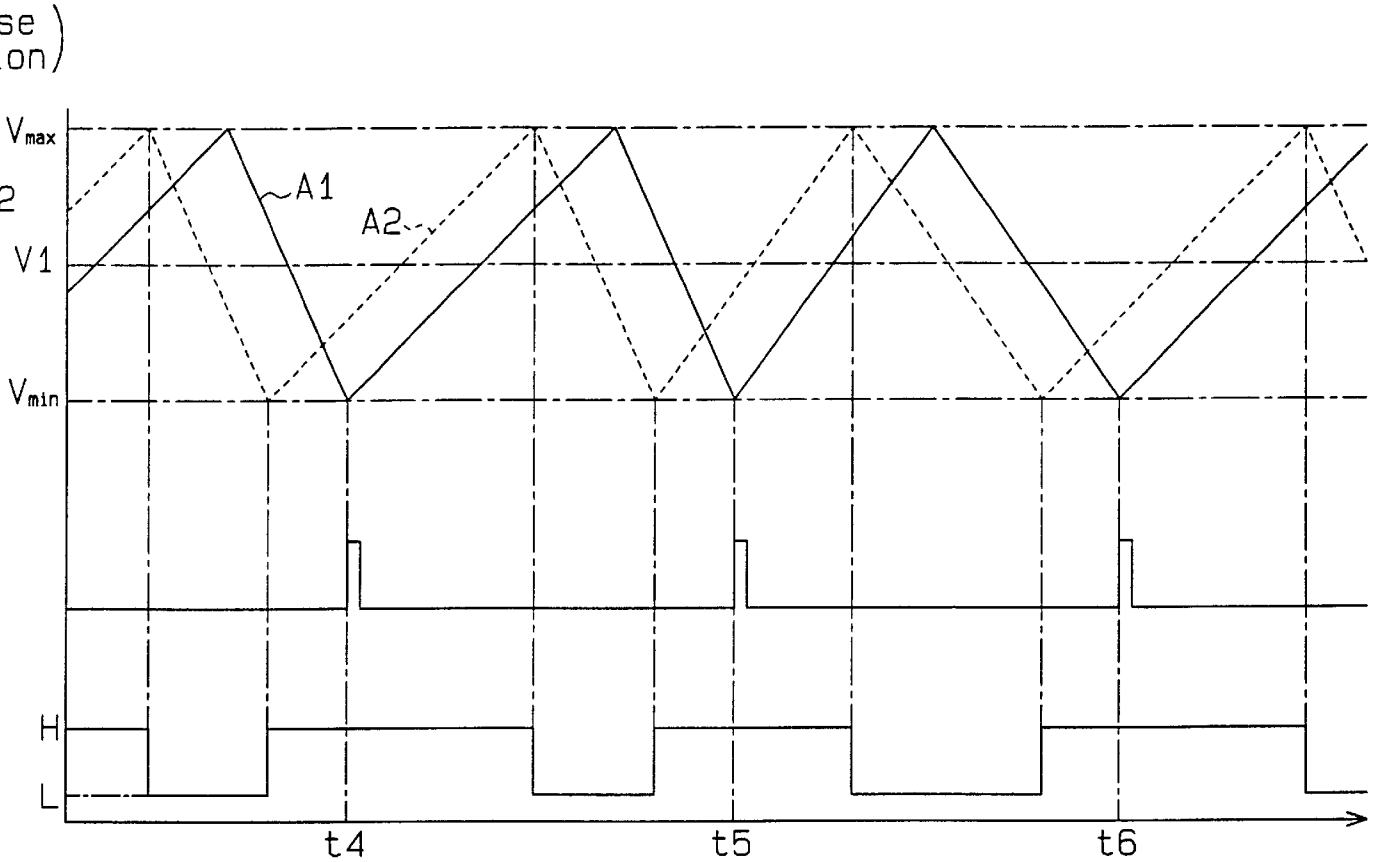
Fig.16(a) A1, A2
Fig.16(b) T1
Fig.16(c) B1

(normal rotation)
Fig.20(a) crank rotor
Fig.20(b) A1, A2
Fig.20(c) C1
Fig.20(d) B1
Fig.20(e) T1
Fig.20(f) T3
Fig.20(g) B2
70S
10° CA
70S
10° CA
X1
Y1
70L
A1
A2
Vmax
V1
Vmin
H
L
H
L
H
L
t1
t2
t3

(normal rotation)
crank rotor

Fig.22(b) A1, A2
Fig.22(c) B1
Fig.22(d) T1
Fig.22(e) C1
Fig.22(f) D1
Y1
X1
10° CA
10° CA
Vmax
V1
Vmin
H
L
H
L
H
M
L
t1
t2
t3

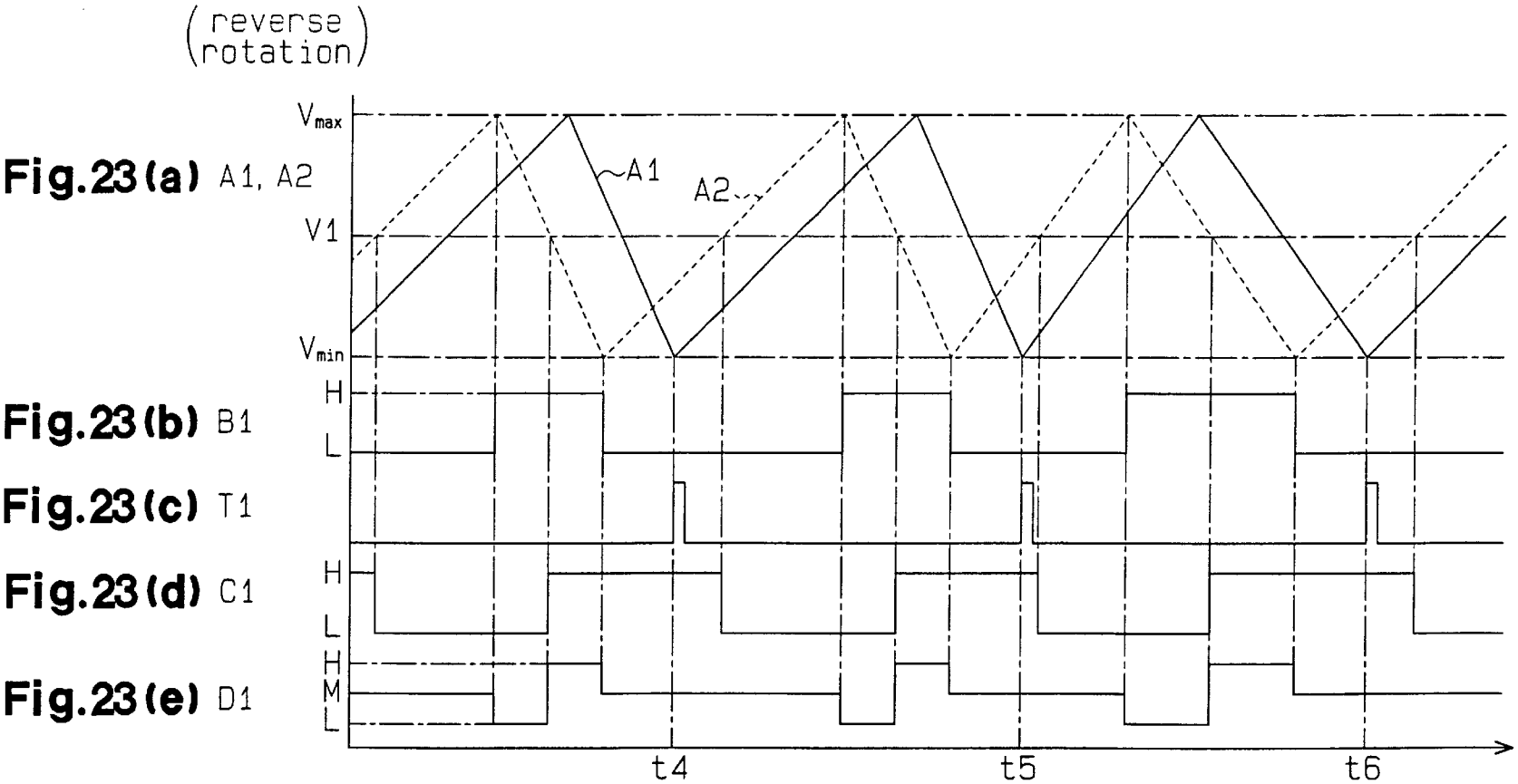
Fig.23(a) A1, A2
Fig.23(b) B1
Fig.23(c) T1
Fig.23(d) C1
Fig.23(e) D1

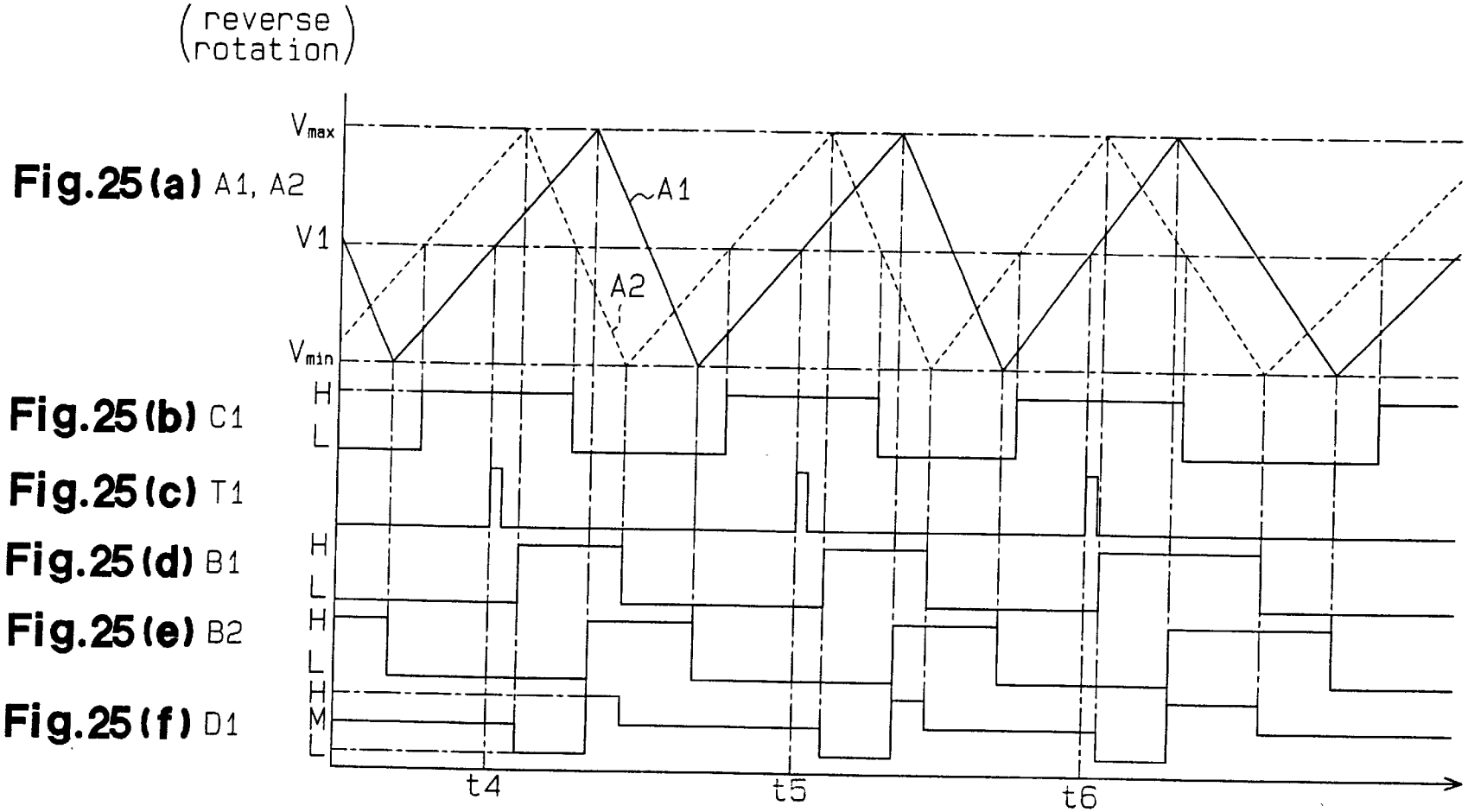
Fig.25(a) A1, A2
Fig.25(b) C1
Fig.25(c) T1
Fig.25(d) B1
Fig.25(e) B2
Fig.25(f) D1

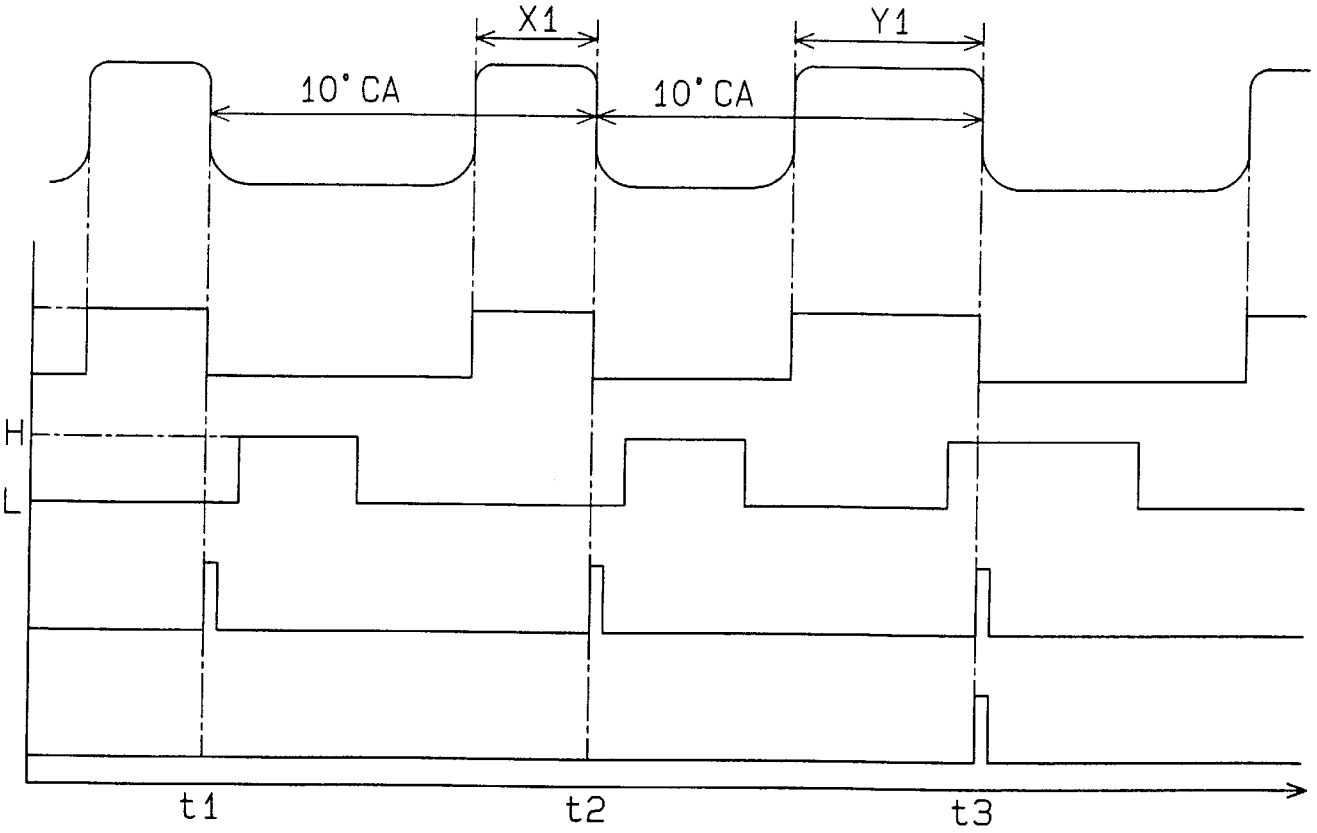
Fig.26(a) crank rotor
Fig.26(b) A1
Fig.26(c) A2
Fig.26(d) T1
Fig.26(e) T3

E1
TE1

C

Vo
E1

TE2

Vo
t1
time

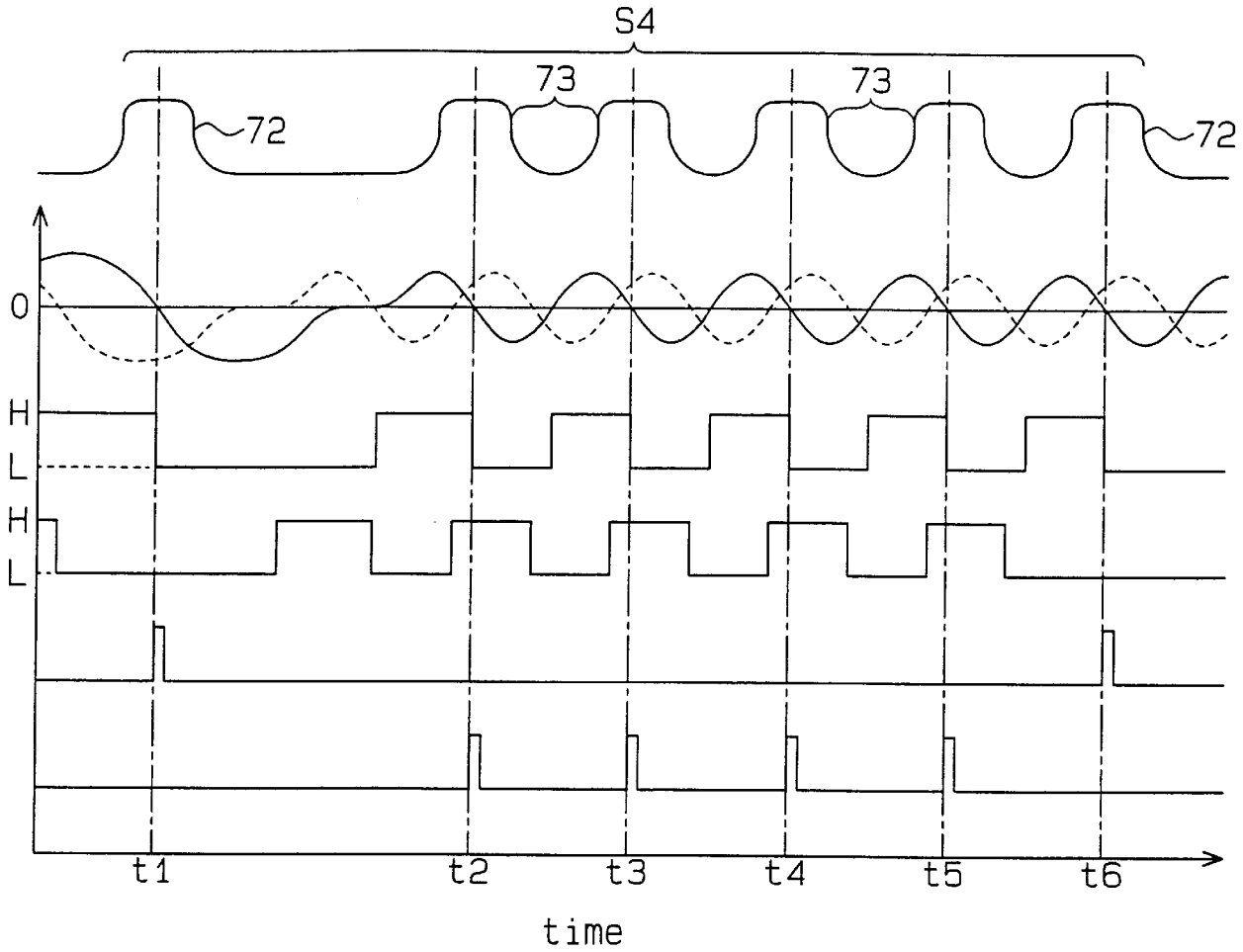
Fig.37(a) crank rotor
Fig.37(b) DSG1 DSG2
Fig.37(c) TSG1
Fig.37(d) TSG2
Fig.37(e) CRSG1
Fig.37(f) CRSG2

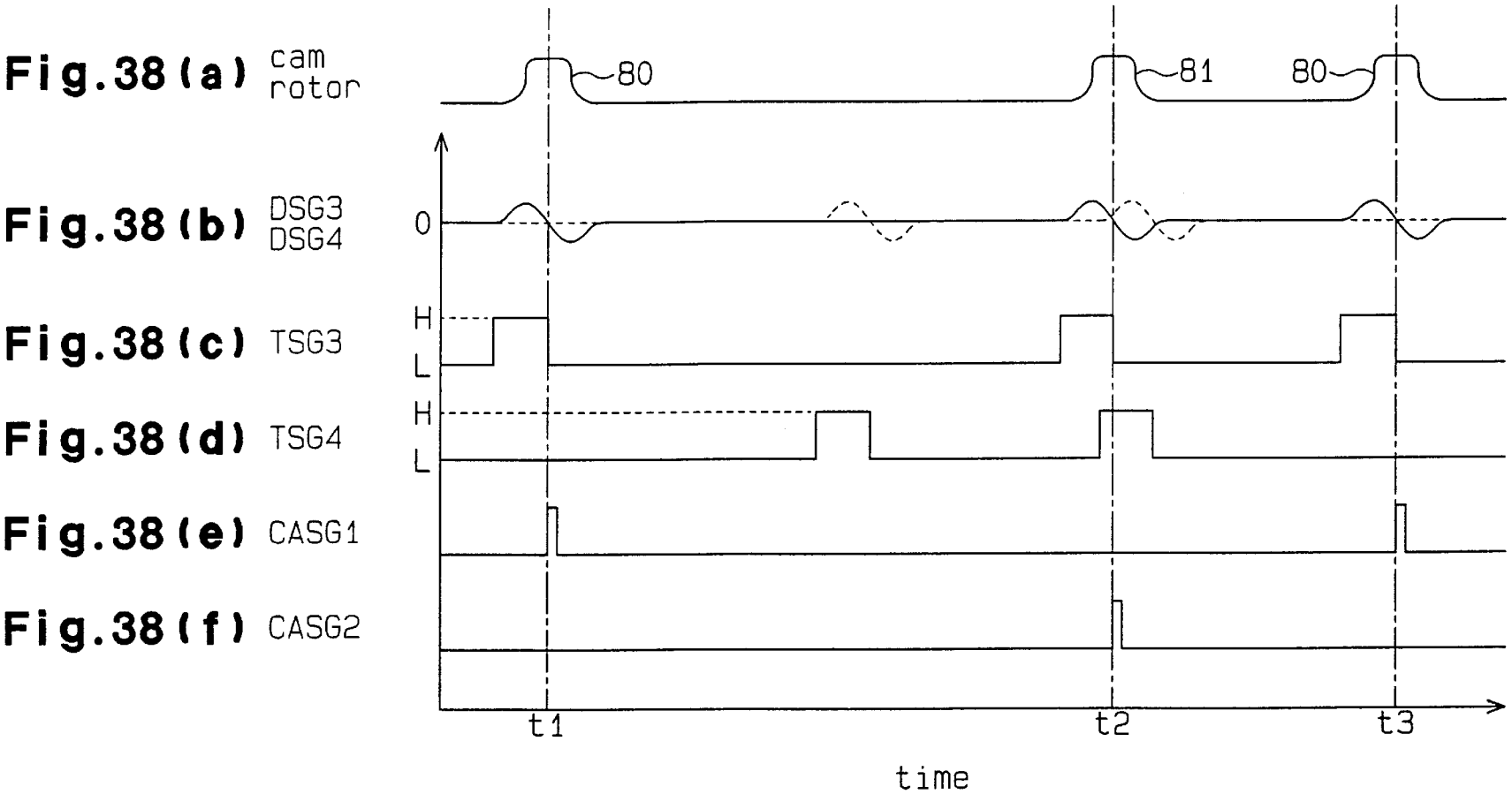
Fig.38(a) cam rotor
Fig.38(b) DSG3 DSG4
Fig.38(c) TSG3
Fig.38(d) TSG4
Fig.38(e) CASG1
Fig.38(f) CASG2
80
81
80
0
H
L
H
L
t1
t2
t3
time

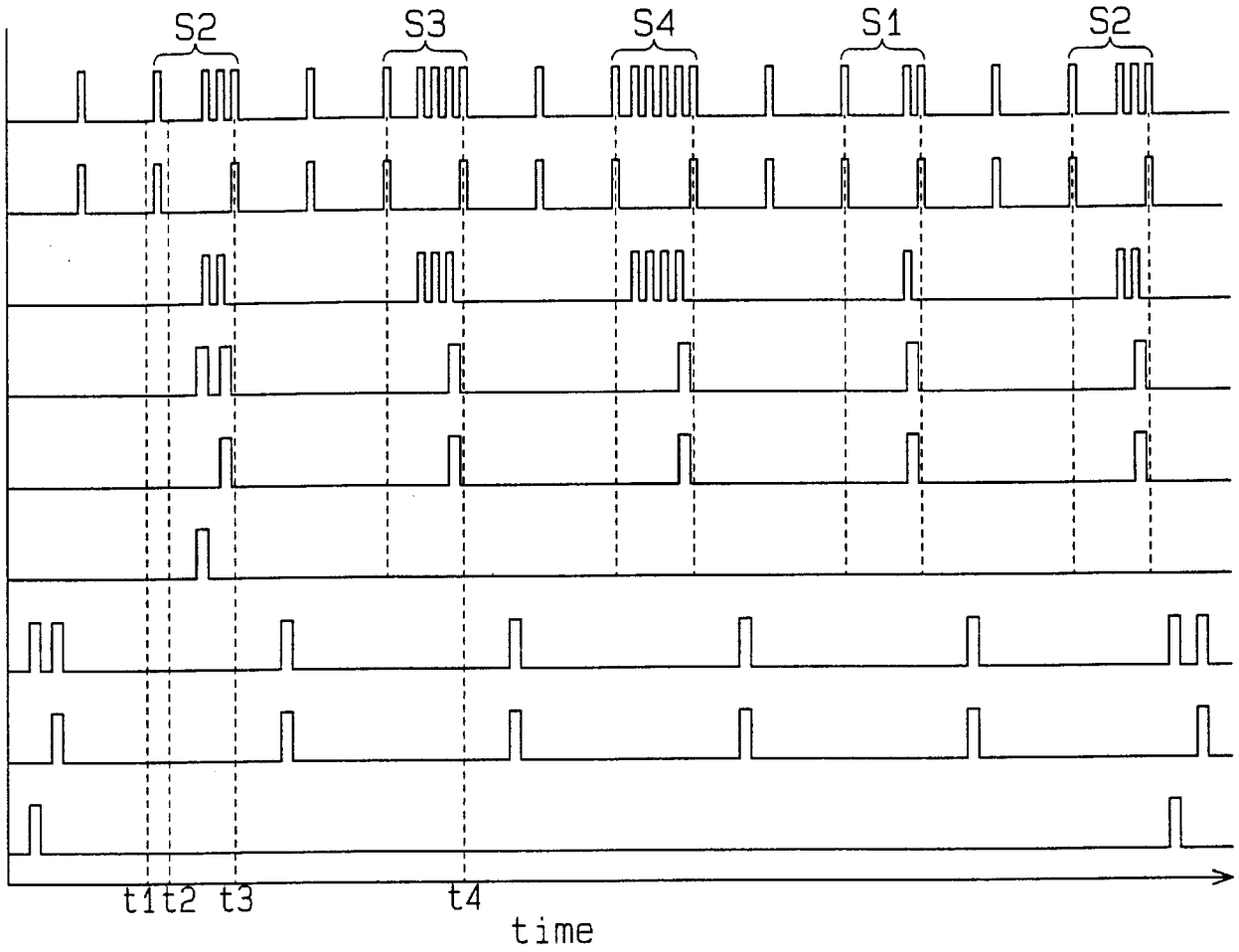
Fig.39(a) crank rotor
Fig.39(b) CRSG1
Fig.39(c) CRSG2
Fig.39(d) cam rotor
Fig.39(e) CASG1
Fig.39(f) CASG2
Fig.39(g) cam rotor
Fig.39(h) CASG1
Fig.39(i) CASG2

Fig.46(a) crank rotor

Fig.46(b) B1, B2

Fig.46(c) DSG1

Fig.46(d) TSG1

Fig.46(e) B2, B3

Fig.46(f) DSG2

Fig.46(g) TSG2

Fig.46(h) CRSG1

Fig.46(i) CRSG2

Fig.47 (a) cam rotor

Fig.47 (b) C1, C2

Fig.47 (c) DSG3

Fig.47 (d) TSG3

Fig.47 (e) C2, C3

Fig.47 (f) DSG4

Fig.47 (g) TSG4

Fig.47 (i) CASG1

Fig.47 (h) CASG2

CRANK ANGLE DETECTING APPARATUS OF INTERNAL COMBUSTION ENGINE

BACKGROUND OF THE INVENTION

The present invention relates to an apparatus for detecting the rotational angle of the crankshaft, or the crank angle, of an internal combustion engine.

The piston in each cylinder of an internal combustion engine is connected to a crankshaft by a connecting rod. Reciprocation of the pistons rotates the crankshaft. The position of each piston in the associated cylinder is detected based on the rotational angle of the crankshaft, or the crank angle. The crank angle is detected by a crank angle detecting apparatus. The detected crank angle is referred to in several engine control procedures that are performed in synchronization with the strokes (intake, compression, expansion and exhaust strokes) of the engine cycle. Specifically, engine control procedures such as ignition timing control and injection timing control are performed based on the crank angle.

Japanese Unexamined Patent Publication No. 5-288112 discloses a crank angle detecting apparatus that includes a rotational speed sensor located in the vicinity of the crankshaft and a cylinder distinguishing sensor located in the vicinity of the camshaft. The rotational speed sensor includes a crank rotor secured to the crankshaft and an electromagnetic pickup facing the crank rotor. The crank rotor has teeth that are angularly spaced apart by thirty degrees and a vacant space that has no tooth and is sixty degrees wide. The rotational speed sensor outputs a pulse, or rotational speed signal, every time each tooth passes by the pickup.

The cylinder distinguishing sensor includes a cam rotor secured to the camshaft and an electromagnetic pickup facing the cam rotor. The cam rotor has a detection tooth. The distinguishing sensor outputs a cylinder distinguishing signal every time the pickup detects the detection tooth. In other words, the distinguishing signal is output every time the cam rotor rotates three hundred sixty degrees, which corresponds to a crank angle of seven hundred twenty degrees.

The rotational speed signal that is output right after the vacant space has passed by the pickup is defined as a reference position signal. The number of rotational speed signals generated after the reference position signal is counted. If the cylinder distinguishing signal is output at the same time the number of the rotational speed signals reaches a predetermined number, the crank angle that corresponds to a certain stroke of each cylinder is determined. In other words, cylinder distinction is executed.

In this manner, cylinder distinction is executed by means of two sensors (the rotational speed sensor and the cylinder distinguishing sensor) for determining specific cylinders to ignite or to inject with fuel. Further, cylinder distinction is executed after the reference position signal is output, that is, only after the vacant space passes by the pickup.

However, if the engine is stopped immediately after the vacant space has passed by the pickup, cylinder distinction will not be executed immediately after restarting the engine. That is, when the engine is restarted, cylinder distinction is not executed until the crankshaft is rotated by nearly three hundred and sixty degrees, or until the vacant space passes by the pickup of the rotational speed sensor. The delay in cylinder distinction hinders engine starting.

SUMMARY OF THE INVENTION

Accordingly, it is an objective of the present invention to provide a crank angle detecting apparatus that executes cylinder distinction immediately after the engine is started.

To achieve the foregoing and other objectives and in accordance with the purpose of the present invention, a crank angle detecting apparatus for an internal combustion engine is provided. The engine has a plurality of cylinders, each cylinder retaining a piston. A crankshaft is operationally coupled to the pistons such that the crankshaft rotates twice per engine cycle and the position of each piston depends upon the rotational position of the crankshaft. The crank angle detecting apparatus includes a crank rotor, a detector, a crank angle signal generator, a first memory a camshaft, a cam angle signal generator and a discriminator. The crank rotor is provided on the crankshaft to rotate with the crankshaft and a plurality of angular segments. Each angular segment includes a group of indicia of different lengths as measured in the circumferential direction of the crankshaft. The group of indicia in each angular segment has a distinct combination. The detector faces the indicia for detecting passage of the indicia when the crank rotor rotates. The crank angle signal generator receives signals from the detector and for generating a crank angle signal. The crank angle signal changes in accordance with the combination of the indicia. The first memory stores the changes of the crank angle signal. The camshaft is rotated once per engine cycle by the crankshaft and includes a first one hundred eighty degree segment and a second one hundred eighty degree segment. The cam angle signal generator detects rotation of the camshaft for generating a cam angle signal and. The cam angle signal indicates which one of the first and second one hundred eighty degree segments corresponds to a currently detected portion of the camshaft. The discriminator discriminates the angular position of the crankshaft, which is indicative of the current point in the engine cycle, based on stored changes of the crank angle signal and of the cam angle signal.

The present invention further provides a crank angle detecting apparatus for an internal combustion engine, wherein the engine has a plurality of cylinders, each cylinder retaining a piston, and wherein a crankshaft is operationally coupled to the pistons such that the crankshaft rotates twice per engine cycle and the position of each piston depends upon the rotational position of the crankshaft. A crank rotor is provided on the crankshaft to rotate with the crankshaft, the crank rotor having a plurality of angular segments, each angular segment includes a pair of first indicia that define the size of the segment and at least one second indicia located between the first indicia, wherein the number of the second indicia is different in each segment. A detector faces the indicia for generating a signal corresponding to the indicia in each segment when the crank rotor rotates. A counter is provided for counting the number of second indicia in each segment based on signals from the detector. A camshaft is rotated once per engine cycle by the crankshaft, the camshaft including a first one hundred eighty degree segment and a second one hundred eighty degree segment. A cam angle signal generator detects rotation of the camshaft for generating a cam angle signal, wherein the cam angle signal indicates which one of the first and second one hundred eighty degree segments corresponds to a currently detected portion of the camshaft. A discriminator is provided for discriminating the angular position of the crankshaft, which is indicative of the current point in the engine cycle based on the count value of the counter and the cam angle signal.

Other aspects and advantages of the invention will become apparent from the following description, taken in conjunction with the accompanying drawings, illustrating by way of example of the principles of the invention.

BRIEF DESCRIPTION OF THE DRAWINGS

The invention, together with objects and advantages thereof, may best be understood by reference to the following description of the presently preferred embodiments together with the accompanying drawings in which:

FIGS. 16(*a*)–16(*c*) are timing charts, like FIGS. 15(*a*)–15(*f*), in which the crank rotor is rotating in the reverse direction;

FIGS. 23(*a*)–23(*e*) are timing charts, like FIGS. 22(*a*)–22(*f*), in which the crank rotor is rotating in the reverse direction;

FIGS. 25(*a*)–25(*e*) are timing charts, like FIGS. 24(*a*)–24(*g*), in which the crank rotor is rotating in the reverse direction;

FIG. 26(*a*)–26(*e*) are timing charts showing changes, over time, of signals in relation to the teeth on a crank rotor according to a sixth embodiment;

FIGS. 37(*a*)–37(*f*) are timing charts showing changes, over time, of signals in relation to the teeth on the crank rotor of FIG. 29;

FIGS. 38(*a*)–38(*f*) are timing charts showing changes, over time, of signals in relation to the teeth on the cam rotor of FIG. 31;

FIGS. 39(*a*)–39(*i*) are timing charts showing changes, over time, of a crank reference angle signal, a crank distinction signal, a cam reference angle signal and a cam distinction signal;

DETAILED DESCRIPTION OF THE PREFERRED EMBODIMENTS

Figure 1:
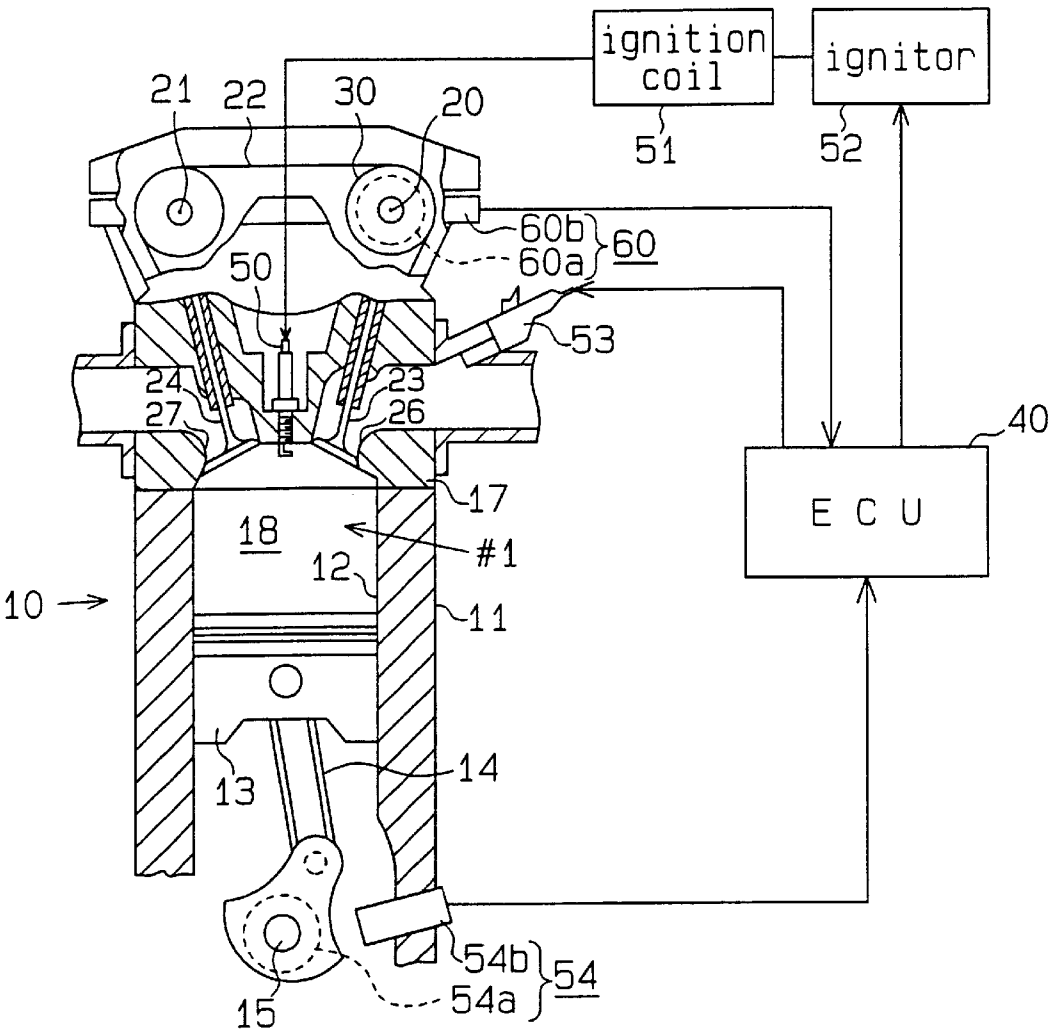
FIG. 1 is a cross-sectional view illustrating a crank angle detecting apparatus according to a first embodiment of the present invention.

A crank angle detecting apparatus according to a first embodiment of the present invention will now be described with reference to FIGS. 1–14. The apparatus is used in a four-cycle gasoline engine 10. As shown in FIG. 1, the engine 10 includes a cylinder block 11 and a cylinder head 17 located on top of the cylinder block 11. The cylinder block 11 has eight cylinders 12 (only the first cylinder #1 is shown in the drawing). Each cylinder 12 reciprocally houses a piston 13, which is coupled to a crankshaft 15 by a connecting rod 14. The cylinder block 11, the cylinder head 17 and the pistons 13 define combustion chambers 18.

Each combustion chamber 18 communicates with an intake port 26 and an exhaust port 27, which are formed in the cylinder head 17. The cylinder head 17 supports an intake camshaft 20, an exhaust camshaft 21, intake valves 23 and exhaust valves 24. The intake and exhaust valves 23, 24 are reciprocated by rotation of the intake and exhaust camshafts 20, 21, respectively. The camshafts 20, 21 are coupled to the crankshaft 15 by a timing belt 22. Four strokes (intake, compression, combustion and exhaust strokes) of the piston 13 in each cylinder #1–#8 rotate the crankshaft 15 two times. Two turns of the crankshaft 15 rotate the camshafts 20, 21 once. Rotation of the camshafts 20, 21 reciprocates the valves 23, 24. Accordingly, the valves 23, 24 selectively open and close the associated intake and exhaust valves 23, 24 in accordance with a predetermined timing.

The engine 10 has a valve timing changing mechanism (VVT) 30 for changing the valve timing of the intake valves 23. The VVT 30 changes the rotational phase of the intake camshaft 20 thereby changing the valve timing of the intake valves 23. The VVT 30 is controlled by an electronic control unit (ECU) 40.

The cylinder head 17 includes ignition plugs 50, each of which corresponds to one of the cylinders #1–#8. The plugs 50 are electrically connected with an ignition coil 51. The ignition coil 51 supplies high voltage to the plugs 50, which causes each plug 50 to ignite air-fuel mixture in the associated cylinder. The coil 51 is connected to an ignitor 52, which in turn connected to the ECU 40. The ECU 40 controls the ignitor 52 to adjust the timing of high voltage generation, or the ignition timing.

Electromagnetic valve type injectors 53 are located in the vicinity of the cylinder 17. Each injector 53 corresponds to one of the cylinders #1–#8 and injects fuel into the corresponding intake port 26. The timing of the fuel injection and the amount of injected fuel are controlled by the ECU 40. Specifically, the ECU 40 controls the opening timing of the injectors 53.

A crank position sensor 54 is located in the vicinity of the crankshaft 15. The crank position sensor 54 includes a crank rotor 54*a*, which is fixed to the crankshaft 15 to integrally rotate with the crankshaft 15, and an electromagnetic sensor 54*b*, which is fixed to the cylinder block 11 and faces the crank rotor 54*a*.

Figure 2:
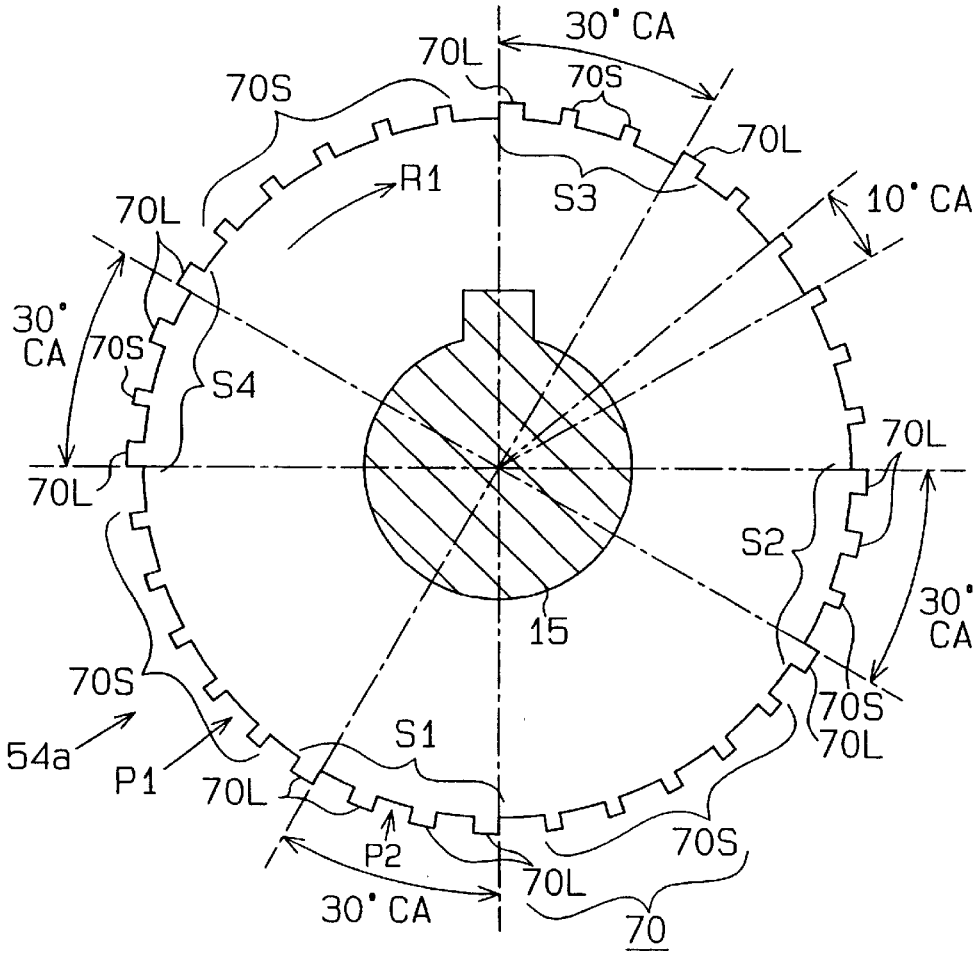
FIG. 2 is a front view illustrating the crank rotor of FIG. 1.

The crank rotor 54*a* is a disk made of magnetic material and has thirty six teeth 70, or indicia, formed on its circumference as illustrated in FIG. 2. Each tooth 70 has a leading edge and a trailing edge. The leading edge refers to the edge that first passes by the sensor 54*b* as the rotor 54*a* rotates, and the trailing edge refers to the opposite edge. The trailing edges of the teeth 70 are spaced at equal angular intervals (ten degrees). The teeth 70 include short teeth 70S and long teeth 70L. The short teeth 70S are relatively short along the circumferential direction of the crank rotor 54*a* while the long teeth 70L are relative long along the circumferential direction of the crank rotor 54*a*.

Specifically, the crank rotor 54*a* has four long teeth 70L that are spaced apart by ninety degrees. The rotor 54*a* has another four long teeth 70L, each of which is spaced apart by thirty degrees from one of the first four long teeth 70L. Each of the first four long teeth 70L and the associated long tooth 70L that is thirty degrees away constitute a pair. Two teeth 70 are located between the long teeth 70L of a pair. Each pair of long teeth 70L and two teeth 70 located in between form a detection segment. The rotor 54*a* has four detection segments S1–S4, which are spaced apart by ninety degrees.

The combination of the teeth 70 between the long teeth 70L in each detection segment S1–S4 is different. Suppose a short tooth 70S is represented by a letter "S" and a long tooth 70L is represented by a letter "L", the sequences of the teeth 70 in the detection segments S1–S4 in a direction opposite the rotational direction R1 of the crank rotor 54*a* are as follows. The sequence of the teeth 70 in the first detection segment S1 is L, L, L, L; the sequence of the second detection segment S2 is L, S, L, L; the sequence of the third detection segment S3 is L, S, S, L; and the sequence of the fourth detection segment S4 is L, L, S, L. The teeth 70 that do not belong to any of the detection segments S1–S4 are all short teeth 70S.

Figure 3:
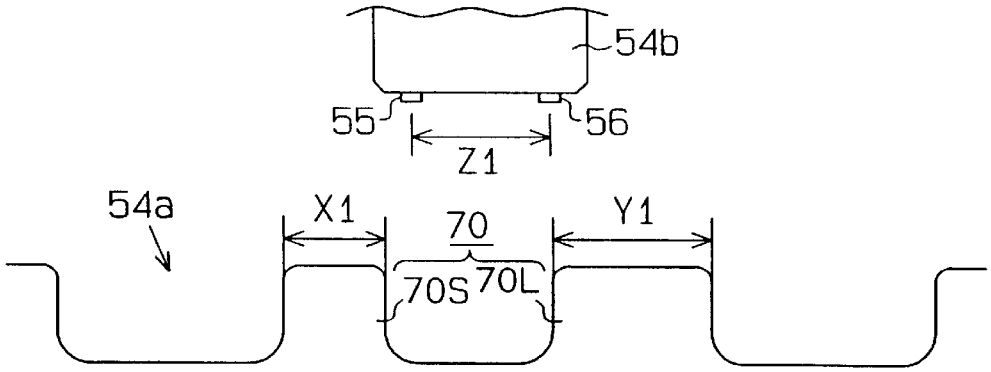
FIG. 3 is a schematic view illustrating the arrangement of sensing elements in the crank position sensor of FIG. 1.

FIG. 3 is a developed view illustrating the distal end of the crank sensor 54*b* and a portion of the circumference of the crank rotor 54*a*. The sensor 54*b* has a first sensing element 55 and a second sensing element 56, which are magnetic reluctance element (MRE) type sensors. The first and second portions 55, 56 are arranged along the rotational direction of the crank rotor 54*a*. The distance between the sensing elements 55 and 56, the length X1 of the short teeth 70S and the length Y1 of the long teeth 70L satisfy the following inequality (1).

$$X1<Z1<Y1 \quad (1)$$

Figure 4:
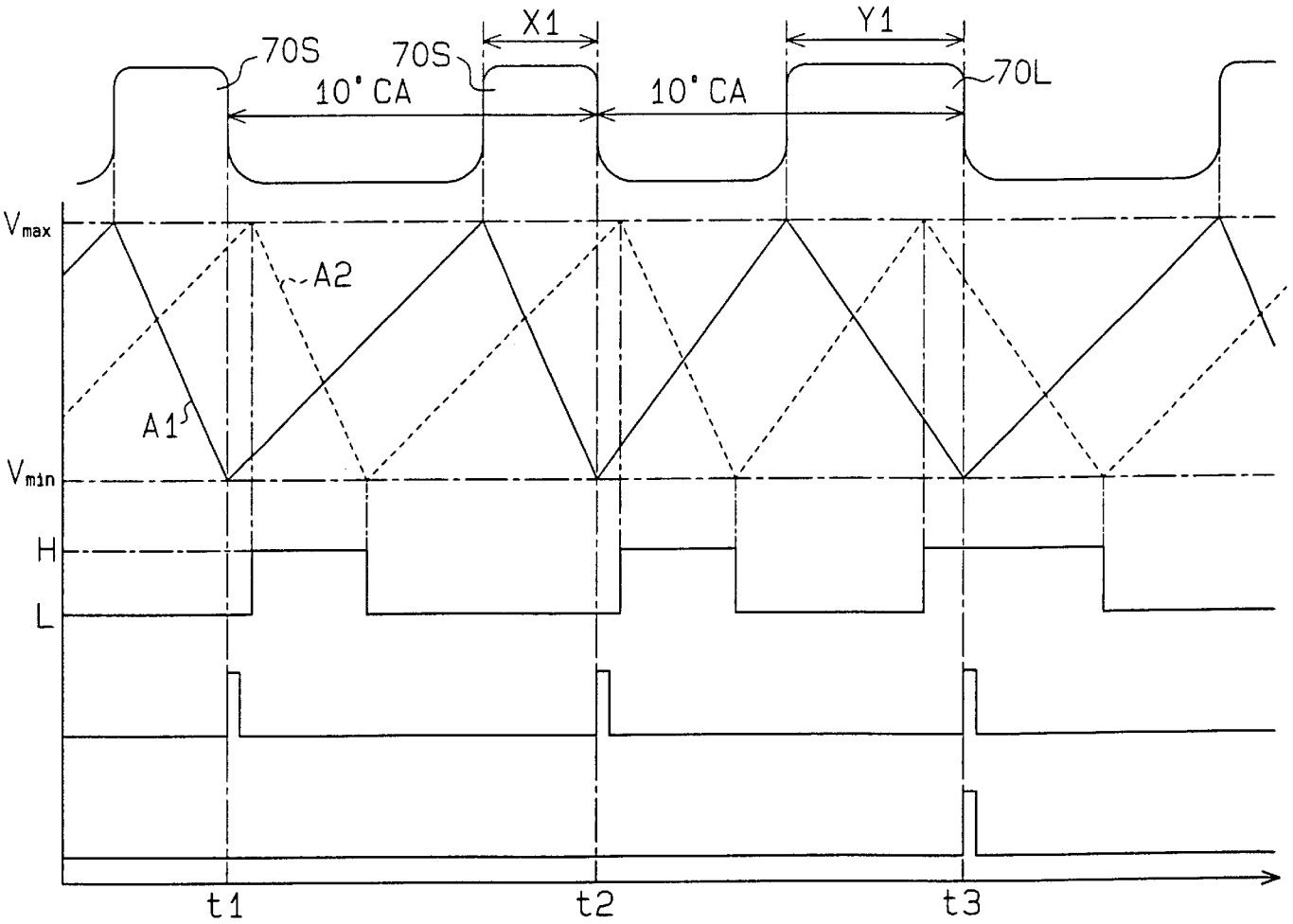
FIGS. 4(*a*)–4(*e*) are timing charts showing changes, over time, of signals in relation to the teeth on the crank rotor of FIG. 2.

As the crank rotor 54*a* rotates, the sensing elements 55, 56 generate signals A1, A2, which change as illustrated in FIG. 4(*b*). In FIG. 4(*b*), the solid line shows the change of the signal A1, which is generated by the first sensing element 55, and the broken line shows the change of the signal A2, which is generated by the second sensing element 56.

The signal A1 is a triangular wave and has a maximum value Vmax when a leading edge of a short tooth 70S or a long tooth 70L is closest to the sensing element 55. The signal A1 has a minimum value Vmin when a trailing edge of a short tooth 70S or a long 70L is closest to the sensing element 55. The signal A2 from the second sensing element 56 is also a triangular wave having a predetermined phase lag with respect to the signal A1.

Since the sensing elements 55, 56 satisfy the inequality (1), the waveform of the signals A1, A2 depends on whether a short tooth 70S or a long tooth 70L passes by the sensing element 55, 56. For example, when the end of a short tooth 70S is close to the first sensing element 55 and the signal A1 has the minimum value Vmin (at times t1, t2), the signal A2 has not reached the maximum value Vmax but is increasing. When the end of a long tooth 70L is close to the first sensing element 55 and the signal A1 has the minimum value Vmin (at a time t3), the signal A2 has already reached the maximum value Vmax and is decreasing. The crank angle sensor according of FIGS. 1–14 uses the tact that the state of the signals A1, A2 changes in accordance with the length of the teeth 70 in order to determine whether a short tooth 70S or a long teeth 70L is passing by the sensing elements 55, 56. Based on this determination, the crank angle sensor detects the crank angle.

The cam position sensor 60 located in the vicinity of the camshaft 20 will now be described. As shown in FIG. 1, the cam position sensor 60 includes a cam rotor 60*a* and an electromagnetic sensor 60*b*. The cam rotor 60*a* is secured to the intake camshaft 20 and rotates integrally with the camshaft 20. The sensor 60*b* is connected to the cylinder head 17 and faces the cam rotor 60*a*.

Figure 5:
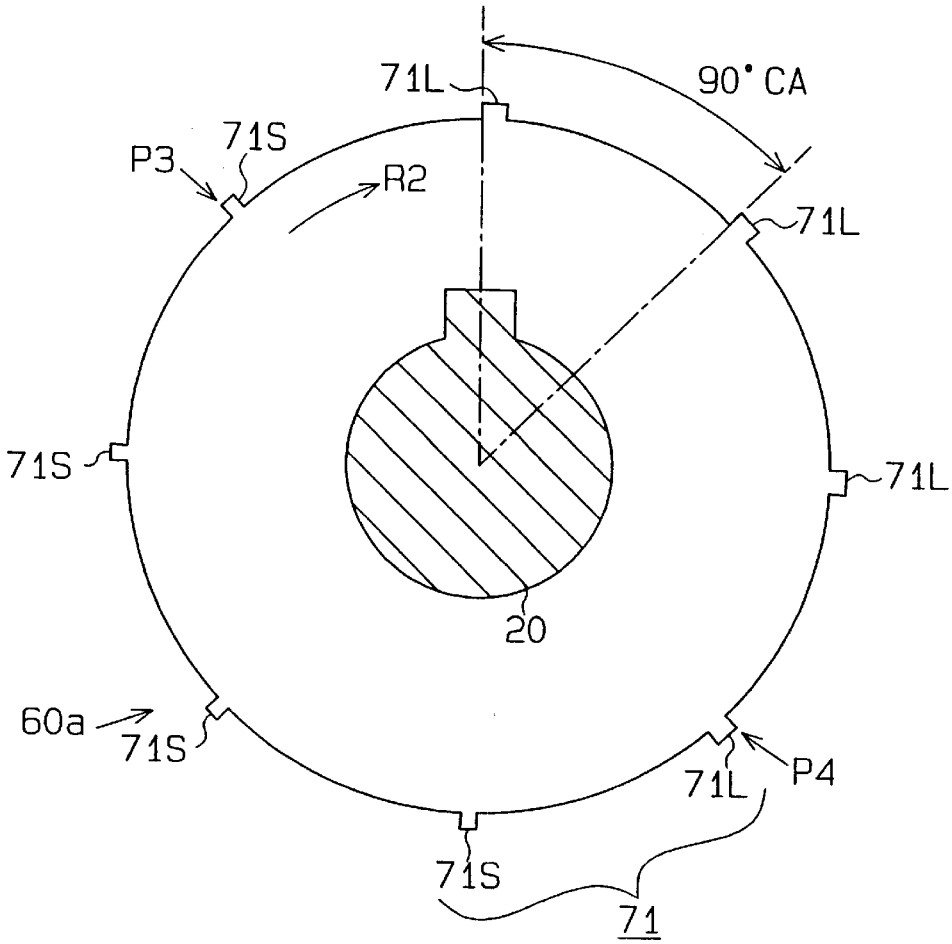
FIG. 5 is a front view illustrating the cam rotor of FIG. 1.

As shown in FIG. 5, the cam rotor 60*a* is a disk made of magnetic material and has eight teeth 71 formed in its circumference. Each tooth 71 has a leading edge and a trailing edge. The leading edge leads in the rotational direction R2 of the cam rotor 60*a* (the intake camshaft 20), that is, it passes by the sensor 60*b* before associated trailing edge as the rotor 60*a* rotates, and the trailing edge refers to the edge that is opposite to the leading edge. The teeth 71 are spaced at equal angular intervals (forty-five degrees, which corresponds to ninety degrees of the crankshaft rotation) with reference to the trailing edges of the teeth 71. Like the teeth 70 of the crank rotor 54*a*, the teeth 71 include short teeth 71S and long teeth 71L. The short teeth 71S are relatively short along the circumferential direction of the cam rotor 60*a*, while the long teeth 71L are relatively long in the circumferential direction of the crank rotor 60*a*.

Specifically, the cam rotor 60*a* has four long teeth 71L, which are spaced apart by forty five degrees (ninety degrees of the crankshaft rotation). The cam rotor 60*a* also has four short teeth 71S, which are spaced apart by forty five degrees (ninety degrees of the crankshaft rotation). The long teeth 71L are located on one side of a plane that includes the axis of the cam rotor 60*a*, and the short teeth 71S are on the other. Suppose a short tooth 71S is represented by a letter "S" and a long tooth 71L is represented by a letter "L", the sequence of the teeth 71 on the cam rotor 60*a* in a direction opposite the rotational direction R2 of the cam rotor 60*a* is "L, L, L, L, S, S, S, S".

Figure 6:
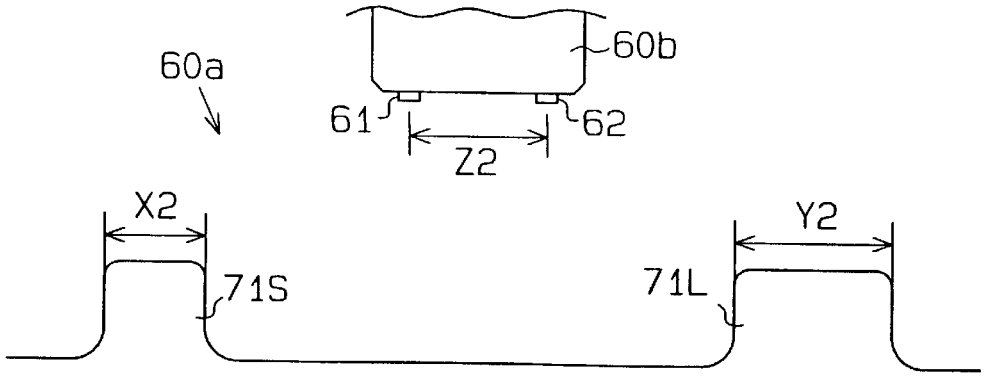
FIG. 6 is a schematic view illustrating the arrangement of sensing elements in the crank position sensor of FIG. 1.

FIG. 6 is a developed view illustrating the distal end of the sensor 60*b* and a portion of the circumference of the cam rotor 60*a*. The sensor 60*b* has a first sensing element 61 and a second sensing element 62, which are Hall element type sensors. The first and second sensing elements 61, 62 are arranged along the rotational direction R2 of the cam rotor 60*a*. The distance Z2 between the sensing elements 61 and 62, the length X2 of the short tooth 71S and the length Y2 of the long tooth 71L satisfy the following inequality.

$$X2<Z2<Y2 \quad (2)$$

Figure 7:
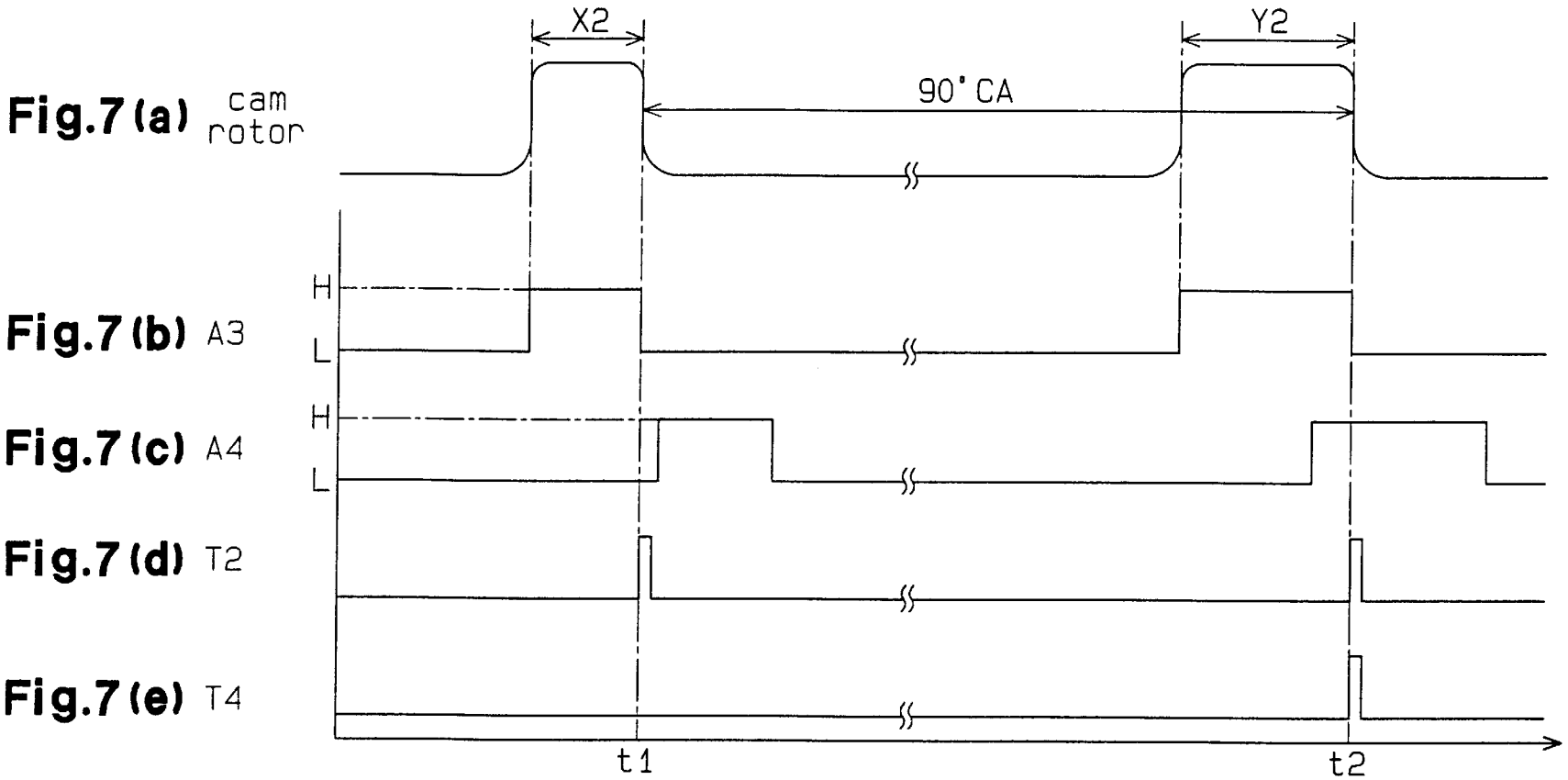
FIGS. 7(*a*)–7(*e*) are timing charts showing changes, over time, of signals in relation to the teeth on the cam position sensor of FIG. 1.

As the cam rotor 60*a* rotates, the sensing elements 61, 62 generate signals A3, A4, which change as illustrated in FIGS. 7(*b*) and 7(*c*). FIG. 7(*a*) shows the shape of the cam rotor 60*a* corresponding to the signal A3 from the first sensing element 61.

As shown in FIG. 7(*b*), the signal A3 from the first sensing element 61 is a rectangular wave. The signal A3 changes from low to high when a leading edge of a short tooth 71S or a long tooth 71L passes by the first sensing element 61. The signal A3 changes from high to low when the trailing edge of a tooth passes by the first sensing element 61. As shown in FIG. 7(*c*), the signal A4 from the second sensing element 62 is also a rectangular wave having a predetermined phase lag with respect to the signal A3.

Since the sensing elements 61, 62 satisfy the inequality (2), the level of the signal A4 when the signal A3 changes from high to low (at times t1 and t2) depends on whether a short tooth 71S or a long tooth 71L is passing the sensing elements 61, 62. For example, when a short tooth 71S passes by the sensing elements 61, 62, the level of the signal A4 low when the signal A3 changes from high to low (the time t1). When a long tooth 71L passes by the sensing elements 61, 62, the level of the signal A4 is high (H) when the signal A3 changes from high to low (the time t2).

The fact that the signals A3 and A4 change in accordance with the length of the passing tooth 71 is used to determine whether a short tooth 71 or a long tooth 71L is passing by the sensing elements 61, 62. This determination is used to judge whether the crankshaft 15 is in the first turn or the second turn of its cycle.

Figure 8:
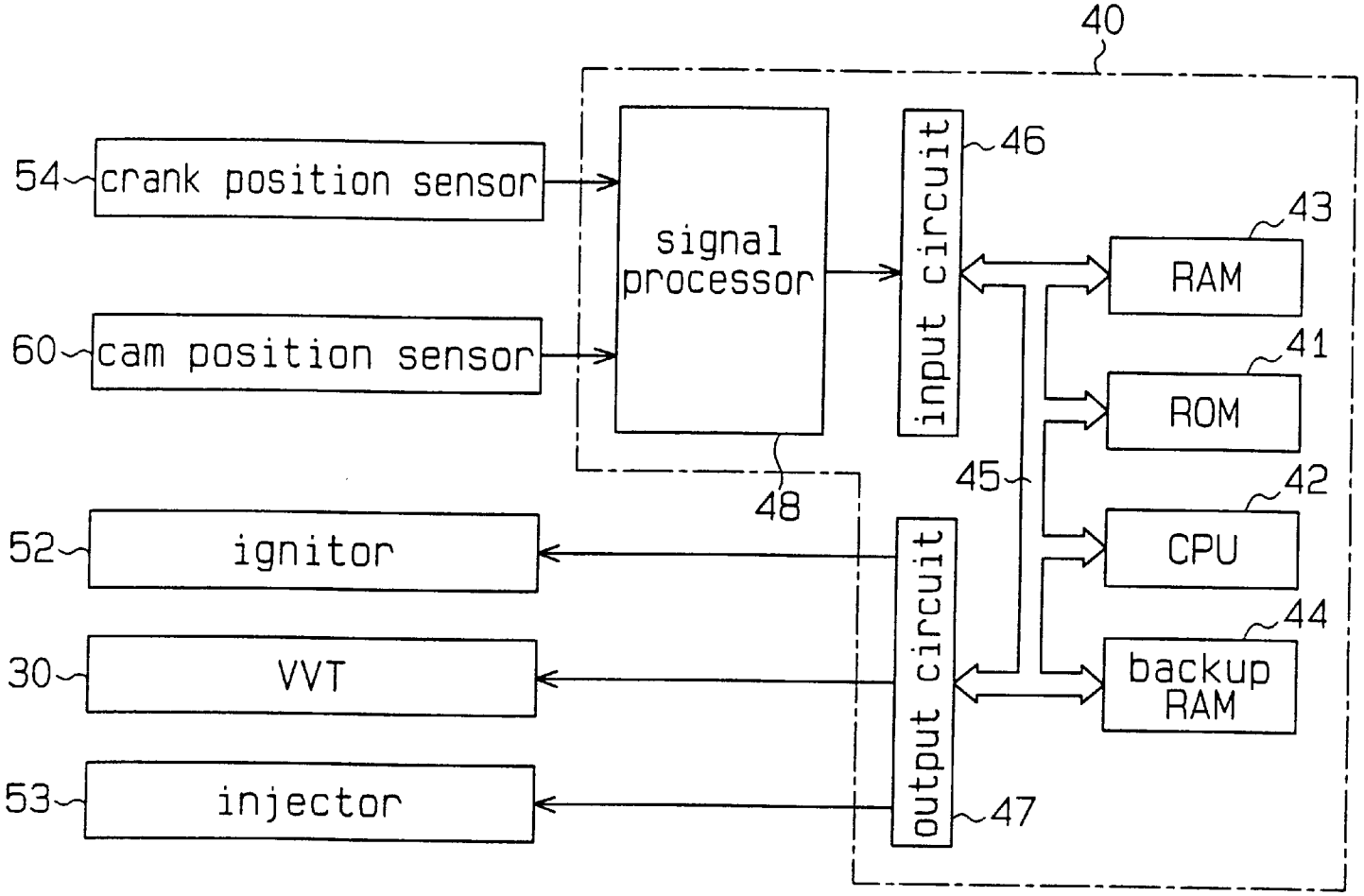
FIG. 8 is a block diagram illustrating the crank angle detecting apparatus of FIG. 1.

The electrical construction of the crank angle detector will now be described with reference to FIG. 8. The ECU 40 includes a ROM 41, a CPU 42, RAM 43 and a backup RAM 44. The ROM 41 stores function data and various control programs. The CPU 42 executes various computations based on the programs. The RAM 43 temporarily stores the result of the computations and data from various sensors. The backup RAM 44 stores data in the RAM 43 when supply of electricity to the ECU 40 is stopped. The CPU 42, the ROM 41, the RAM 43 and the backup RAM 44 are connected to one another by a bidirectional bus 45. The bidirectional bus 45 also connects the CPU 42, the ROM 41, the RAM 43 and the backup RAM 44 to an input circuit 46 and an output circuit 47. The output circuit 47 is connected to the ignitor 52 and to the injector 53. The ignitor 52 and the injector 53 are controlled based on the results of control programs executed by the CPU 42.

The input circuit 46 is connected to a signal processor 48. The signal processor 48 is connected to the crank position sensor 54 and to the cam position sensor 60 and receives signals A1–A4 from the sensing elements 55, 56, 61, 62. The signal processor 48 processes the signals A1–A4 thereby generating regular angle signals T1, T2 and long tooth signals T3, T4. The signal processor 48 then supplies the signals T1–T4 to the input circuit 46.

The regular angle signal T1 and the long tooth signal T3 will now be described. As shown in FIGS. 4(*b*) and 4(*d*), the signal processor 48 creates a pulse in the regular angle signal T1 when the signal A1 from the first sensing element 55 reaches the minimum value Vmin (the times t1, t2 and t3). Therefore, the regular angle signal T1 goes high, or pulses, when the trailing edge of a tooth 70 passes by the first sensing element 55, or every time the crankshaft 15 rotates ten degrees.

As shown in FIG. 4(*c*), the signal processor 48 generates a differentiated signal B1 by differentiating the signal A2, which is output from the second sensing element 56. Since the signal A2 is a triangular wave, the differentiated signal B1 is a rectangular wave. The signal B1 is low when the signal A2 is increasing, and is high when the signal A2 is decreasing. The signal processor 48 produces a pulse in the long tooth pulse signal T3 shown in FIG. 4(*e*) if the regular angle signal T1 is high when the differentiated signal B1 is high (t3). Therefore, the long tooth signal T3 pulses only when the trailing edge of a long tooth 70L passes by the first sensing element 55.

The regular angle signal T2 and the long tooth signal T4 will now be described. As shown in FIGS. 7(*b*) and 7(*d*), the signal processor 48 produces a pulse in the regular angle signal T2 when the signal A3 from the first sensing element 61 changes from high to low, or at times t1 and t2. Therefore, the regular angle signal T2 pulses for every ninety degrees of the crankshaft 15 rotation or forty five degrees of camshaft rotation, that is, when the trailing edge of teeth 71 pass by the first sensing element 61.

The signal processor 48 pulses the long tooth pulse signal T4 shown in FIG. 7(*e*) if the regular angle signal T2 is high when the signal A4 from the second sensing element 62 is high (t2). Therefore, a pulse occurs in the long tooth signal T4 when the trailing edge of a long tooth 71L passes by the first sensing element 61.

As the cam rotor 60*a* rotates, the four long teeth 71L consecutively pass by the sensing elements 61, 62. Then, the four short teeth 71S consecutively pass by the sensing elements 61, 62. Thus, as the cam rotor 60*a* rotates, only the regular angle signal T2 is periodically output during one half of a revolution. During the half, the regular angle signal T2 and the long tooth signal T4 are both output. These periods alternate every time the crankshaft 15 is rotated one turn, or every time the intake camshaft 20 rotates a half turn.

Figure 9:
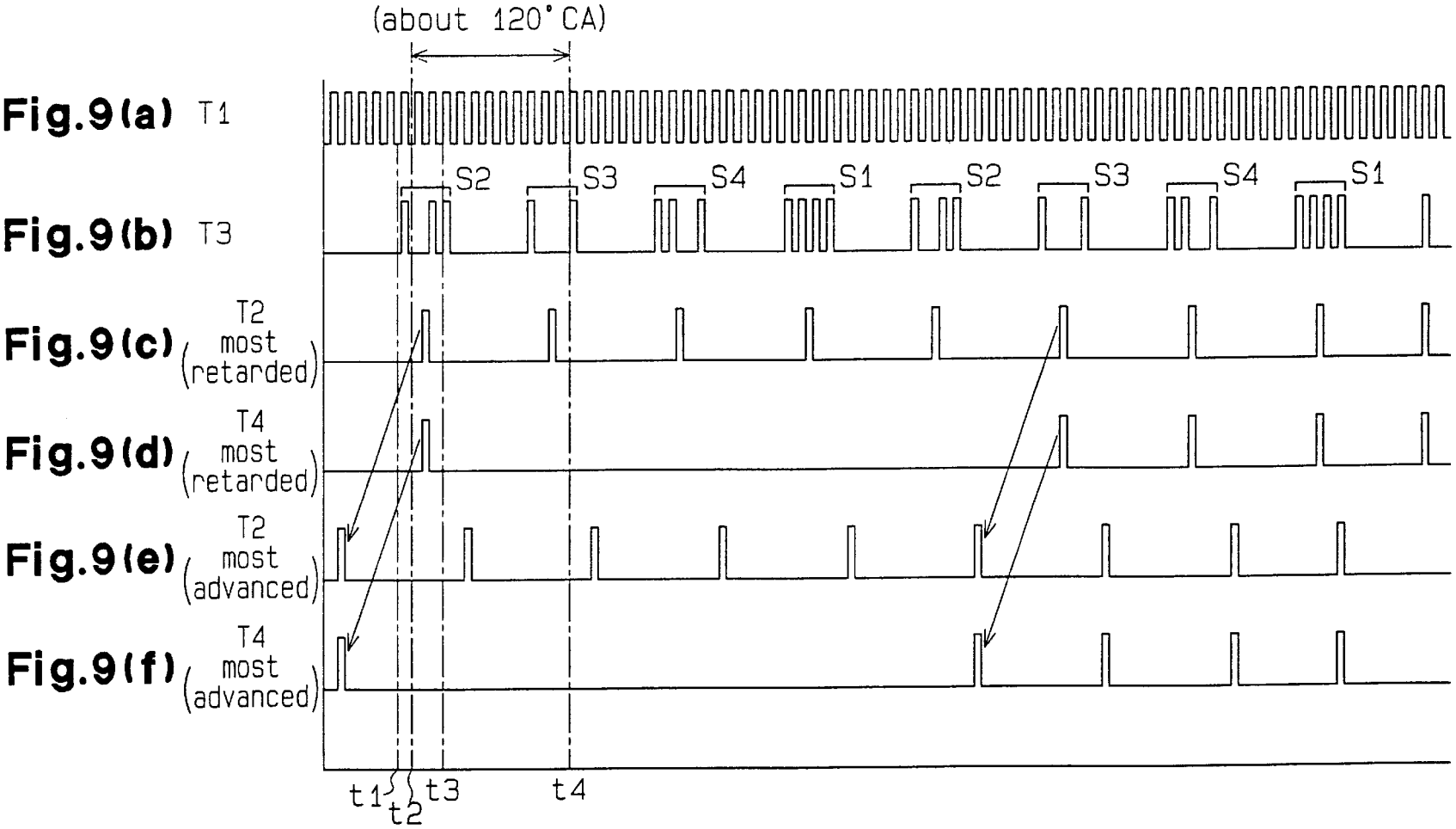
FIGS. 9(*a*)–9(*f*) are timing charts showing changes, over time, of regular angle signals and long tooth signals.

FIGS. 9(*a*)–9(*f*) show the changes of the signals T1–T4. FIGS. 9(*c*) and 9(*d*) show the changes of the regular angle signal T2 and the long tooth signal T4 when the valve timing of the intake valves 23 is most retarded by the VVT 30. The FIGS. 9(*e*) and 9(*f*) show the changes of the signal T2 and the signal T4 when the valve timing of the intake valve 23 is most advanced by the VVT 30.

As shown in FIGS. 9(*c*)–9(*f*), the timing of the pulses of the signals T2 and T4 are changed by varying the rotational phase of the intake camshaft 20 by the VVT 30. However, when cranking the engine 10, the valve timing of the intake valves 23 is most retarded by the VVT 30. Thus, as shown in FIGS. 9(*b*), 9(*c*) and 9(*d*), the regular angle signal T2 and the long tooth signal T4 are high during the range of one of the detection segments S1–S4.

Figure 10:
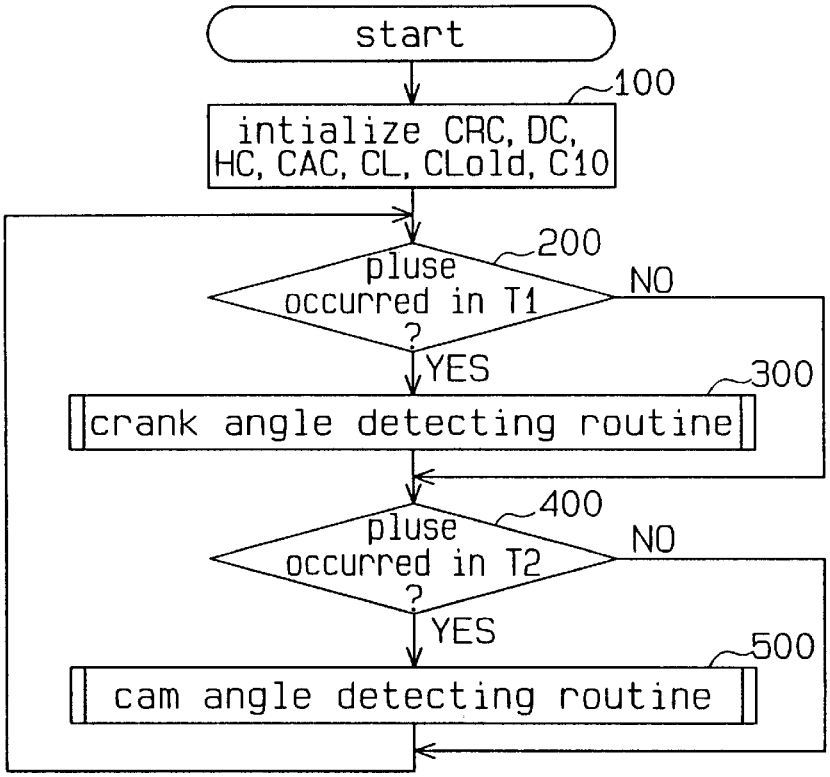
FIGS. 10–13 are flowcharts showing a main routine executed by the ECU of FIG. 8.

The operation of the crank angle detecting apparatus will now be described with reference to FIGS. 10–14. A main routine executed by the ECU 40 will first be described with reference to FIG. 10. The main routine is initiated by turning an ignition switch (not shown) to an ON position. The flowchart of FIG. 10 shows only principle steps in the routine.

At step 100, the ECU 40 initializes a crank counter value CRC, a down counter value DC, a high level counter value HC, a cam counter value CAC, a cam level value CL, a previous cam level value CLold, which is from the previous routine, and a ten degree CA signal counter value C10. The backup RAM 44 stores the initial values of the values CRC, DC, HC, CAC, CL, CLold and C10. In this embodiment, the crank counter value CRC is initialized to one hundred, the down counter value DC is initialized to zero, the high level counter value HC is initialized to zero, the cam counter value CAC is initialized to one hundred, the cam level counter value CL is initialized to one hundred, the cam level value CLold is initialized to one hundred and the ten degree CA signal counter value C10 is initialized to one hundred.

At step 200, the ECU 40 judges whether there has been a pulse in the regular angle signal T1. If the determination is positive, the ECU 40 moves to step 300 and executes a routine for detecting the crank angle. The routine for detecting the crank angle is repeatedly executed as an interrupt at every ten degrees rotation of the crankshaft 15. If the determination is negative at step 200 or after executing the crank angle detecting routine, the ECU 40 moves to step 400.

At step 400, the ECU 40 judges whether a pulse has occurred in the regular angle signal T2. If the determination is positive, the ECU 40 moves to step 500 and executes a routine for detecting the angle of the intake camshaft 20. The routine for detecting the cam angle is repeatedly executed as an interrupt at every ninety degrees rotation of the crankshaft 15. If the determination is negative at step 400 or after executing the cam angle detecting routine, the ECU 40 returns to step 200.

Each process in the crank angle detecting routine will now be described with reference to FIGS. 11–13. At step 310, the ECU 40 judges whether the crank counter value CRC is one hundred. The ignition timing control and the fuel injection timing control are executed based on the crank counter value CRC. The value CRC corresponds to the crank angle, which indicates the current piston stroke of each cylinder #1–#8. Therefore, the ignition timing and the fuel injection timing controls are executed in synchronization with the strokes of the cylinders #1–#8. The value CRC is maintained at one hundred until cylinder distinction is finished. When cylinder distinction is finished, the value CRC is incremented from its value at the completion of cylinder distinction by one at every thirty degree increase of the crank angle. When it reaches twenty-four, the value CRC is set to zero, and again, is incremented by one at every thirty degree increase of the crank angle. If the determination at step 310 is positive, the ECU 40 judges that cylinder distinction has not been completed and moves to step 312.

At step 312, the ECU 40 judges whether the down counter value DC is zero. The value DC is used to determine when to execute cylinder distinction. The value DC is decremented from three by one. When the value DC is zero, cylinder distinction, (steps 331 and 332) which will be described later, is performed. If the determination at step 312 is positive, the ECU 40 moves to step 314, which is shown in FIG. 12.

At step 314, the ECU 40 judges whether a pulse is occurring in the long tooth signal T3. If the determination is negative, the ECU 40 temporarily suspends the current routine. If the determination is positive at step 314, the ECU 40 determines that the teeth 70 of one of the detection segments S1–S4 are passing by the sensing elements 55, 56 of the crank position sensor 54 and moves to step 316.

At step 316, the ECU 40 sets the down counter value DC to three and stores the value DC in the RAM 43. Subsequently, the ECU 40 sets the high level counter value HC to two at step 318. The ECU 40 then stores the value HC in the RAM 43 and temporarily suspends the current routine.

If the determination is negative at step 312, the ECU 40 judges that a pulse has occurred in the long tooth signal T3 at least once since the current routine was started and moves to step 320. At step 320, the ECU 40 decrements the down counter value DC by one and moves to step 322, which is shown in FIG. 12.

At step 322, the ECU 40 judges whether the long tooth signal T3 is high. If the determination is positive, the ECU 40 moves to step 323. At step 323, the ECU 40 doubles the current high level counter value HC and substitutes the resultant for the new high level high level counter value HC. The ECU 40 then stores the value HC in the RAM 43.

If the determination is negative at step 322, the ECU 40 moves to step 324. At step 324, the ECU 40 adds one to the current high level counter value HC and substitutes the resultant for the new high level counter value HC. The ECU 40 then stores the value HC in the RAM 43. In this manner, the high level counter value HC is increased in accordance with the type of teeth 70 (a long tooth 70L or a short tooth 70S) that pass by the sensing elements 55 and 56.

The high level counter value HC is used to determine which one of the detection segments S1–S4 has passed by the sensing elements 55, 56. Specifically, when the teeth 70 of one of the segments S1–S4 pass by the sensing elements 55, 56 prior to the completion of cylinder distinction, the ECU 40 identifies the detection segment (S1–S4) referring to the high level counter value HC. For example, when the teeth 70 of the first detection segment S1 pass by the sensing elements 55, 56, the value HC changes in the sequence two, four, eight, sixteen. When the teeth 70 of the second detection segment S2 pass by the sensing elements 55, 56, the value HC changes in the sequence two, three, six, twelve.

When the teeth 70 of the third detection segment S3 pass by the sensing elements 55, 56, the value HC changes in the sequence of two, three, four, eight. When the teeth 70 of the fourth detection segment S4 pass by the sensing elements 55, 56, the value HC changes in the sequence of two, four, five, ten.

As described above, when the teeth 70 of one of the detection segments S1–S4 have passed by the sensing elements 55, 56, the high level counter value HC has a value (sixteen, twelve, eight or ten) depending on which of the segments S1–S4 has passed. The value HC is therefore used to identify the detection segment (S1–S4). Then, the position of the crank rotor 54 a relative to the sensing elements 55, 56, or the position of each piston 13 in the associated cylinder #1–#8, is detected.

After executing steps 323 and 324, the ECU 40 moves to step 326, At step 326, the ECU 40 judges whether the down counter value DC is zero. If the determination is negative, the ECU 40 judges that the crank rotor 54*a* has not rotated thirty degrees since the first pulse of a segment S1–S4 in the long tooth signal T3. In other words, the ECU 40 judges that all the teeth 70 of a detection segment (S1, S2, S3 or S4) have not passed by the sensing elements 55, 56. The ECU 40 then temporarily suspends the current routine.

If the determination is positive at step 326, the ECU 40 moves to step 328. At step 328, the ECU 40 judges whether a pulse is occurring in the long tooth signal T3.

For example, if this routine is started when the position of the sensing elements 55, 56 relative to the crank rotor 54*a* is at the position shown by arrow P1 in FIG. 2, a pulse occurs in the long tooth signal T3 when the ECU 40 moves to step 328. Thus, the determination of step 328 is positive. In this case, all the teeth 70 of the first detection segment S1 have passed by the sensing elements 55, 56.

If this routine is started when the position of the sensing elements 55, 56 relative to the crank rotor 54*a* is at a position shown by arrow P2 in FIG. 2, a pulse does not appear in the long tooth signal T3 when the ECU 40 moves to step 328. Thus, the determination of the step 328 is negative. In this case, the teeth 70 of the first detection area S1 have not all passed by the sensing elements 55, 56.

If the determination is negative at step 328, the ECU 40 moves to step 329. At step 329, the ECU resets the high level counter HC to zero. Further, at step 330, the ECU 40 sets the down counter value DC to zero and temporarily suspends the current routine.

If the determination at step 328 is positive, the ECU 40 moves to step 331. At step 331, the ECU 40 reads the cam level value CL and the high level counter value HC from the RAM 43. The cam level value CL is used to judge if the crankshaft 15 is in its first turn or in its second turn. The value CL is computed in a cam angle detecting routine, which will be described later, and is stored in the RAM 43.

As described above, the position of each piston 13 in the associated cylinder #1–#8 is identified by referring to the high level counter value HC when the teeth 70 of one of the detection segments S1–S4 have passed by the sensing elements 55, 56. However, the crank angle for a certain stroke cannot be determined referring only to the position of each piston 13 in the associated cylinder. This is because the piston 13 occupies every position twice during each rotation of the crankshaft. Thus, this routine refers to the cam level value CL as well as to the high level counter value HC. If, for example, the piston 13 in one of the cylinders #1–#8 is at the top dead center, the ECU 40 judges whether the piston 13 is at the compression top dead center or at the intake top dead center.

At step 331, the ECU 40 reads the cam level value CL and the high counter value HC. At a subsequent step 332, the ECU 40 computes the crank counter value CRC based on the cam level value CL and the high level counter value HC. The ROM 41 stores a function map defining the relationship between the crank counter value CRC, and the cam level value CL and the high level counter value HC. The ECU 40 refers to the map to compute the crank counter value CRC.

Chart 1 below shows the relationship between the cam level value CL, the high level counter value HC and the crank counter value CRC. The ECU 40 sets the crank counter value CRC to eleven when the high level counter value HC is sixteen and the cam level counter CL is one. The ECU 40 sets the crank counter value CRC to two when the high level counter value HC is twelve and the cam level value CL is two.

CHART 1

| | CRC | |
|---|---|---|
| HC | CL = 2 | CL = 1 |
| 16 | 23 | 11 |
| 12 | 2 | 14 |
| 8 | 17 | 5 |
| 10 | 20 | 8 |

At step 334, the ECU 40 sets the ten degree CA counter value C10 to zero. At step 336, the ECU 40 resets the high level counter value HC to zero and temporarily suspends the current routine.

Figure 13:
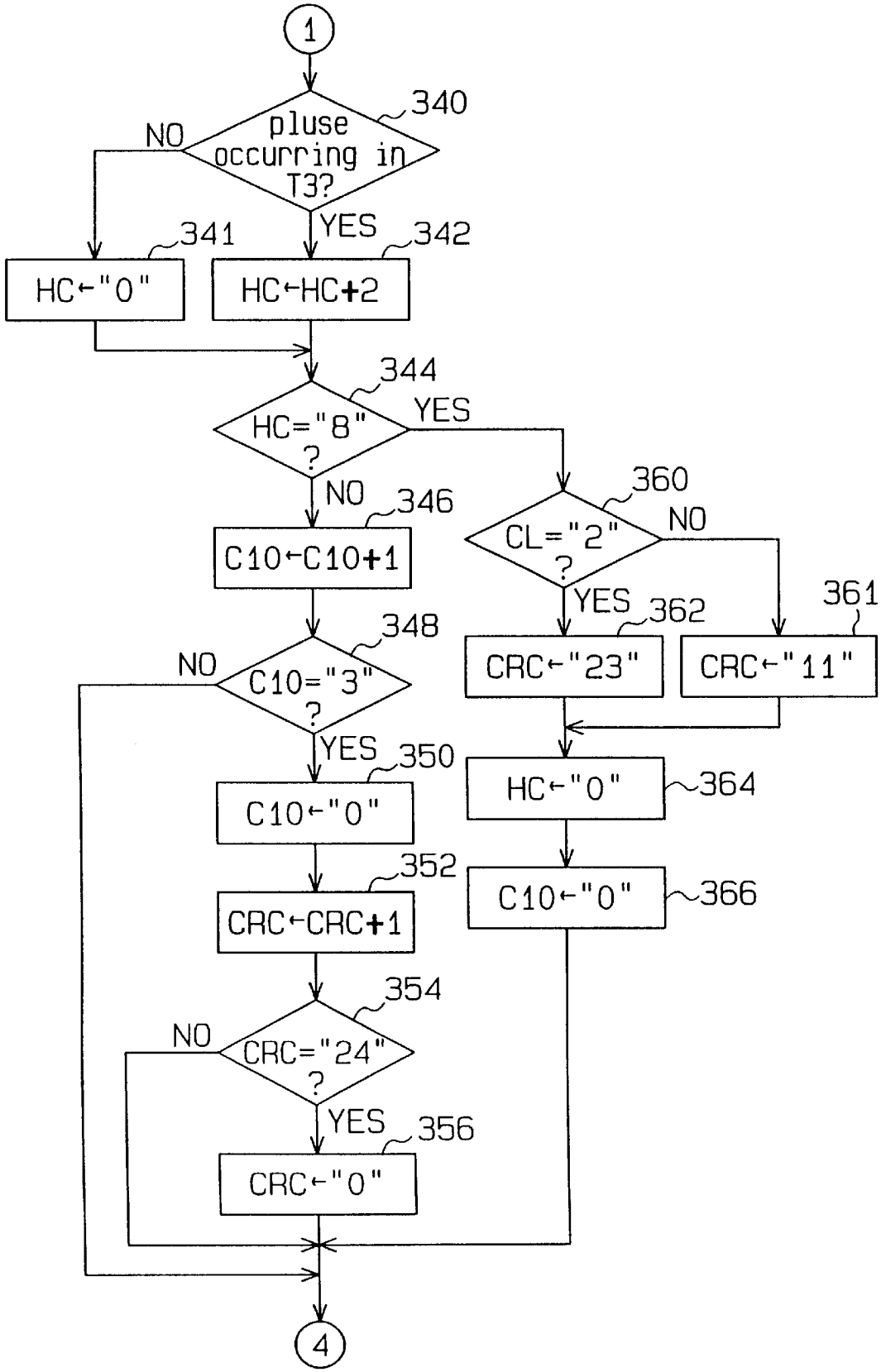

If the determination at step 310 (FIG. 11) is negative, that is, it cylinder distinction has been completed and the crank counter value CRC is a value other than one hundred, the ECU 40 moves to step 340 (FIG. 13).

At step 340, the ECU 40 judges whether a pulse is occurring in the long tooth signal T3. If the determination is positive, the ECU 40 moves to step 342 and increments the high level counter value HC by two. If the determination at step 340 is negative, the ECU 40 moves to step 341 and sets the high level counter HC to zero.

The high level counter value HC is used to detect the time at which the teeth 70 of the first detection segment S1 have passed by the sensing elements 55, 56 after cylinder distinction is completed. For example, the high level counter value HC changes in the sequence two, four, six, eight as the teeth 70 of the first detection segment S1 pass by the sensing elements 55, 56. The value HC changes in the sequence two, zero, two, four as the teeth of the second detection segment S2 pass by the sensing elements 55, 56. The value HC changes in the sequence two, zero, zero, two as the teeth 70 of the third detection segment S3 pass by the sensing elements 55, 56. The value HC changes in the sequence of two, four, zero, two as the teeth of the fourth detection segment S4 pass by the sensing elements 55, 56. When the short teeth 70S that do not belong any of the detection segments S1–S4 pass by the sensing elements 55, 56, the high level counter value HC is always zero. Therefore, the time at which the value HC becomes eight is the time at which the teeth 70 of the first sensing element S1 have passed the sensing elements 55, 56.

After executing step 341 or step 342, the ECU 40 moves to step 344. At step 344, the ECU 40 judges whether the high level counter value HC is eight. If the determination is negative, the ECU 40 executes step 346 and the subsequent steps to increment the value CRC by one every time the crankshaft 15 rotates thirty degrees.

Specifically, the ECU 40 increments the ten degree CA signal counter value C10 by one at step 346. After cylinder distinction is completed, the value C10 is incremented by one every time the crankshaft 15 is rotated ten degrees CA and this routine is executed. If the value C10 is two, the value C10 is set to zero. In other words, the value C10 varies among zero, one and two.

At step 348, the ECU 40 judges whether the counter value C10 is three. If the determination is positive, the ECU 40 resets the value C10 to zero at step 350. At step 352, the ECU 40 increments the crank counter value CRC by one.

Thereafter, at step 354, the ECU 40 judges whether the crank counter value CRC is twenty-four. If the determination is positive, the ECU moves to step 356 and sets the value CRC to zero. Thus, the value CRC is incremented by one every time the crankshaft 15 rotates thirty degrees and circulates between zero and twenty-three. After executing step 356, or if the determination of step 348 or step 354 is negative, the ECU 40 temporarily suspends the current routine.

If the determination at step 344 is positive, that is, if the teeth 70 of the detection segment S1 have just passed by the sensing elements 55, 56, the ECU 40 moves to step 360.

At step 360, the ECU 40 judges whether the cam level value CL is two. If the determination is positive, the ECU 40 moves to step 362 and sets the crank counter value CRC to twenty three. If the determination is negative at step 360, the ECU 40 moves to step 361 and sets the value CRC to eleven.

After executing step 361 or step 362, the ECU 40 moves to step 364 and resets the high level counter value HC to zero. Thereafter, the ECU 40 sets the ten degree CA signal counter value C10 to zero and temporarily suspends the current routine.

Steps 360–366 are designed to correct the crank counter value CRC and are executed every time the crankshaft 15 is rotated one turn. That is, even if the regular angle signal T1 is high regardless of passing of the teeth 70 due to noise and the value CRC is deviated from the proper value, steps 360–366 correct the value CRC during one turn of the crankshaft 15.

Figure 14:
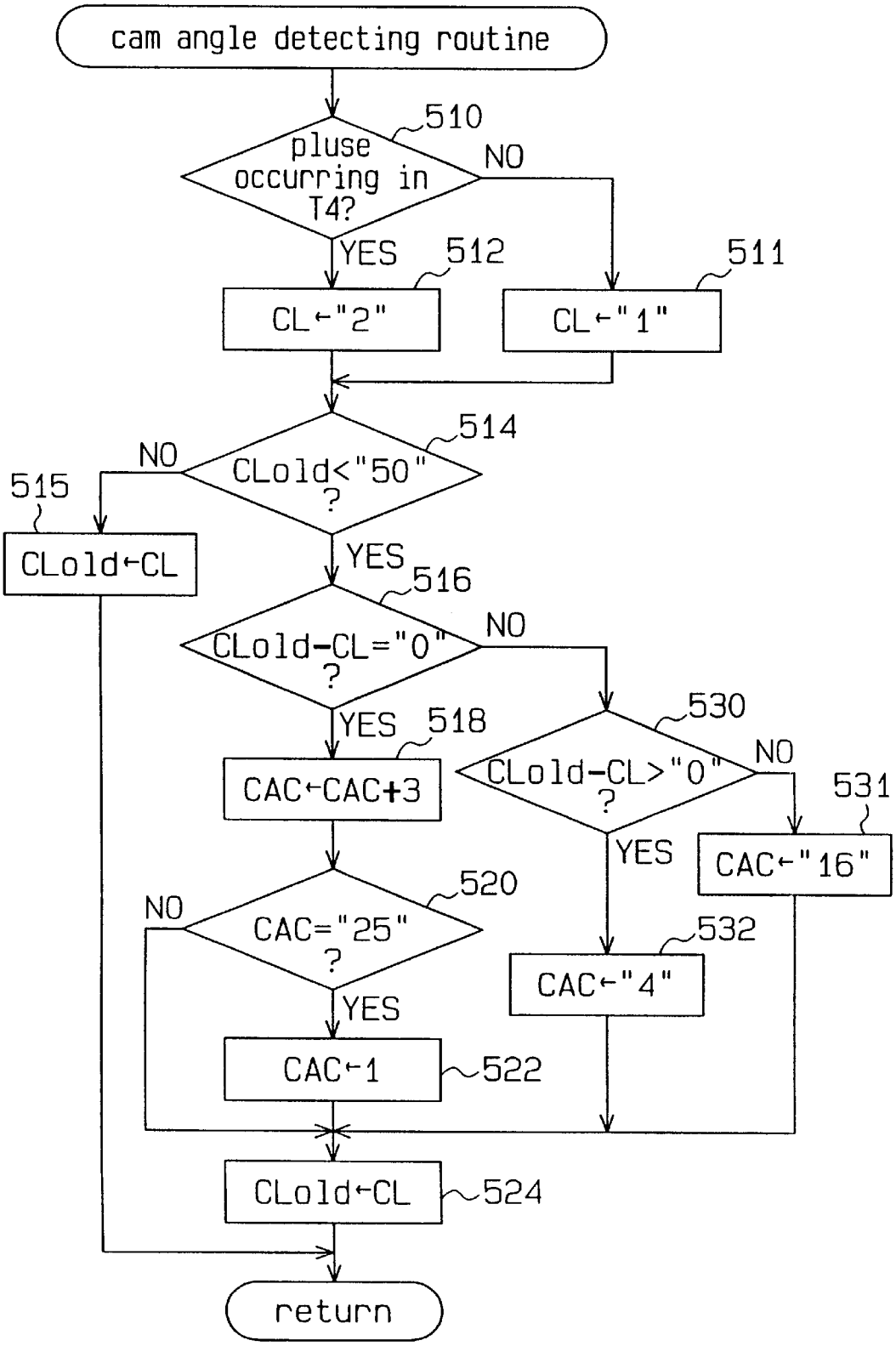
FIG. 14 is a flowchart showing a cam angle detecting routine of the first embodiment.

The cam angle detecting routine will now be described with reference to FIG. 14. At step 510, the ECU 40 judges whether a pulse is occurring in the long tooth signal T4. If the determination is positive, the ECU 40 sets the cam level value CL to two. If the determination is negative at step 510, the ECU 40 moves to step 511 and sets the value CL to one.

After executing step 511 or step 512, the ECU 40 moves to step 514 and judges whether the cam level value CLold in the previous routine is less than fifty. If the determination is negative, that is, if the cam level value CLold is still the initial value of one hundred, the ECU 40 moves to step 515. At step 515, the ECU 40 substitutes the current cam level value CL for the cam level value CLold of the previous routine and temporarily suspends the current routine.

If the determination is positive at step 510, the ECU 40 judges that the regular angle signal T2 has been high at least twice since the ignition switch was switched to the ON position. The ECU 40 then moves to step 516. When the first pulse in the regular angle signal T2 occurs, the crank level value CL is set to one or to two in this routine. When the second pulse in the signal T2 occurs, the crank level value CL (one or two) set when the signal T2 was initially high is used as the previous crank level value CLold. Step 516 and subsequent steps are executed after the regular angle signal T2 has been high at least twice to judge whether the cam level value CL of the current routine is different from the value CL at step 516 in the previous routine.

Specifically, the ECU 50 judges whether the difference between the previous cam level value CLold and the current cam level value CL is zero at step 516. If the determination is negative, the ECU 40 judges that the current cam level value CL is different from that in the previous routine and moves to step 530. The determination of step 516 is negative when the short tooth 71S at a position P3 of the cam rotor 60*a* passes by the sensing elements 61, 62, or when the long tooth 71L at a position P4 passes by the sensing elements 61, 62. That is, when different types of teeth 71L and 71S consecutively pass by the sensing elements 61, 62, or every time the cam rotor 60*a* is rotates a half turn, the determination at step 516 is negative.

At step 530, the ECU 40 subtracts the current cam level value CL from the previous cam level value CLold and judges whether the resultant is greater than zero. If the determination is positive, that is, if the cam level value CL has changed from two to one, the ECU 40 moves to step 532. At step 532, the ECU 40 sets the cam counter value CAC to four.

If the determination is negative at step 530, or if the cam level value CL has changed from one to two, the ECU 40 sets the value CAC to sixteen at step 531.

The cam counter value CAC is incremented by three every time the crankshaft 15 rotates ninety degrees and the regular angle signal T2 is high. The value CAC corresponds to the cam angle. As described above, the engine 10 includes the VVT 30, which rotates the intake camshaft 20. Therefore, there is no one-to-one correspondence between the cam angle and the crank angle (the crank counter value CRC). Thus, the crank angle detector of this embodiment directly detects the rotational angle of the intake camshaft 20 to detect the cam angle (the cam counter value CAC). When the crank angle (the cam counter value CAC) cannot be detected due to a malfunction of the crank position sensor 54, the cam counter value CAC is used as a substitute for the crank counter value CRC.

If the determination is positive at step 516, the ECU 40 judges the current cam level value CL is the same as that in the previous routine and moves to step 518.

At step 518, the ECU 40 increments the cam counter value CAC by three. At step 520, the ECU 40 judges whether the cam counter value CAC is twenty-five. If the determination is positive, the ECU 40 moves to step 522 and sets the cam counter CAC to one.

If the determination is negative at step 520, or after executing steps 522, 531 or 542, the ECU 40 moves to step 524.

At step 524, the ECU 40 substitutes the current cam level value CL for the previous cam level value CLold and temporarily suspends the current routine.

As described above, in the crank angle detecting routine and the cam angle detecting routine, the crank counter value CRC, which corresponds to the crank angle, and the cam counter value CAC, which corresponds to the cam angle, are computed. The ECU 40 executes the ignition timing control, the fuel injection control and the valve timing control based on the crank counter value CRC and the cam counter value CAC.

In this embodiment, the crank rotor 54*a* has four detection segments S1–S4, each of which has different combination of the teeth 70. The crank counter value CRC is determined based on the high level counter value HC and the cam level value CL, or on the combination of tooth types of a detection segments S1–S4 that is passing by the sensing elements 55, 56 of the crank position sensor 54.

The crank rotor 54 a has four detection segments S1–S4, which are spaced apart by ninety degrees. Therefore, during one turn of the crankshaft 15, the crank counter value CRC is determined four times. That is, cylinder detection is performed four times. For example, if the engine 10 is started at the time t1 of FIG. 9, cylinder distinction is performed at the time t3, at which all the teeth 70 of the second detection segment S2 have passed by the sensing elements 55, 56. If the engine 10 is started at a time t2, at which some of the teeth 70 of the detection segment S2 have already passed by the sensing elements 55, 56, the crank angle is determined at the time t4, at which the teeth 70 of the third detection segment S3 have passed by the sensing elements 55, 56.

Therefore, cylinder distinction is positively performed while the crankshaft 15 rotates at least one hundred twenty degrees. As a result, the ignition timing control and other controls performed in accordance with the strokes of the pistons 13 are started soon after the engine 10 is started. This improves the starting of the engine 10.

In this embodiment, each of the detection segments S1–S4 has four teeth 70 (the two long teeth 70L at the ends and the other two teeth 70 in between), and the crank angle is detected based on the combination of the teeth 70 in the detection segments S1–S4. Alternatively, the number of teeth 70 between the end teeth 70L of each detection segment S1–S4 may vary. In this case, the crank angle may be detected based on the number of teeth 70 between the end teeth 70L of each sensing elements S1–S4. However, in this variation, the teeth 70 are not arranged at equal angular intervals. Thus, in this variation, the teeth 70 between the end teeth 70L only function to distinguish the detection segments S1–S4.

In the embodiment of FIGS. 1–14, the crank angle is detected based on the combination of long and short teeth 70 in the detection segments S1–S4. Therefore, all the teeth 70 are spaced apart at equal angular intervals and each tooth 70 is used to generate the regular angle signal T1. Thus, the embodiment of FIGS. 1–14 generates a greater number of pulses in the regular angle signal T1 per turn of the crankshaft 15 compared to the case where the crank angle is detected based on the number of teeth in the detection segments S1–S4. As a result, the output cycle of the signal T1 is shortened. This improves the accuracy of the crank angle detection. As a result, the accuracy of the ignition timing control and other controls are improved.

Further, in the embodiment of FIGS. 1–14, the valve timing of the intake valves 23 is most retarded by the VVT 30 when the engine 10 is started. A pulse occurs in the regular angle signal T2 of the cam rotor 60*a* within the time of the range of pulses in the regular angle signal T1 that correspond to the teeth 70 in one of the detection segments S1–S4. If, as shown in FIG. 9(*e*), no pulse occurs in the signal T2 within the time span of the T1 pulses corresponding to the detection segments S1–S4, cylinder distinction is not performed until the time t4 even if the engine 10 is started at the time t1. That is, unlike the embodiment of FIGS. 1–14, cylinder distinction is not completed at the time t3. This is because no pulse occurs in the regular angle signal T2 during the period from the time t1 to time t3, and the cam level value CL thus cannot be determined during the period.

However, in the embodiment of FIGS. 1–14, the cam level value CL is determined when the teeth 70 of each detection segment S1–S4 have passed by the sensing element 55, 56. Upon the determination of the value CL, the crank counter value CRC is determined. As a result, the crank angle is quickly determined.

The sensing elements 55, 56 of the crank position sensor 54 are arranged to satisfy the inequality (1). Therefore, the level of the differentiated signal B1 at the time of a pulse in the regular angle signal T1 varies depending on the length of each tooth 70. As a result, the length of each tooth 70 is easily and positively detected based on the level of the differentiated signal B1 at any rotational speed of the crankshaft 15. This improves the accuracy of the crank angle detection.

The sensing elements 61, 62 of the cam position sensor 60 are arranged to satisfy the inequality (2). Therefore, the level of the signal A4 at the time of a pulse in the regular angle signal T2 varies depending on the length of each tooth 71. As a result, the length of each tooth 71 is easily and positively detected based on the level of the signal A4 at any rotational speed of the camshaft 20 as in the case of the crank position sensor 54.

A second embodiment of the present invention will now be described with reference to FIGS. 15–18. The differences from the embodiment of FIGS. 1–14 will mainly be discussed below.

To avoid a redundant description, like or same reference numerals are given to those components that are the same as the corresponding components of the embodiment of FIGS. 1–14.

In the embodiment of FIGS. 15–18, the crank angle detection (computation of the crank counter value CRC) is continued until rotation of the crankshaft 15 is completely stopped after the ignition switch is moved to the OFF position. The crank counter value CRC that is finally obtained is stored in the backup RAM 44 as an initial crank counter, value CRC when the engine 10 is started again.

When the ignition switch is turned to the OFF position and the injector 53 and the ignition plug 50 stop igniting air-fuel mixture, the speed of the crankshaft 15 decreases until the crankshaft 15 stops. The rotational direction of the crankshaft 15 may reverse immediately before stopping completely. The crank angle detector of FIGS. 15–18 detects the reverse of the crankshaft rotation and adjusts the crank counter value CRC, accordingly.

The distance Z1 between the sensing elements 55, 56 along the rotational direction R1 of the crank rotor 54*a* (see FIG. 2), the length X1 of each short tooth 70S and the length Y1 of each long tooth 70L satisfy the following inequality (3).

$$X1/2<Z1<Y1/2 \quad (3)$$

Figure 15A:
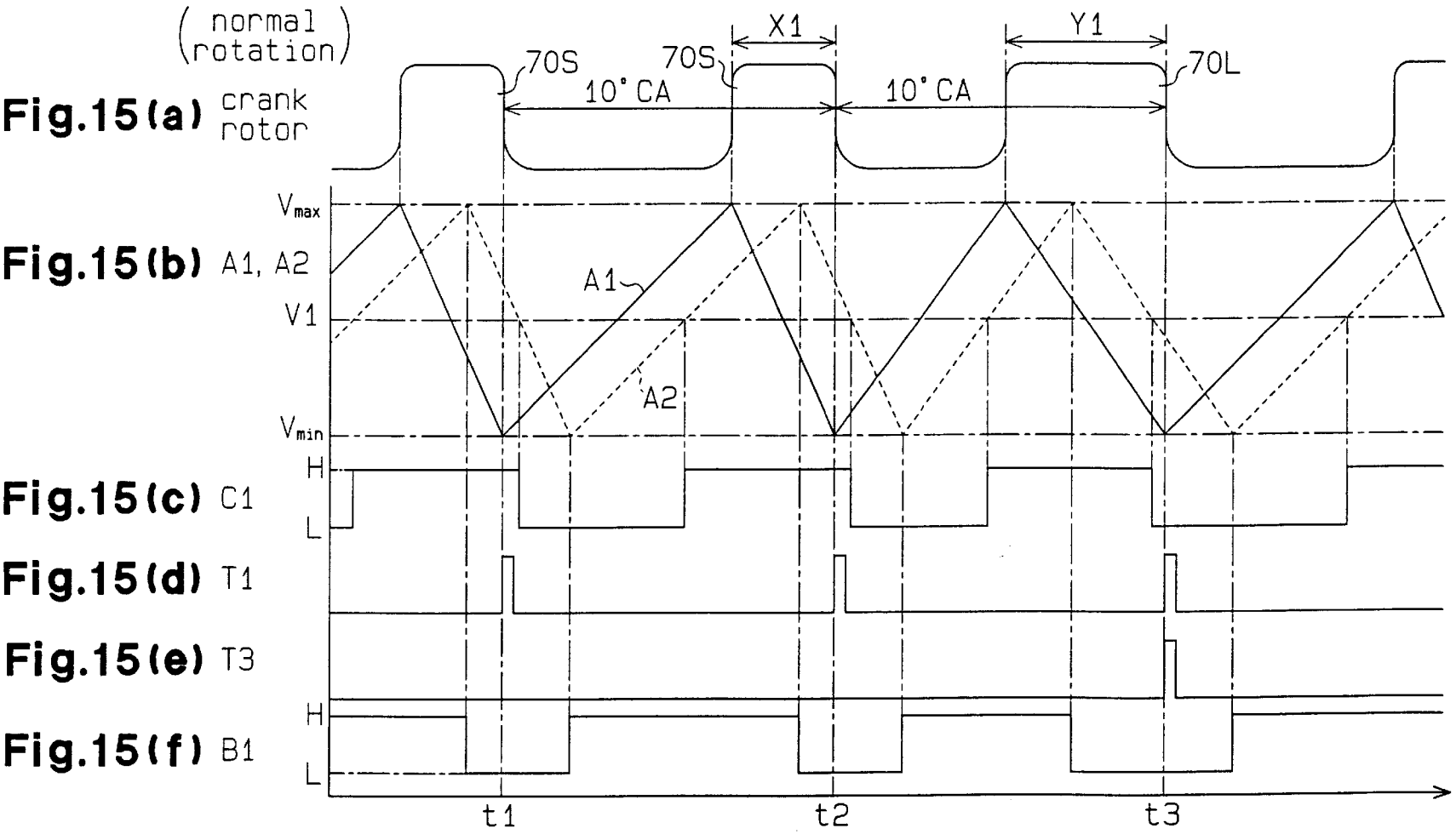
FIGS. 15(*a*)–15(*f*) are timing charts showing changes, over time, of signals in relation to the teeth on a crank rotor according to a second embodiment.

FIG. 15(*b*) shows the changes of the signals A1, A2 output from the sensing elements 55, 56 as the crank rotor 54*a* rotates. The solid line shows the changes of the signal A1 output from the first sensing element 55 and the broken line shows the changes of the signal A2 output from the second sensing element 56. FIG. 15(*a*) shows the shape of the crank rotor 54*a* corresponding to the signal A1.

As shown in FIGS. 15(*a*) and 15(*b*), the signal A1 is a triangular wave having a maximum value Vmax and a minimum value Vmin. Specifically, the signal A1 has the maximum value Vmax when the first sensing element 55 faces the leading edge of each short tooth 70S or of each long tooth 70L, and has the minimum value Vmin when the sensing element 55 faces the trailing edge of each tooth 70S or of each tooth 70L. The signal A2 is a triangular wave that has the same shape as the signal A1 and has a predetermined phase lag with respect to the signal A1. Since the sensing elements 55, 56 satisfy the inequality (3), the waveform of the signals A1, A2 depends on which of a short tooth 70S or a long tooth 70L is passing by the sensing element 55, 56.

When the trailing edge of a short tooth 70S is close to the first sensing element 55 and the signal A1 has the minimum value Vmin (at times t1, t2), the signal A2 from the second sensing element 56 is greater than a predetermined reference value V1. Contrarily, when the trailing edge of a long tooth 70L is close to the first sensing element 55 and the signal A1 has the minimum value Vmin (at a time t3), the signal A2 is smaller than the reference value VI. The reference value V1 is defined by an equation (4).

$$V1=(V\max+V\min)/2 \quad (4)$$

As described above, the state of the signals A1, A2 varies in accordance with the length of the passing tooth 70. This is used to determine which of a short tooth 70S or a long tooth 70L is passing by the sensing elements 55, 56.

The signal processor 48 provides the input circuit 46 with the regular angle signal T1 and the long tooth signal T3. The processor 48 also processes the signals A1, A2 for generating a differentiated signal B1. The processor 48 outputs the regular angle signal T1 in the same manner as the embodiment of FIGS. 1–14.

The processor 48 generates a comparison signal C1 which changes in accordance with the level of the signal A2. As shown in FIG. 15(*c*), the comparison signal C1 is high when the signal A2 is greater than the reference value V1 and is low when the signal A2 is smaller than the reference value V1. The processor 48 produces a pulse in the long tooth signal T3, which is shown in FIG. 15(*e*), if the comparison signal C1 is low when the regular angle signal T1 is high. Thus, a pulse occurs the long tooth signal T3 only when the trailing edge of the long tooth 70L passes by the first sensing element 55.

The signal processor 48 differentiates the signal A2 to generate a differentiated signal B1 and sends the signal B1 to the input circuit 46. Unlike the embodiment of FIGS. 1–14, the differentiated signal B1 is high when the signal A2 is increasing and is low when the signal A2 is decreasing.

Since the arrangement of the sensing elements 55, 56 satisfies the inequality (3), the level of the differentiated signal B1 when a pulse occurs in the regular angle signal T1 changes in accordance with the rotational direction of the crankshaft 15. That is, when the crankshaft 15 is rotating in the normal direction, or when the crank rotor 54*a* is rotating in the direction R1 shown in FIG. 2, the differentiated signal B1 is low when a pulse occurs in the regular angle signal T1 (the times t1, t2 and t3). Contrarily, when the crankshaft 15 is rotating in the reverse direction, the differentiated signal B1 is high as shown in FIG. 16(*c*) when a pulse occurs in the regular angle signal T1 (the times t4, t5 and t6). As described above, the level of the differentiated signal B1 when the regular angle signal T1 is high changes in accordance with the rotational direction of the crankshaft 15. Accordingly, the rotational direction of the crankshaft 15 is detected.

Figure 17:
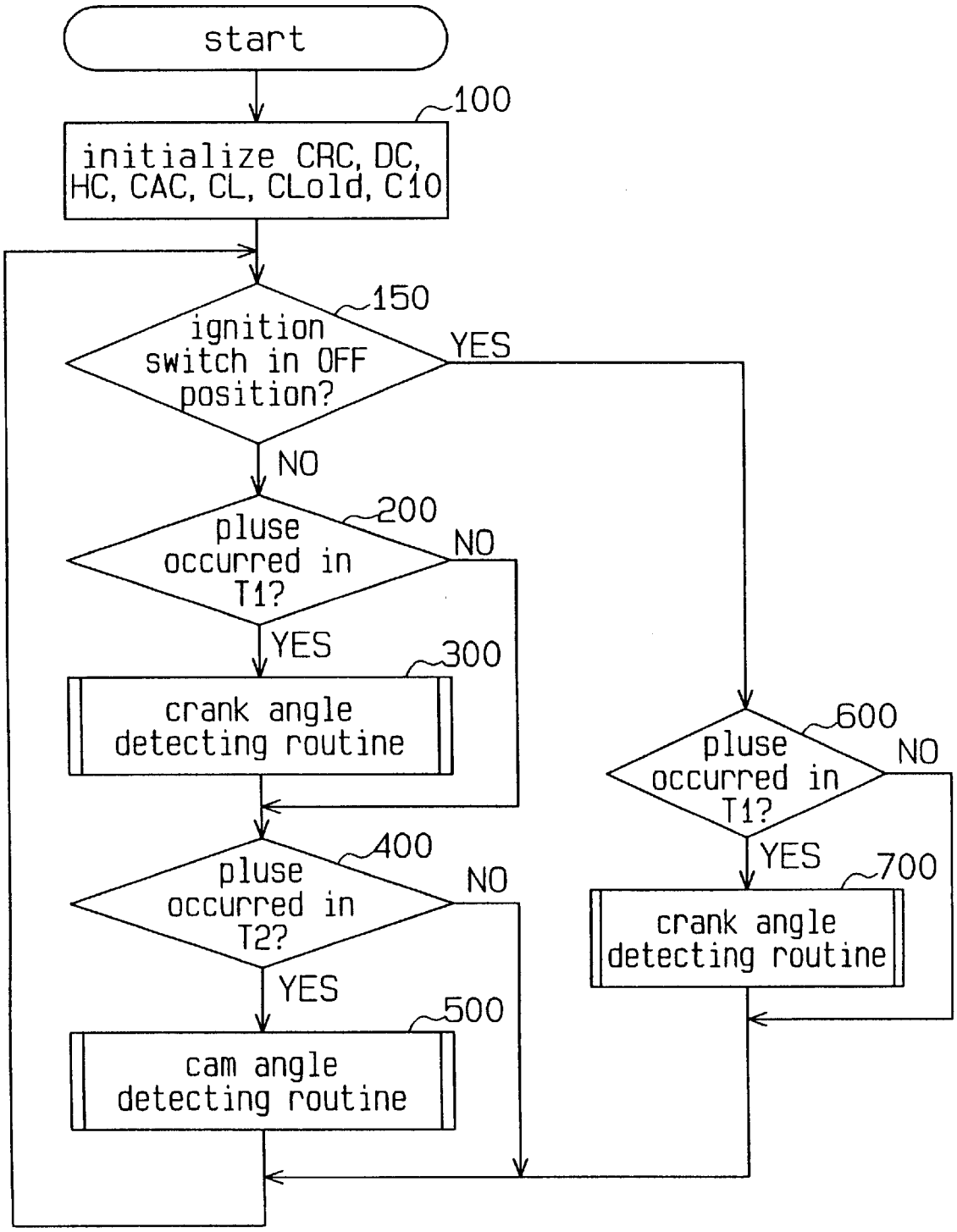
FIG. 17 is a flowchart showing a main routine of the second embodiment.

A main routine executed by the ECU 40 will now be described with reference to the flowchart of FIG. 17. The main routine is started when the ignition switch (not shown) is moved to the ON position and is continued for a predetermined period after the ignition switch is moved to the OFF position. The predetermined period is sufficiently longer than the time required for the crankshaft 15 to stop.

Description of steps having the same number as those in the flowchart of FIG. 10 is omitted to avoid redundancy.

After executing step 100, the ECU 40 moves to step 150. At step 150, the ECU 40 judges whether the ignition switch has been moved to the OFF position based on a switch signal output from the ignition switch. If the determination is negative, the ECU 40 executes steps 200–500.

If the determination is positive at step 150, that is, if the ignition switch has been moved to the OFF position, the ECU 40 moves to step 600. At step 600, the ECU 40 judges whether a pulse has occurred in the regular angle signal T1. If the determination is positive, the ECU 40 moves to step 700 and performs a crank angle detecting routine (FIG. 18), which is different from the crank angle detecting routine of FIG. 10. Therefore, the routine is repeatedly executed as an interrupt at every ten degrees rotation of the crankshaft 15.

If the determination is negative at step 600 or after executing step 700, the ECU 40 moves back to step 150.

A crank angle detecting routine of step 700 will now be described with reference to the flowchart of FIG. 18. At step 710, the ECU 40 judges whether the differentiated signal B1 is high. If the determination is negative, the ECU 40 judges that the crankshaft 15 is rotating in the normal direction and executed steps 721–726, which are designed for the normal rotation of the crankshaft 15.

At step 721, the ECU 40 increments the ten degree CA signal counter value C10 by one. At a subsequent step 722, the ECU 40 judges whether the counter value C10 is three. If the determination is positive, the ECU 40 moves to step 723. At step 723, the ECU 40 sets the counter value C10 to zero and moves to step 724. At step 724, the ECU 40 increments the crank counter value CRC by one.

Further, at step 725, the ECU 40 judges whether the crank counter value CRC is twenty-four. If the determination is positive, the ECU 40 moves to step 726 and sets the crank counter value CRC to zero.

On the other hand, if the determination at step 710 is positive, the crankshaft 15 is rotating in the reverse direction. The ECU 40 then executes steps 711–716, which are designed for the reverse rotation of the crankshaft 15.

At step 711, the ECU 40 decrements the counter value C10 by one. At a subsequent step 712, the ECU 40 determines whether the counter value C10 is minus one. If the determination is positive, the ECU 40 moves to step 713. At step 713, the ECU 40 sets the counter value C10 to two and moves to step 714. At step 714, the ECU 40 decrements the crank counter value CRC by one.

Further, at step 715, the ECU 40 judges whether the crank counter value CRC is minus one. If the determination is positive, the ECU 40 moves to step 716 and sets the crank counter value CRC to twenty-three.

If the determination at either of steps 712, 715, 722 or 725 is negative, or after executing steps 716, 726, the ECU 40 moves to step 730.

At step 730, the ECU 40 rewrites the initial value of the crank counter value CRC stored in the backup RAM 44 with the current crank counter value CRC and temporarily suspends the current routine. Therefore, when the engine 10 is started again, the crank counter value CRC will be initialized with the rewritten initial value.

As described above, the ECU 40 continues to compute the crank counter value CRC until the crankshaft 15 is completely stopped and the initial value of the crank counter value CRC is rewritten with the current crank counter value CRC.

Therefore, once cylinder distinction is performed, the engine 10 is started with crank angle (crank counter value CRC) determined. That is, when the ignition switch is moved to the ON position, the crank counter value CRC has already been determined. As a result, the starting of the engine 10 is improved.

The sensing elements 55, 56 of the crank position sensor 54 are arranged to satisfy the inequality (3). Therefore, the level of the comparison signal Clat the time of output of the regular angle signal T1 varies depending on the length of the passing tooth 70. As a result, the length of the passing tooth 70 is easily and positively detected at any rotational speed of the crankshaft 15. This improves the accuracy of the crank angle detection.

Further, the arrangement of the sensing elements 55, 56 causes the level of the differentiated signal B1, when a pulse occurs in the regular angle signal T1, to change based on the rotational direction of the crankshaft 15. Therefore, when the crankshaft 15 rotated in the reverse direction when the engine 10 is stopping, the reverse rotation of the crankshaft 15 is detected, which allows the ECU 40 to accurately compute the crank counter value CRC. As a result, the crank angle is detected reliably.

A third embodiment of the present invention will now be described with reference to FIGS. 19–21. The differences from the embodiment of FIGS. 15–18 will mainly be discussed below and the same construction, process, operation and advantages as the embodiment of FIGS. 15–18 will be omitted.

In the embodiments of FIGS. 1–18, the trailing edges of the teeth 70 on the crank rotor 54*a* are spaced at equal angular intervals. In the embodiment of FIG. 19–21, the centers of the teeth 70 are spaced apart at equal angular intervals (ten degrees). As in the embodiment of FIGS. 15–18, the sensing elements 55, 56 of the crank position sensor 54 are arranged in the vicinity of the crank rotor 54*a* to satisfy the inequality (3).

The signal processor 48 processes the signals A1–A4 from the sensing elements 55, 56, 61, 62 to generate an regular angle signal T1, a long tooth signal T3 and a differentiated signal B2, in addition to the regular angle signal T2 and the long tooth signal T4. The processor 48 sends the signals T1–T4 and B2 to the input circuit 46.

Figure 20:
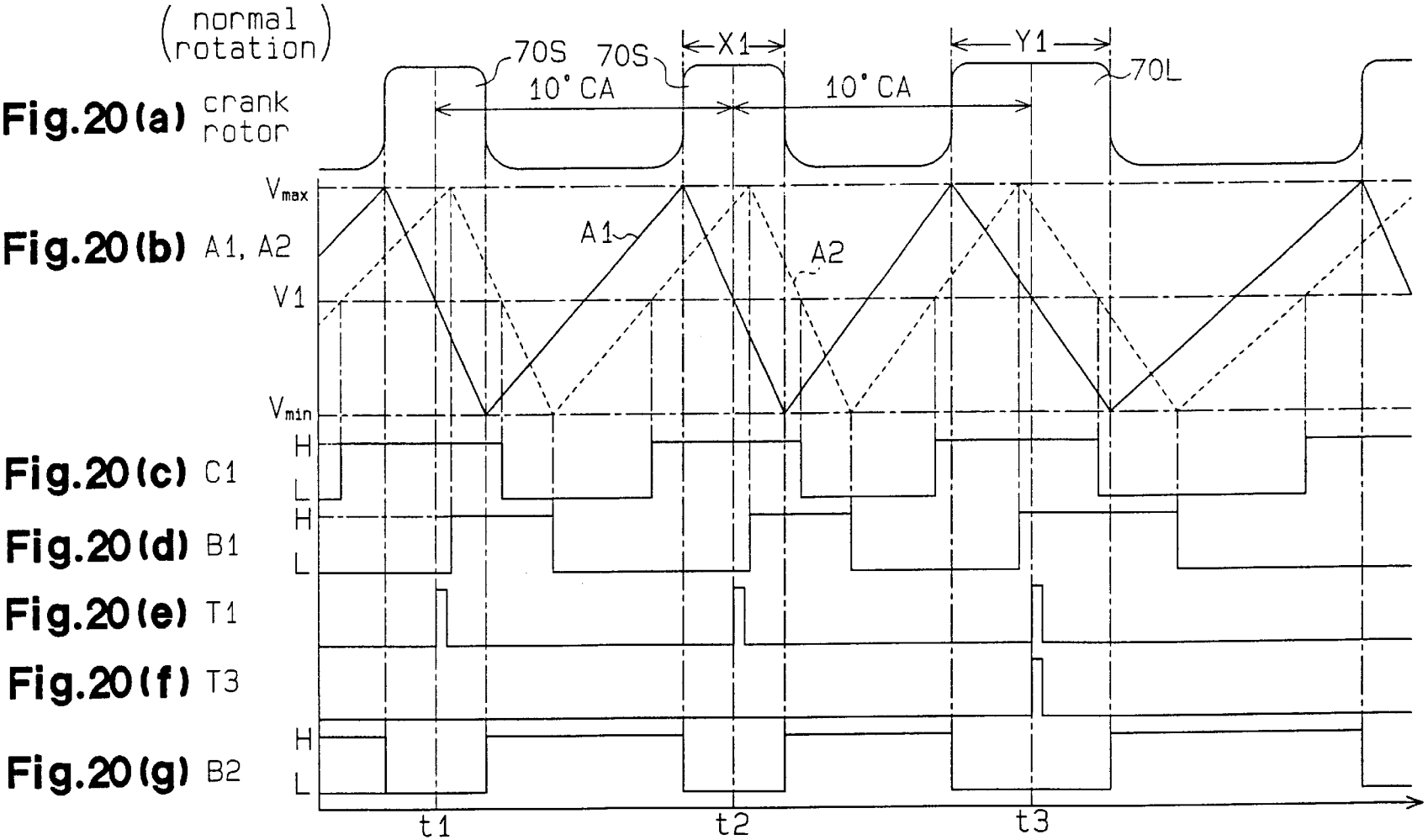
FIGS. 20(*a*)–20(*g*) are timing charts showing changes, over time, of signals in relation to the teeth on a crank rotor according to a third embodiment.

FIG. 20(*b*) shows changes of the signals A1, A2 output from the sensing elements 55, 56 as the crank rotor 54*a* rotates. FIG. 20(*a*) shows the shape of the crank rotor 54*a* corresponding to the output of the signal A1.

As in the embodiment of FIG. 15–18, the signal processor 48 generates the comparison signal C1 shown in FIG. 20(*c*). The signal processor 48 produces a pulse in the regular angle signal T1 when the signal A1 is equal to a reference value V1((Vmax+Vmin)/2) and the comparison signal C1 is high. Therefore, a pulse occurs in the regular angle signal T1 every time the crankshaft 15 rotates ten degrees and the center of each tooth 70 passes by the first sensing element 55.

The signal processor 48 differentiates the signal A2 to generate a differentiated signal B1. Unlike the embodiment of FIGS. 15–18, the signal B1 is low when the signal A2 is increasing and is high when the signal A2 is decreasing.

Since the sensing elements 55, 56 are arranged to satisfy the inequality (3), the level of the differentiated signal B1 when a pulse occurs in the regular angle signal T1 changes in accordance with the length of the passing tooth 70. That is, the level of the signal B1 when a pulse occurs in the regular angle signal T1 (the times t1, t2, t3) is low when the passing tooth 70 is a short tooth 70S and is high when the passing tooth 70 is a long tooth 70L. The signal processor 48 produces a pulse in the long tooth signal T3, which is shown in FIG. 20(*f*), if the regular angle signal T1 is high when the signal B1 is high. Thus, a pulse occurs in the long tooth signal T3 when the center of each long tooth 70L passes by the first sensing element 55.

Further, the signal processor 48 differentiates the signal A1 to generate a differentiated signal 52 shown in FIG. 20(*g*). The processor 48 sends the signal B2 to the input circuit 46. The signal S2 is high when the signal A1 is increasing and is low when the signal A1 is decreasing.

Since the sensing elements 55, 56 are arranged to satisfy the inequality (3), the level of the differentiated signal 82 when a pulse occurs in the regular angle signal T1 changes in accordance with the rotational direction of the crankshaft 15. That is, when the crankshaft 15 is rotating in the normal direction, the differentiated signal B2 is always low when the regular angle signal T1 is high (the times t1, t2, t3).

Figure 21:
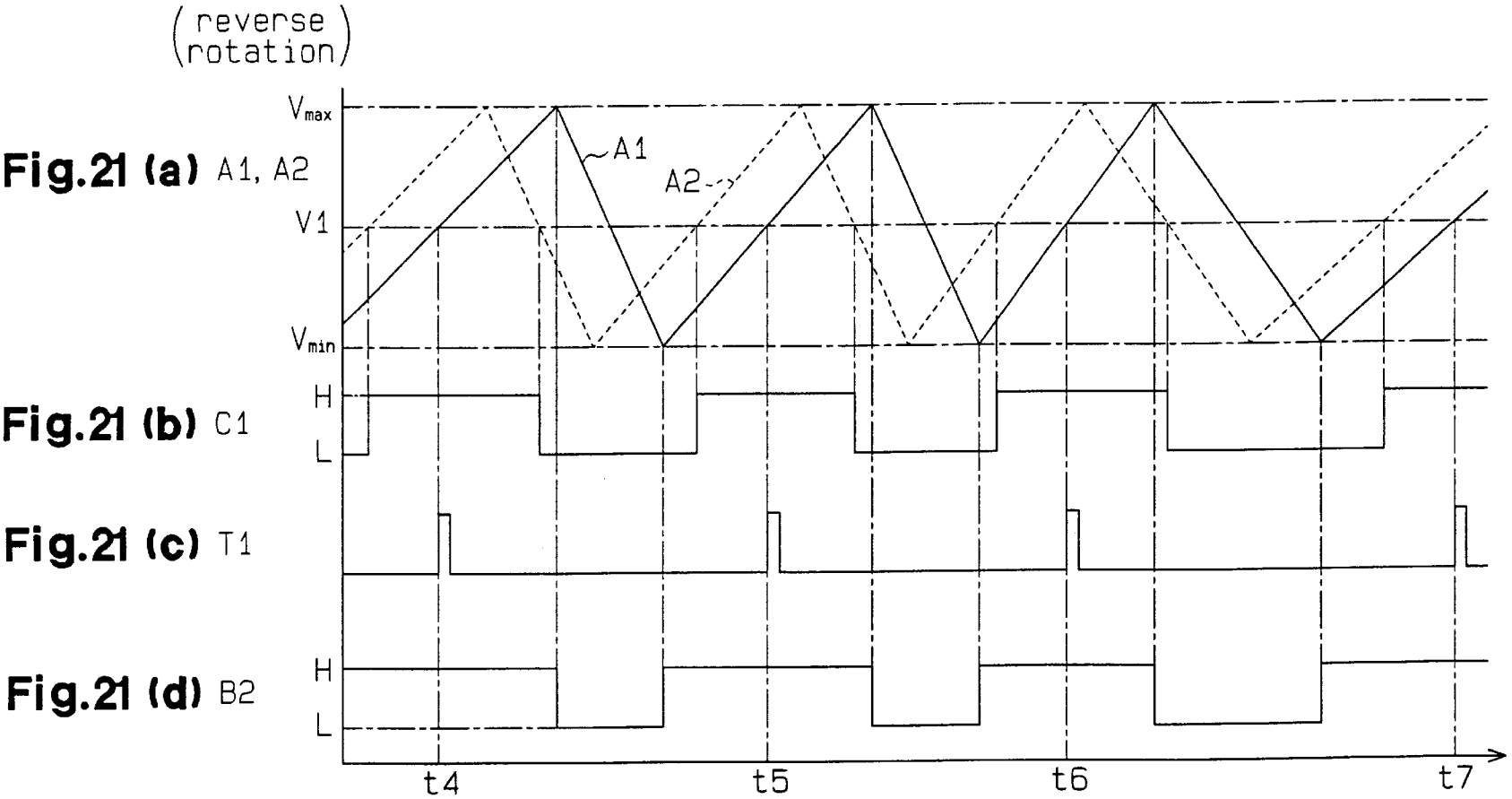
FIGS. 21(*a*)–21(*d*) are timing charts, like FIGS. 20(*a*)–20(*g*), in which the crank rotor is rotating in the reverse direction.

Contrarily, when the crankshaft 15 is rotating in the reverse direction, the differentiated signal B2 is high as shown in FIG. 21(*d*) when the regular angle signal T1 is high (the times t4, t5, t6 and t7). As described above, the level of the differentiated signal B2 when a pulse occurs in the regular angle signal T1 changes in accordance with the rotational direction of the crankshaft 15. Accordingly, the rotational direction of the crankshaft 15 is detected.

Figure 18:
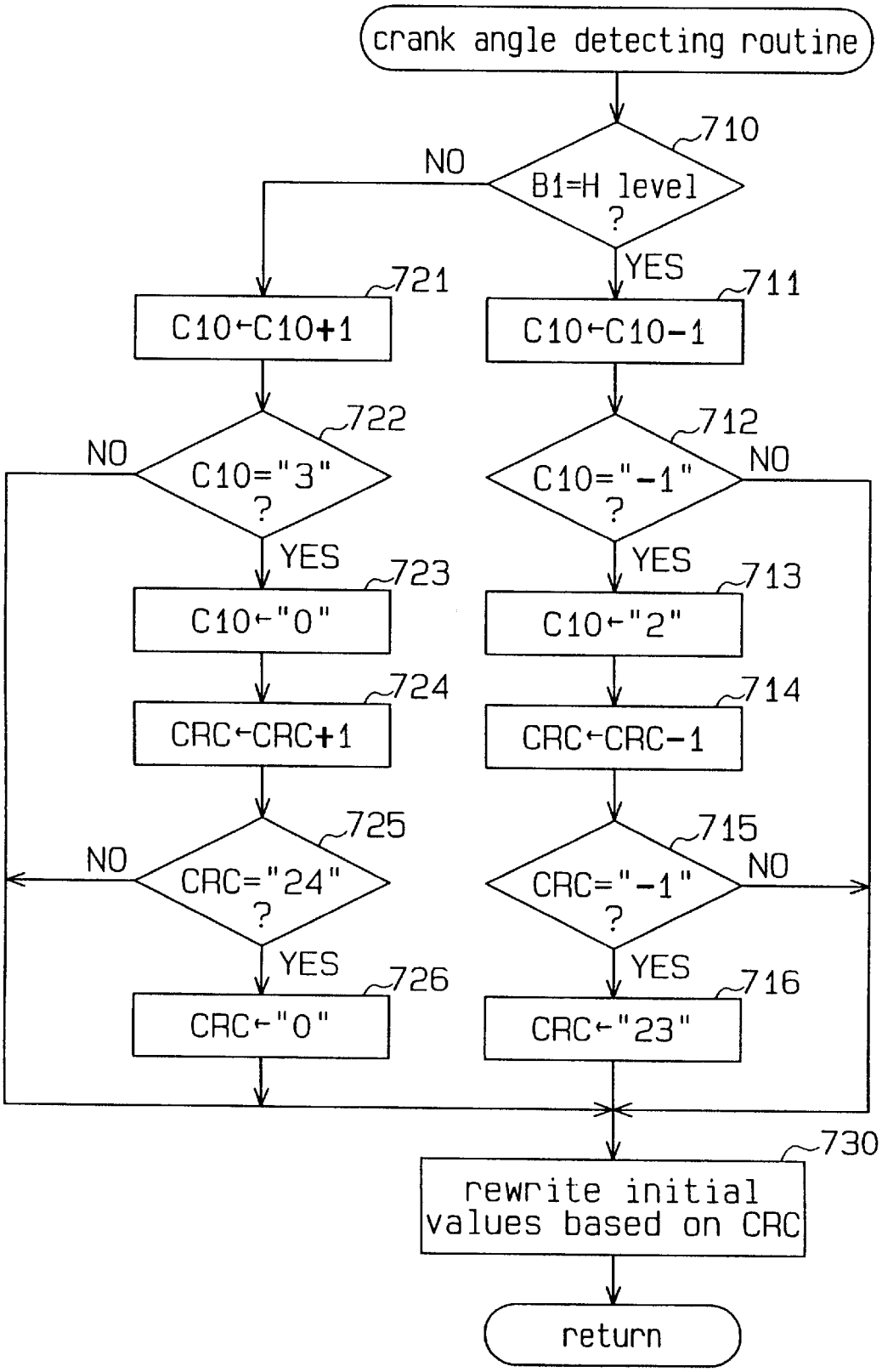
FIG. 18 is a flowchart showing a crank angle detecting routine of the second embodiment.
Figure 19:
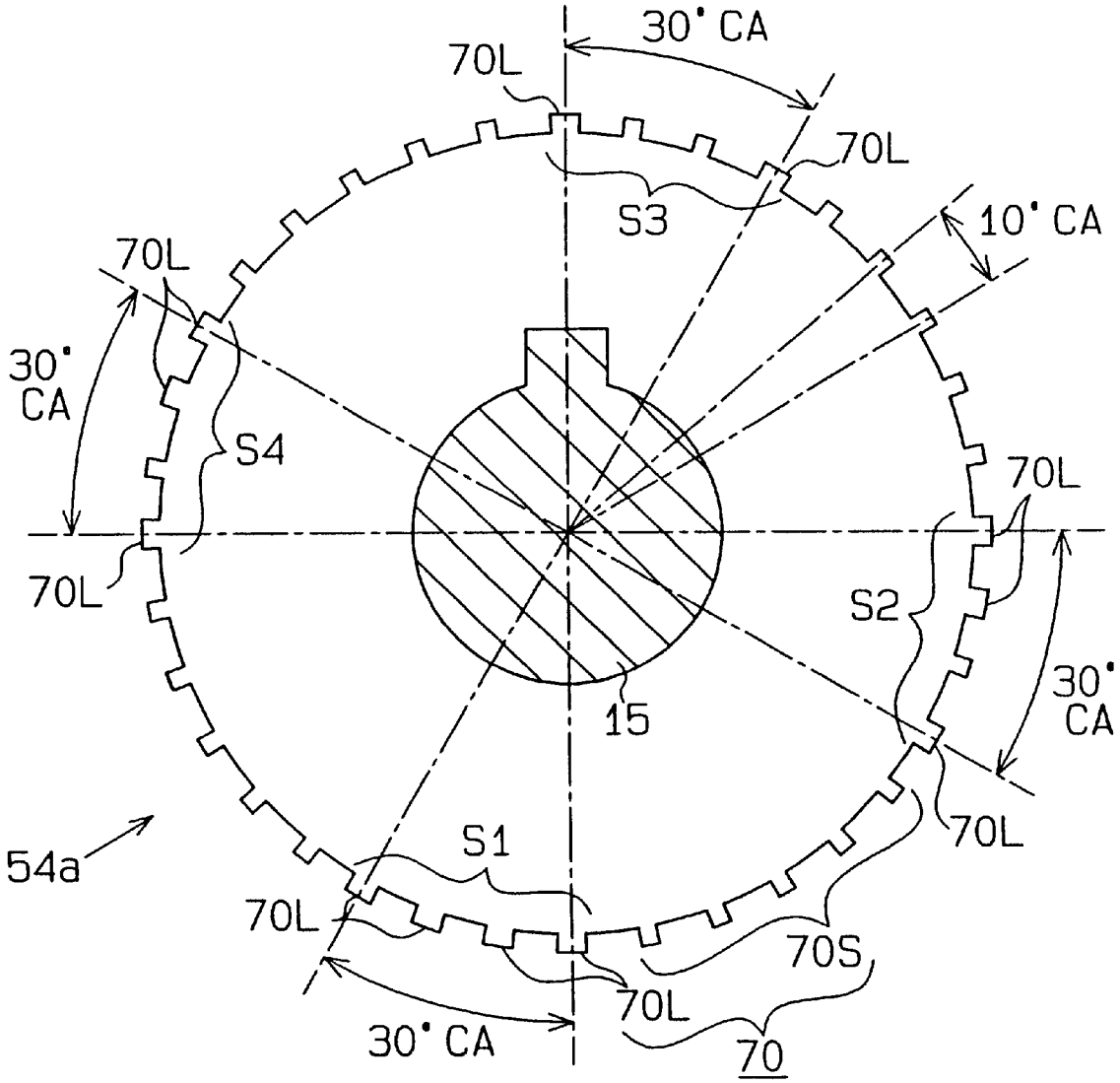
FIG. 19 is a front view illustrating a crank rotor according to a third embodiment.

In the embodiment of FIGS. 19–21, the crank angle and the cam angle are detected substantially in the same manner as in the embodiment of FIGS. 15–18. That is, the ECU 40 executes the main routine, the cam angle detecting routine and the crank angle detecting routine based on the regular angle signals T1, T2, the long tooth signals T3, T4 and the differentiated signal B2 and computes the crank counter value CRC and the cam counter value CAC.

In the embodiment of FIGS. 15–18, the ECU 40 judges whether the differentiated signal B1 is high at step 710 of the crank angle detecting routine. However, at step 710 of the embodiment of FIGS. 19–21, the ECU 40 judges whether the differentiated signal B2 is high at step 710.

A fourth embodiment of the present invention will now be described with reference to FIGS. 22 and 23. The differences from the embodiment of FIGS. 15–18 will mainly be discussed below. In addition to the regular angle signal T2 and the long tooth signal T4, the signal processor 48 of the fourth embodiment generates an regular angle signal T1 and a discrimination signal D1 by processing the signals A1–A4 from the sensing elements 55, 56, 61, 62. The processor 48 sends the signals T1–T3, D1 to the input circuit 46.

Figure 22A:
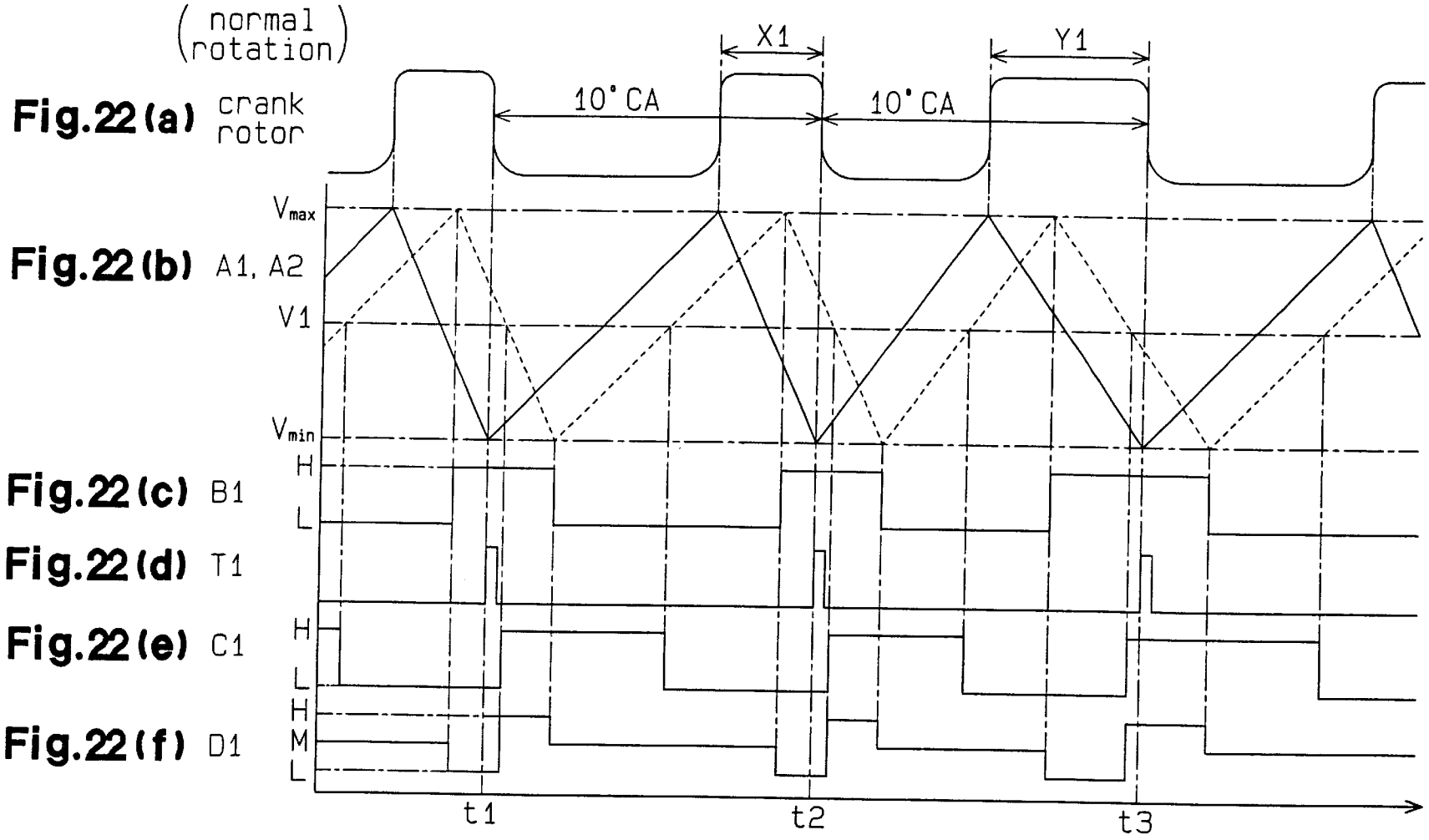
FIGS. 22(*a*)–22(*f*) are timing charts showing changes, over time, of signals in relation with the teeth on a crank rotor according to a fourth embodiment.

FIG. 22(*b*) shows the changes of the signals A1, A2, which are output from the sensing elements 55, 56 as the crank rotor 54*a* rotates. FIG. 22(*a*) shows the shape of the crank rotor 54*a*, which corresponds to the signal A1 from the first sensing element 55.

The signal processor 48 differentiates the signal A2 to generate a differentiated signal B1. Unlike the embodiment of FIGS. 15–18, the signal B1 is high when the signal A2 is decreasing and is low when the signal A2 is increasing.

The signal processor 48 generates a comparison signal C1, which changes in accordance with the level of the signal A2. As shown in FIG. 22(*e*), the comparison signal C1 is low when the signal A2 is greater than the reference value V1 and is high when the signal A2 is equal to the reference value V1 or smaller.

The signal processor 48 generates the discrimination signal D1 shown in FIG. 22(*f*) based on the differentiated signal S1 and the comparison signal C1. The discrimination signal D1 is either high, middle (M) level or low according to the level of the signals B1, C1. Specifically, when the differentiated signal B1 is low, the discrimination signal D1 is at the middle level regardless of the level of the comparison signal C1. When the differentiated signal B1 is high and the comparison signal C1 is low, the discrimination signal D1 is low. When the differentiated signal B1 and the comparison signal C1 are high, the discrimination signal D1 is high.

Since the sensing elements 55, 56 are arranged to satisfy the inequality (3), the level of the discrimination signal D1 when the regular angle signal T1 is high (the times t1, t2, t3) changes in accordance with the length of the passing tooth 70 and with the rotational direction of the crankshaft 15.

That is, the signal D1 when a pulse occurs in the regular angle signal T1 is low if the passing tooth 70 is a short tooth 70S (the times t1, t2). The signal D1 is high if the passing tooth 70 is a long tooth 70L (the time t3).

With the crankshaft 15 rotating in the normal direction, the level of the discrimination signal D1 when the regular angle signal T1 is high is set to high or low in accordance with the length of the passing tooth 70. Contrarily, with the crankshaft 15 rotating in the reverse direction, the discrimination signal D1 when the regular angle signal T1 is high (the times t4, t5, t6) is always middle level as shown in FIG. 23(*e*).

In the embodiment of FIGS. 22 and 23, the crank angle and the cam angle are detected substantially in the same manner as the embodiment of FIGS. 15–18. That is, the ECU 40 executes the main routine, the cam angle detecting routine and the crank angle detecting routine based on the regular angle signals T1, T2, the long tooth signal T4 and the discrimination signal D1 thereby computing the crank counter value CRC and the cam counter value CAC.

Figure 11:
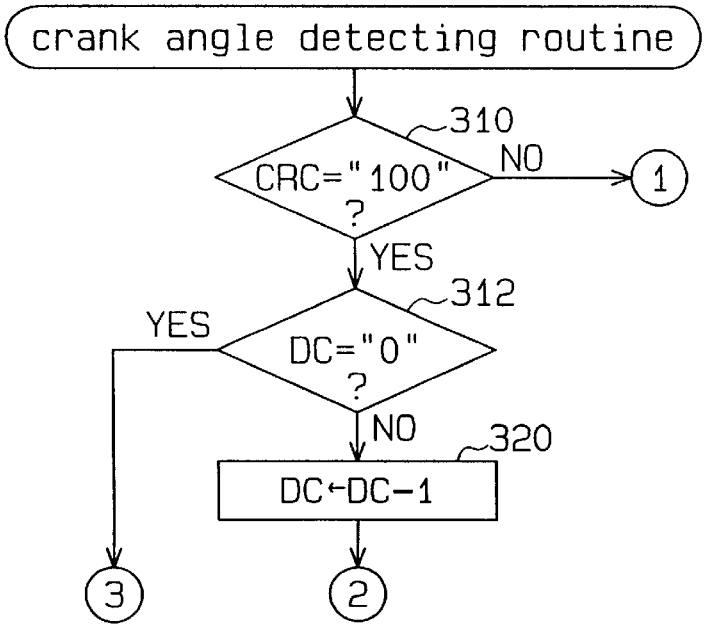
Figure 12:
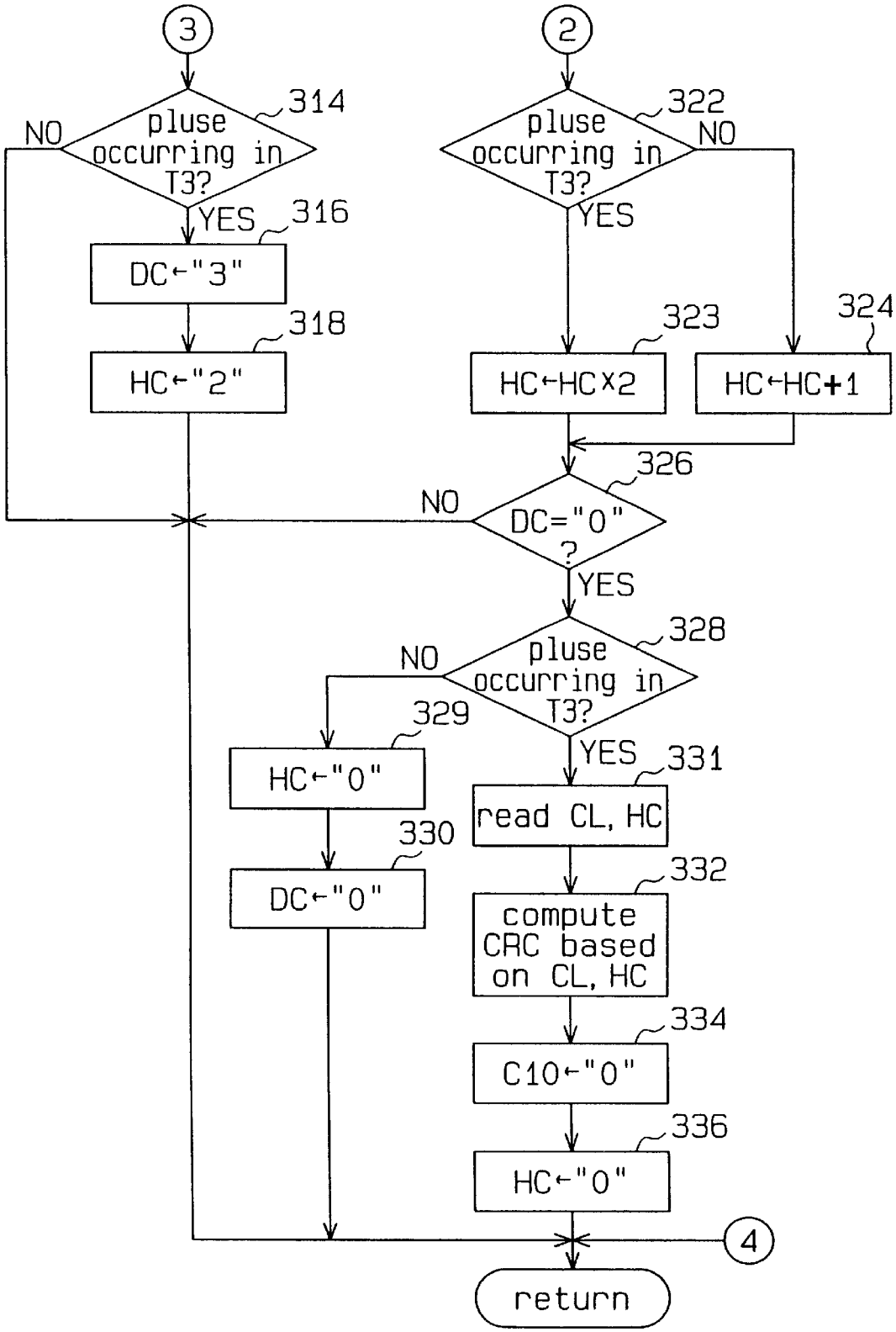

In the embodiment of FIGS. 15–18, the ECU 40 judges whether the long tooth signal T3 is being output at steps 314, 322, 328 and 340 (FIGS. 11–13). However, at the corresponding steps in the embodiment of FIGS. 22 and 23, the ECU 40 judges whether the discrimination signal D1 is high. Therefore, if the determination at steps 314, 322, 328, 340 is positive, the ECU 40 judges that the tooth 70 that is passing by the sensing elements 55, 56 is the long tooth 70L. Further, when the ignition switch is moved to the OFF position, the crankshaft 15 rotates in the normal direction until immediately before the rotation of the crankshaft 15 is stopped. Therefore, if the determination at steps 314, 322, 328, 340 is negative, the ECU 40 judges that the tooth 70 passing by the sensing elements 55, 56 is a short tooth 70S.

In the embodiment of FIGS. 15–18, the ECU 40 judges whether the differentiated signal B1 is high at step 710 of the crank angle detecting routine (FIG. 18). However, at step 710 of the embodiment of FIGS. 22–23, the ECU 40 judges whether the discrimination signal D1 is at the middle level.

A fifth embodiment of the present invention will now be described with reference to FIGS. 24, 25. The differences from the embodiment of FIGS. 19–21 will mainly be discussed below. In addition to the regular angle signal T2 and the long tooth signal T4, the signal processor 48 of the fifth embodiment generates a regular angle signal T1 and a discrimination signal D1 by processing the signals A1–A4 from the sensing elements 55, 56, 61, 62. The processor 48 sends the signals T1, T2, T4 and D1 to the input circuit 46 The regular angle signal T1 is generated when the center of each tooth 70 passes by the sensing elements 55, 56.

Figures 24A, 24B, 24C, 24D, 24E, 24F, 24G:
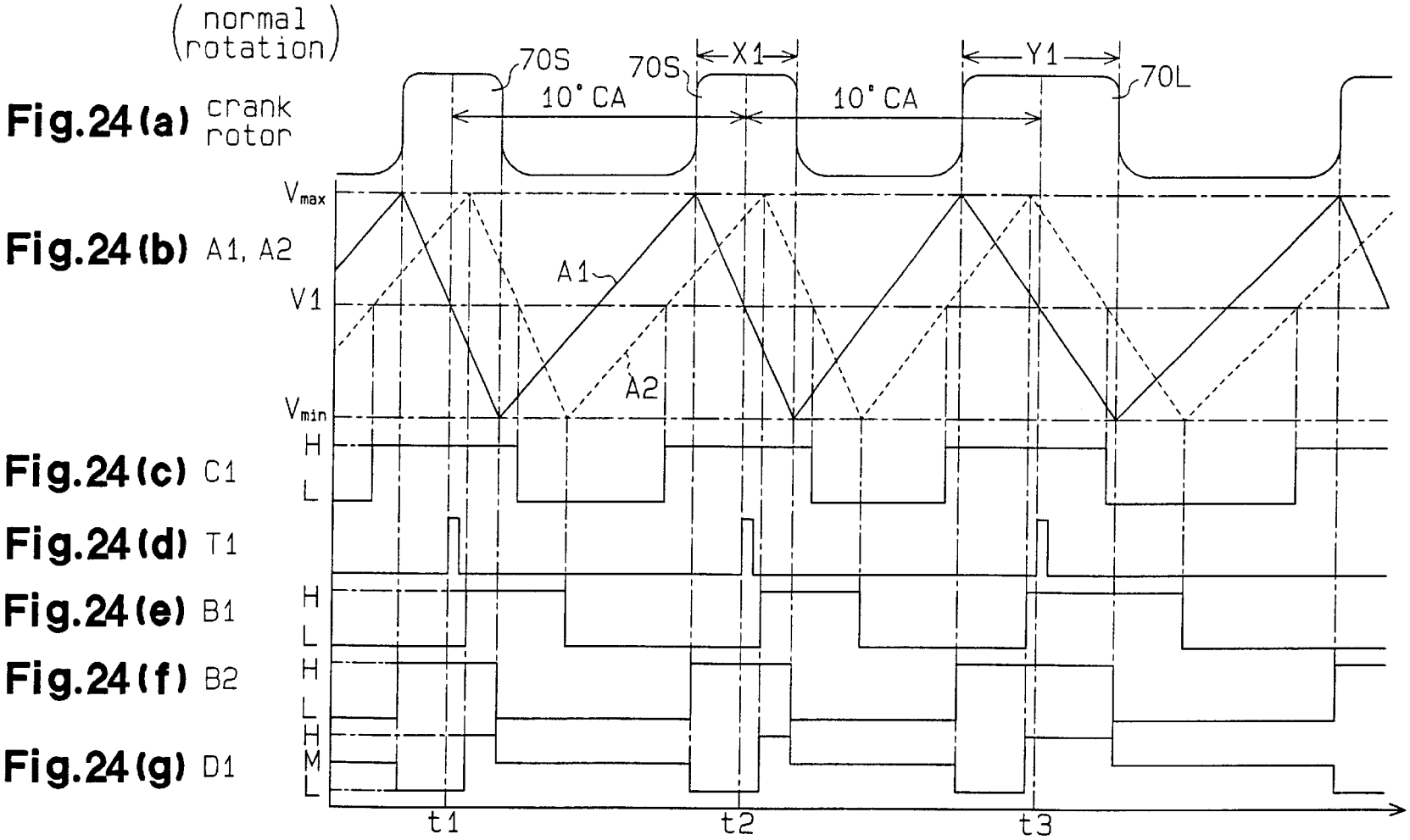
FIG. 24(*a*)–24(*g*) are timing charts showing changes, over time, of signals in relation with the teeth on a crank rotor according to a fifth embodiment.

FIG. 24(*b*) shows changes of the signals A1, A2, which are output from the sensing elements 55, 56 as the crank rotor 54*a* rotates. FIG. 24(*a*) shows the shape of the crank rotor 54*a*, which corresponds to the signal A1.

As in the embodiment of FIGS. 19–21, the signal processor 48 generates the comparison signal C1 (see FIG. 24(*c*)), the differentiated signal B1 (see FIG. 24(*e*)) and the regular angle signal T1 (see FIG. 24(*d*)). The signal processor 48 differentiates the signal A1 to generates a differentiated signal S2 shown in FIG. 24(*f*). The signal B2 is high when the signal A1 is decreasing and is low when the signal A1 is increasing.

The signal processor 48 generates a discrimination signal D1 shown in FIG. 24(*g*) based on the differentiated signals B1, B2. The discrimination signal D1 is either high, middle (M) level or low according to the level of the signals B1, B2. Specifically, when the differentiated signal B2 is low, the discrimination signal D1 is middle level regardless of the level of the differentiated signal B1. When the differentiated signal B2 is high and the differentiated signal B1 is low, the discrimination signal D1 is low. When the differentiated signals B1, B2 are high, the discrimination signal D1 is high.

Since the sensing elements 55, 56 are arranged to satisfy the inequality (3), the level of the discrimination signal D1 when a pulse is occurring in the regular angle signal T1 changes in accordance with the length of the passing tooth 70 and with the rotational direction of the crankshaft 15. The signal D1 is low when a passing tooth 70 is a short tooth 70S (the times t1, t2), and is high when the passing tooth is a long tooth 70L.

When the crankshaft 15 is rotating in the normal direction, the level of the discrimination signal D1 when a pulse is occurring in the regular angle signal T1 is either high or low in accordance with the length of the tooth 70. When the crankshaft 15 is rotating in the reverse direction, the discrimination signal D1 is always middle level as shown in FIG. 25(*f*). In the embodiment of FIGS. 24 and 25, the crank angle and the cam angle are detected in the same manner as the embodiment of FIGS. 22 and 23.

A sixth embodiment of the present invention will now be described with reference to FIG. 26. The differences from the embodiment of FIGS. 1–14 will mainly be discussed below. The sensing elements 55, 56 of the crank position sensor 54 are Hall element type sensors, like the sensing elements 61, 62 of the cam position sensor 60. The sensing elements 55, 56 therefore generate rectangular waves A1, A2. Also, sensing elements 55, 56 are arranged to satisfy the inequality (1) as in the embodiment of FIGS. 1–14.

As shown in FIG. 26(*b*), the signal A1 changes from low to high when the leading edge of a short tooth 71S or of a long tooth 71L passes by the first sensing element 55. The signal A1 changes from high to low when the trailing edge of the tooth passes by the first sensing element 55. As shown in FIG. 26(*c*), the signal A2 from the second sensing element 62 is also a rectangular wave having a predetermined phase lag with respect to the signal A1.

In addition to the regular angle signal T2 and the long tooth signal T4, the signal processor 48 produces a pulse in the regular angle signal T1 and in the long tooth signal T3 by processing the signals A1–A4 from the sensing elements 55, 56, 61, 62. The processor 48 sends the signals T1–T4 to the input circuit 46.

The signal processor 48 produces a pulse in the regular angle signal T1 shown in FIG. 26(*d*) when the signal A1 changes from high to low. In other words, a pulse occurs in the regular angle signal T1 when the crankshaft 15 rotates ten degrees and the trailing edge of each tooth 70 passes by the first sensing element 55. Further, the signal processor 48 produces a pulse in the long tooth pulse signal T3 shown in FIG. 26(*e*) if the signal A2 is high when a pulse is occurring in the signal T1 (at the time t3).

Since the sensing elements 55, 56 are arranged to satisfy the inequality (1), the level of the signal A2 when a pulse is occurring in the regular angle signal T1 depends on whether a short tooth 70S or a long tooth 70L is passing by the sensing element 55, 56. Specifically, if a pulse is occurring in the regular angle signal T1 when the short tooth 70S is passing by the sensing elements 55, 56 (the times t1, t2), the signal A2 is low. On the other hand, if a pulse is occurring in the regular angle signal T1 when the long tooth 70L is passing by the sensing elements 55; 56 (the time t3), the signal A2 is high. Thus, a pulse occurs in the long tooth signal T3 only when the trailing edge of each long tooth 70L passes by the first sensing element 55.

The crank angle detector according to the embodiment of FIG. 26 detects the crank angle and the cam angle in the same manner as the embodiment of FIGS. 1–14. That is, the ECU 40 executes the main routine, the cam angle detecting routine and the crank angle detecting routine thereby computing the crank counter value CRC and the cam counter value CAC.

Figure 27:
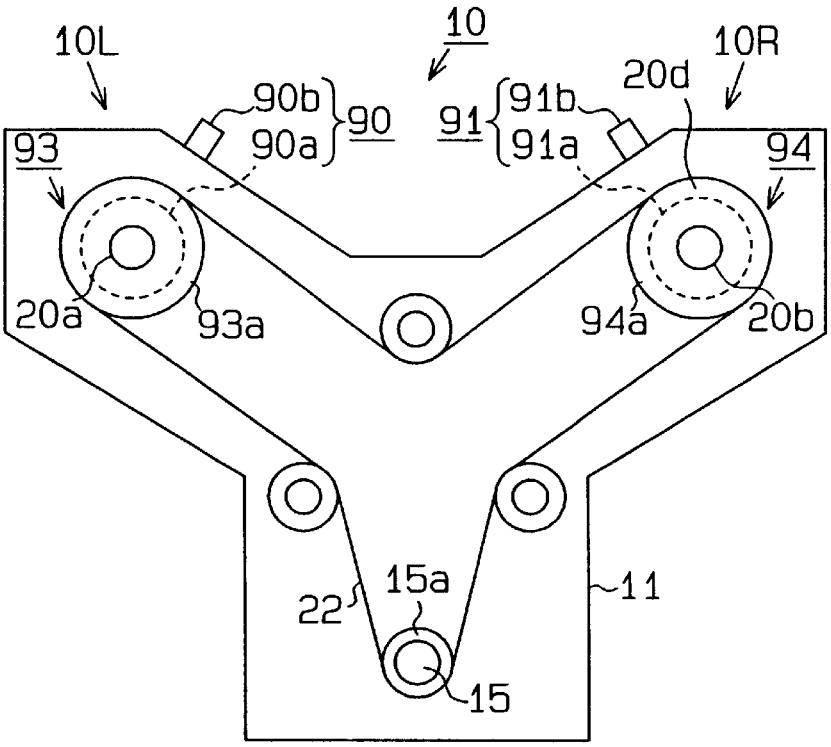
FIG. 27 is a side view illustrating a V-type engine according to a seventh embodiment of the present invention.

A seventh embodiment of the present invention will now be described with reference to FIGS. 27–28 (*b*). A crank angle detector of the seventh embodiment is employed in an eight-cylinder V-type gasoline engine. The differences from the embodiment of FIGS. 1–14 will mainly be discussed below. As shown in FIG. 27, the V-type engine 10 includes a cylinder head having a left bank 10L and a right bank 10R. The left bank 10L and the right bank 10R have an intake camshaft 20*a* and an intake camshaft 20*b*, respectively. Each of the intake camshafts 20*a*, 20*b* is operably coupled to an exhaust camshaft (not shown) in the associated bank 10L, 10R. The intake camshafts 20*a*, 20*b* also have cam pulleys 93*a*, 94*a* at one end, respectively. A crank pulley 15*a* is fixed to one end of the crankshaft 15. The pulleys 93*a*, 94*a* and 15*a* are coupled to one another by a timing belt 22.

The intake camshafts 20*a*, 20*b* include VVTs 93, 94, respectively. The cam pulleys 93*a*, 94*a* constitute a part of the VVTs 93, 94, respectively. The VVTs 93, 94 change the relative rotation of the camshafts 20*a*, 20*b* thereby altering the valve timing of intake valves (not shown) supported in the banks 10L, 10R.

The banks 10L, 10R have cam position sensors 90, 91, respectively. The cam position sensor 90 of the left bank 10L includes a cam rotor 90*a* and a magnetic sensor 90*b*. The cam rotor 90*a* is fixed to the camshaft 20*a* and rotates integrally with the camshaft 20*a*, and the sensor 90*b* is fixed to the cylinder head 17 to face the surface of the cam rotor 90*a*. Likewise, the cam position sensor 91 of the right bank 10R includes a cam rotor 91*a* and a magnetic sensor 91*b*. The cam rotor 91*a* is fixed to the cam rotor 91*a* to integrally rotate with the camshaft 20*b* and the sensor 91*b* is fixed to the cylinder head 17 to face the surface of the cam rotor 91*a*.

Figure 28A:
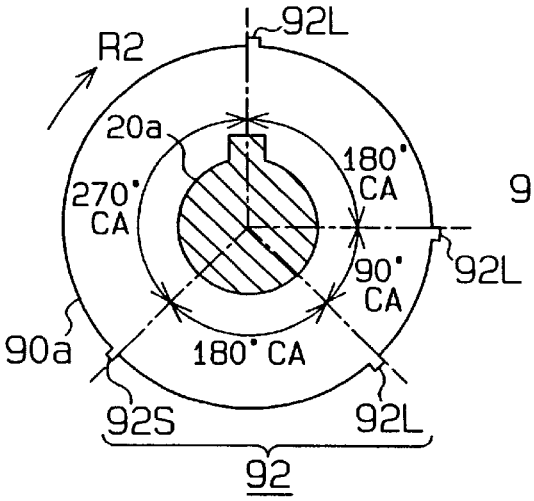
FIGS. 28(*a*) and 28(*b*) are front views illustrating the cam rotors of FIG. 27.
Figure 28B:
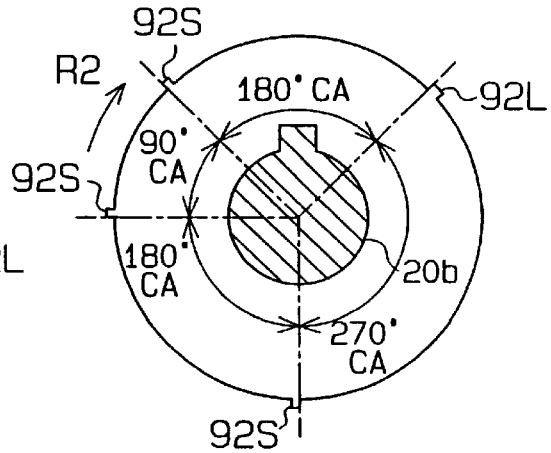

FIGS. 28(*a*) and 28(*b*) show the shapes of the cam rotors 90*a*, 91*a*, respectively. The rotors 90*a*, 91*a* are disks made of magnetic material. The cam rotors 90*a*, 91*a* have teeth 92 formed along their circumferences. In the embodiment of FIGS. 1–14, the cam rotor 60*a* has eight teeth 71, which are spaced apart by equal angular intervals. Each angular interval corresponds to ninety degrees of rotation of the crankshaft 15. In the embodiment of FIGS. 27–28(*b*), however, each of the cam rotors 90*a*, 91*a* has four teeth 92. As the crankshaft 15 rotates ninety degrees, one of the teeth 92 formed on the cam rotors 90*a*, 91*a* passes by the corresponding sensor 90*b*, 91*b*.

Like the magnetic sensor 60*b* in the embodiment of FIGS. 1–14, the magnetic sensors 90*b*, 91*b* each have a pair of Hall element type sensing elements (not shown). The sensing elements of the sensors 90*b*, 91*b* satisfy the inequality (2). As the crankshaft 15 rotates ninety degrees, one of the sensors 90 or 91 sends a signal A3 or A4 to the signal processor 48. Therefore, as in the embodiment of FIGS. 1–14, the signal processor 48 produces pulses in the regular angle signal T2 and in the long tooth signal T4 based on the signals A3, A4 and supplies the signals T2, T4 to the input circuit 46.

The ECU 40 detects the cam angle, or computes the cam counter value CAC, based on the regular angle signal T2 and the long tooth signal T4. The ECU 40 also judges whether a pulse in the signal T2 is based on the signal (A3 or A4) from the cam position sensor 90 or on the signal (A3 or A4) from the can position sensor 91. When a pulse in the regular angle signal T2 is based on the signal A3 or A4 from the cam position sensor 90, the ECU 40 controls the VVT 93 on the left bank 10L based on the crank counter value CRC and on the cam counter value CAC. When a pulse in the regular angle signal T2 is based on the signal A3 or A4 from the cam position sensor 91, the ECU 40 controls the VVT 94 on the right bank 10R based on the crank counter value CRC and on the cam counter value CAC. Accordingly, the VVTs 93, 94 change the valve timing of the intake valve in the banks 10L and 10R.

In the embodiment of FIGS. 1–14, a single cam rotor 60*a* has all the teeth 71. In the embodiment of FIGS. 27–28(*b*), the teeth 92 are distributed to the cam rotors 90*a*, 91*a*. Thus, the number of teeth 92 on each cam rotor 90*a*, 91*a* is decreased compared to the cam rotor 60*a* without increasing the cycle of the regular angle signal T2. The cam rotors 90*a*, 91*a* are therefore easy to machine.

Figure 29:
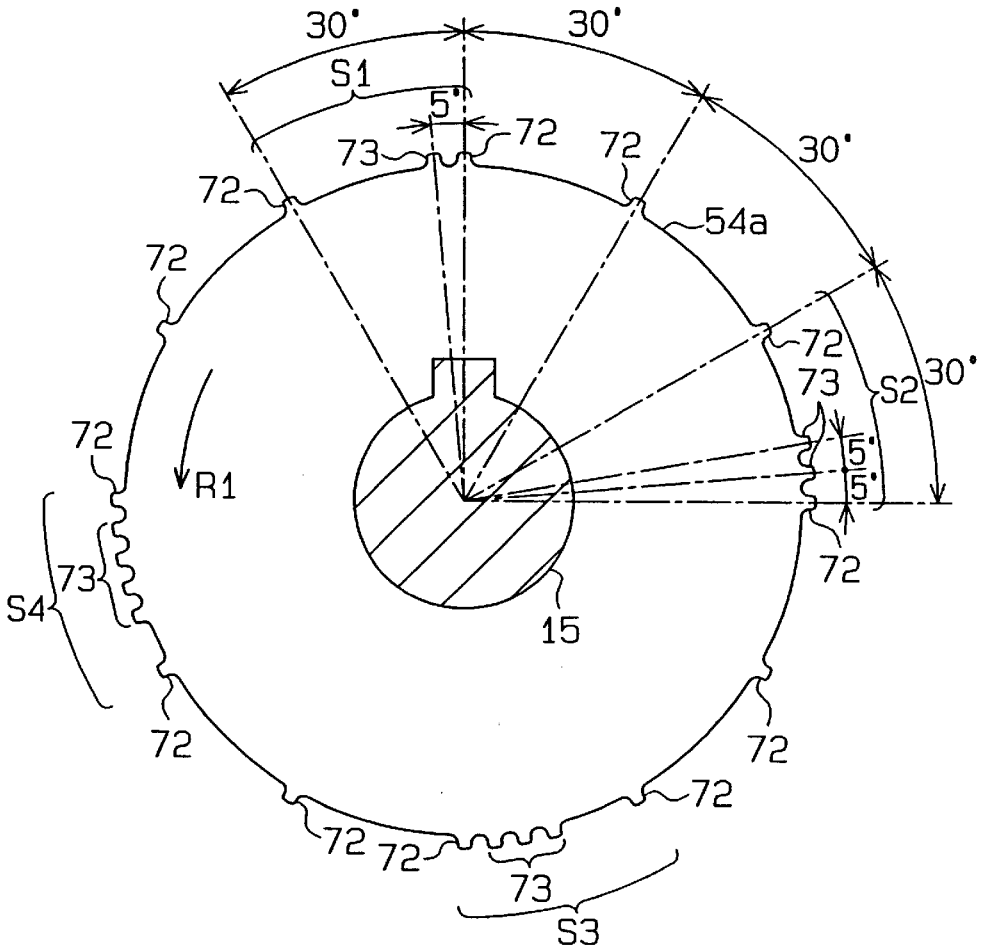
FIG. 29 is a front view illustrating a crank rotor according to an eighth embodiment.

An eighth embodiment of the present invention will now be described with reference to FIGS. 29–43. The difference from the embodiment of FIGS. 1–14 will mainly be discussed below. As shown in FIG. 29, a crank rotor 54*a* has substantially rectangular reference teeth 72 and distinction teeth 73.

The reference teeth 72 are spaced apart by equal angular intervals (thirty degrees in this embodiment) and the number of reference teeth 72 is twelve. The distinction teeth 73 are arranged next to four corresponding reference teeth 72. The four corresponding reference teeth are spaced apart by ninety degrees. Specifically, one to four distinction teeth 73 are formed next to a corresponding one of the reference teeth 72 and are spaced apart from the corresponding tooth 72 or from each other by a predetermined angle (five degrees in this embodiment). Thus, four pairs of adjacent reference teeth 72, which have one to four distinction teeth 73 between them, constitute first to fourth cylinder detection segments S1–S4. The first segment S1 has two reference teeth 72 and a distinction tooth 73 in between. The second segment S2 has two reference teeth 72 and two distinction teeth 73 in between. The third segment S3 has two reference teeth 72 and three distinction teeth 73 in between. The fourth segment S4 has two reference teeth 72 and four distinction teeth 73 in between.

Figure 30:
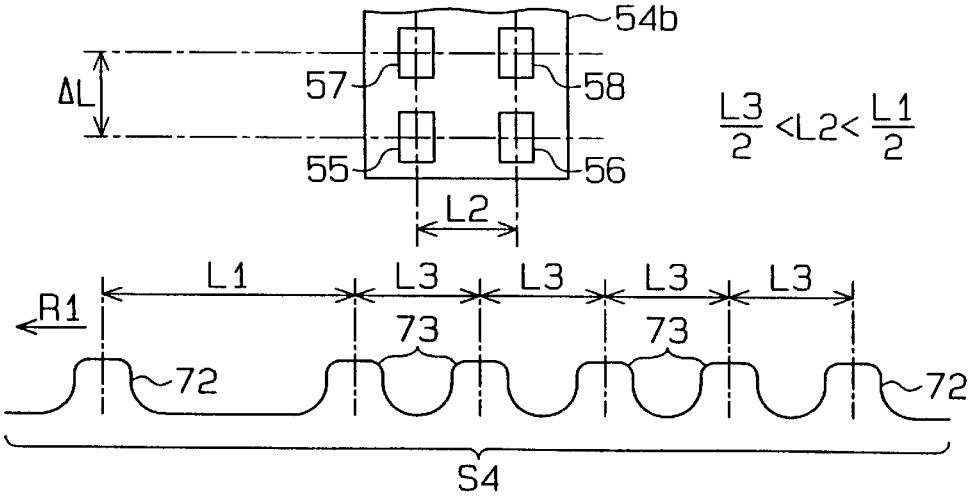
FIG. 30 is a schematic view illustrating the arrangement of sensing elements in a crank position sensor of the eighth embodiment.

FIG. 30 is a developed view showing the fourth cylinder detection segment S4 and a magnetic sensor 54*b* facing the periphery of the rotor 54*a*. The sensor 54*b* has a first sensing element 55 and a second sensing element 56, which are magnetic reluctance element (MRE) type sensors. The first and second portions 55, 56 are arranged along the rotational direction R1 of the crank rotor 54*a*. The crank rotor 54*a*, which is made of magnetic material, creates a magnetic field about its circumference. The sensing elements 55, 56 detects the direction of the magnetic field at the sensing elements 55, 56.

The distance L2 between the centers of the sensing elements 55 and 56, the distance L1 between the centers of the leading reference tooth 72 and the adjacent distinction tooth 73, the distance L3 between the center of each adjacent pair of the distinction teeth 73 satisfy the following inequality (7). The distance between the trailing distinction tooth 73 and the trailing reference tooth 72 is also the distance L3.

$$L3/2<L2<L1/2 \tag{7}$$

In the inequality (7), the distance L1 is the distance between the leading reference tooth 72 (of a segment) and the following distinction tooth 73. The distance L1 of the segment S4 is the shortest among the distances L1 of all the segments S1–S4.

The sensor 54*b* also has sensing elements 57, 58 for correcting signals from the sensing elements 55, 56. The correcting elements 57, 58 are magnetic reluctance element (MRE) type sensors having the same output characteristic as the sensing elements 55, 56. Like the sensing elements 55, 56, the correcting elements 57, 58 are arranged along the direction R1 and are spaced apart by the distance L2. Each of the correcting elements 57, 58 is also spaced apart from the corresponding one of the sensing elements 55, 56 by a predetermined distance) L.

Figure 31:
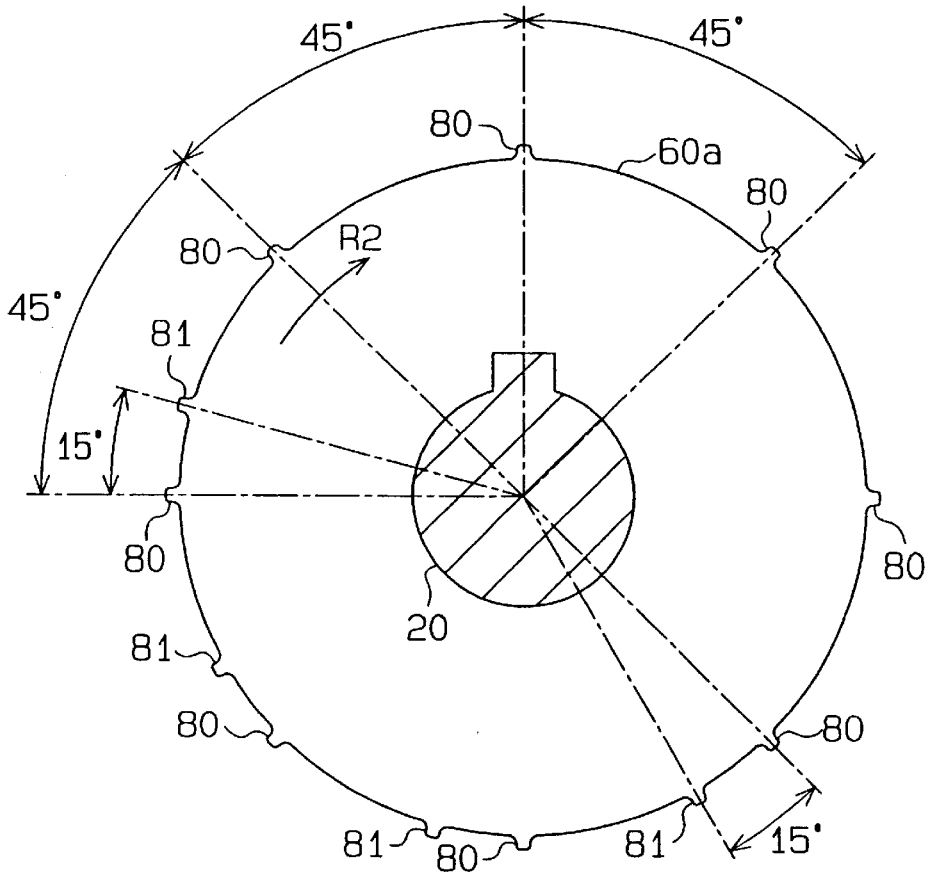
FIG. 31 is a front view illustrating a cam rotor according to an eighth embodiment.

A cam position sensor 60 located in the vicinity of the intake camshaft 20 will now be described. As in the embodiment of FIGS. 1–14, the cam position sensor 60 includes a cam rotor 60*a* and a magnetic sensor 60*b*. The cam rotor 60*a* is a disk made of magnetic material and has eight reference teeth 80 and four distinction teeth 81 formed in its circumference as shown in FIG. 31. The teeth 80, 81 are substantially rectangular.

The reference teeth 80 are spaced apart by equal angular intervals (forty-five degrees in this embodiment). Each distinction tooth 81 is located next to one of four consecutive reference teeth 80. Each distinction tooth 81 is located on the leading side of the corresponding reference tooth 80, and is spaced apart from the corresponding reference tooth 80 by a predetermined angle (fifteen degrees in this embodiment). Therefore, the cam rotor 60*a* has a first one hundred eighty degree cylinder segment, which has four of the reference teeth 80 and the four distinction teeth 81, and a second one hundred eighty degree cylinder segment, which has the other four referential teeth 80.

Figure 32:
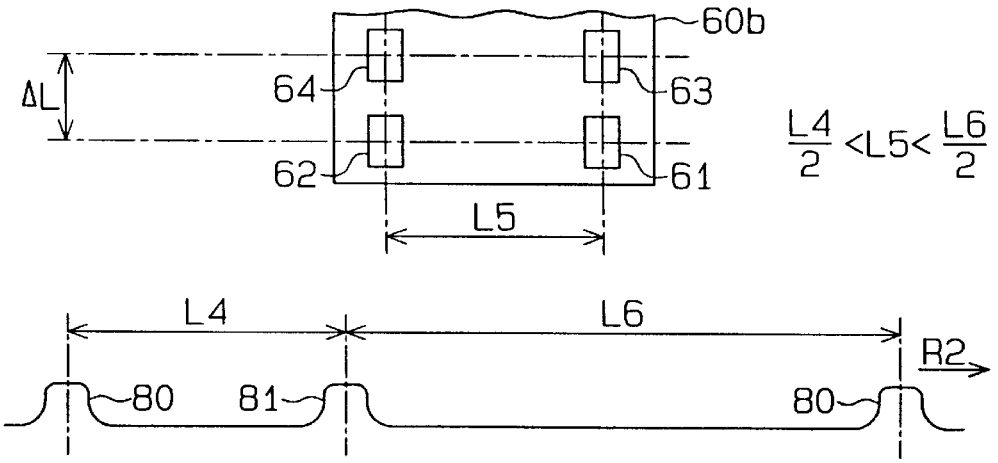
FIG. 32 is a schematic view illustrating the arrangement of sensing elements in a cam position sensor of the eighth embodiment.

FIG. 32 is a developed view showing a portion of the cam rotor 60*a* and a magnetic sensor 60*b* facing the peripheral surface of the rotor 60*a*. Like the sensor 54*b* of the crank position sensor 54, the sensor 60*b* has a first sensing element 61 and a second sensing element 62, which are magnetic reluctance element (MRE) type sensors. The first and second elements 61, 62 are arranged along the rotational direction R2 of the cam rotor 60*a*. The cam rotor 60*a*, which is made of magnetic material, creates a magnetic field about its circumference. The sensing elements 61, 62 detect the direction of the magnetic field at the sensing elements 61, 62.

The distance L5 between the centers of the sensing elements 61 and 62, the distance L4 between the center of the leading reference tooth 80 and the center of the distinction tooth 81, and the distance L6 between the center of the distinction tooth 81 and the center of the trailing reference tooth 80 satisfy the following inequality (8).

$$L4/2<L5<L6/2 \quad (8)$$

The sensor 60*b* also has sensing elements 63, 64 for correcting signals from the sensing elements 61, 62. The correcting elements 63, 64 are magnetic reluctance element (MRE) type sensors having the same output characteristics as the sensing elements 61, 62. Like the sensing elements 61, 62, the correcting elements 63, 64 are arranged along the direction R2 and are spaced apart by the distance L5. Each of the correcting elements 63, 64 is also radially spaced apart from the corresponding sensing element 61, 62 by a predetermined distance) L.

The crank angle sensor according to the embodiment of FIGS. 29–43 has the same electrical structure as that shown in FIG. 6. The signal processor 48 is connected to the crank position sensor 54 and to the cam position sensor 60 and receives signals from the sensing elements 55–58 and 61–64. The signal processor 48 processes these signals to generate a crank reference angle signal CRSG1, a crank distinction signal CRSG2, a cam reference angle signal CASG1 and a cam distinction signal CASG2 and then supplies the signals CRSG1, CRSG2, CASG1 and CASG2 to the input circuit 46.

Figures 33A, 33B, 33C:
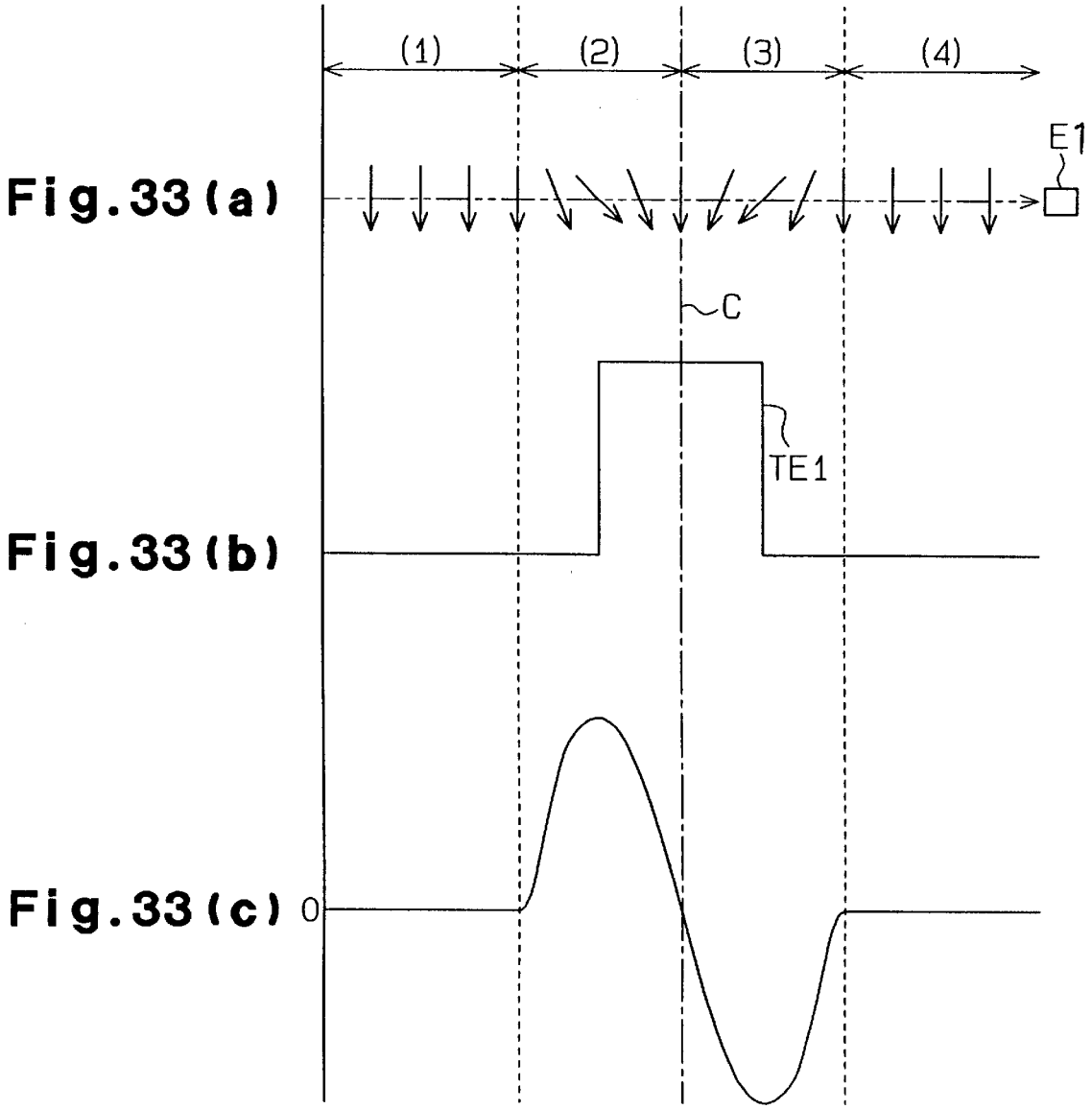
FIGS. 33(*a*)–33(*c*) are timing chart illustrating the principle of the crank position sensor and the cam position sensor of the eighth embodiment.

The signals output from the sensing elements 55–58 and the crank reference angle signal CRSG1 and the crank distinction signal CRSG2 will now be described. Referring to FIGS. 33(*a*) and 33(*b*), the operation of a magnetic reluctance element E1 (sensing elements 55–58) will be described. Specifically, FIG. 33(*c*) shows changes of the signal output from the element E1 as the element E1 moves left to right along the two-dot chain line of FIG. 33(*a*) past a rectangular tooth TE1 (FIG. 33(*b*)), which represents one of the reference teeth 72 or distinction teeth 73.

In a phase (1), the element E1 is located to the left of the tooth TE1 and is sufficiently spaced apart from the tooth TE1.

In the phase (1), the direction of the magnetic field at the element E1, which is shown by arrows, is parallel to the center line C of the tooth TE1. Thus, the output signal of the element E1 is zero as shown in FIG. 33(*c*).

In a phase (2), the element E1 passes by the left edge of the tooth TE1.

In the phase (2), the direction of the magnetic field is gradually inclined relative to the center line C of the tooth TE1. Then, the direction of the magnetic field gradually becomes parallel to the center line C. When the element E1 is aligned with the center line C, the magnetic field direction is parallel to the center line C. Therefore, the signal from the element E1 is initially increased from zero and is then decreased to zero.

In a phase (3), the element E1 passes by the right edge of the tooth TE1.

The magnetic field direction is gradually inclined in the opposite direction relative to the phase (2). Then the magnetic field direction gradually becomes parallel to the center line C of the tooth TE1. Therefore, the signal from the element E1 is initially decreased from zero and is then increased to zero.

In a phase (4), the element E1 is located to the right of the tooth TE1 and is sufficiently spaced apart from the tooth TE1.

In the phase (4), the direction of the magnetic field is parallel to the center line C of the tooth T1. Therefore, the output of the element E1 is zero.

As shown in FIG. 33(*c*), the signal from the element E1 is a sine wave. When the element E1 passes by the center line C of the tooth TE1, the signal decreases to zero. If the tooth TE1 is moved relative to the element E1 instead of moving the element E1, the element E1 generates an identical signal.

Figures 34A, 34B, 34C, 34D:
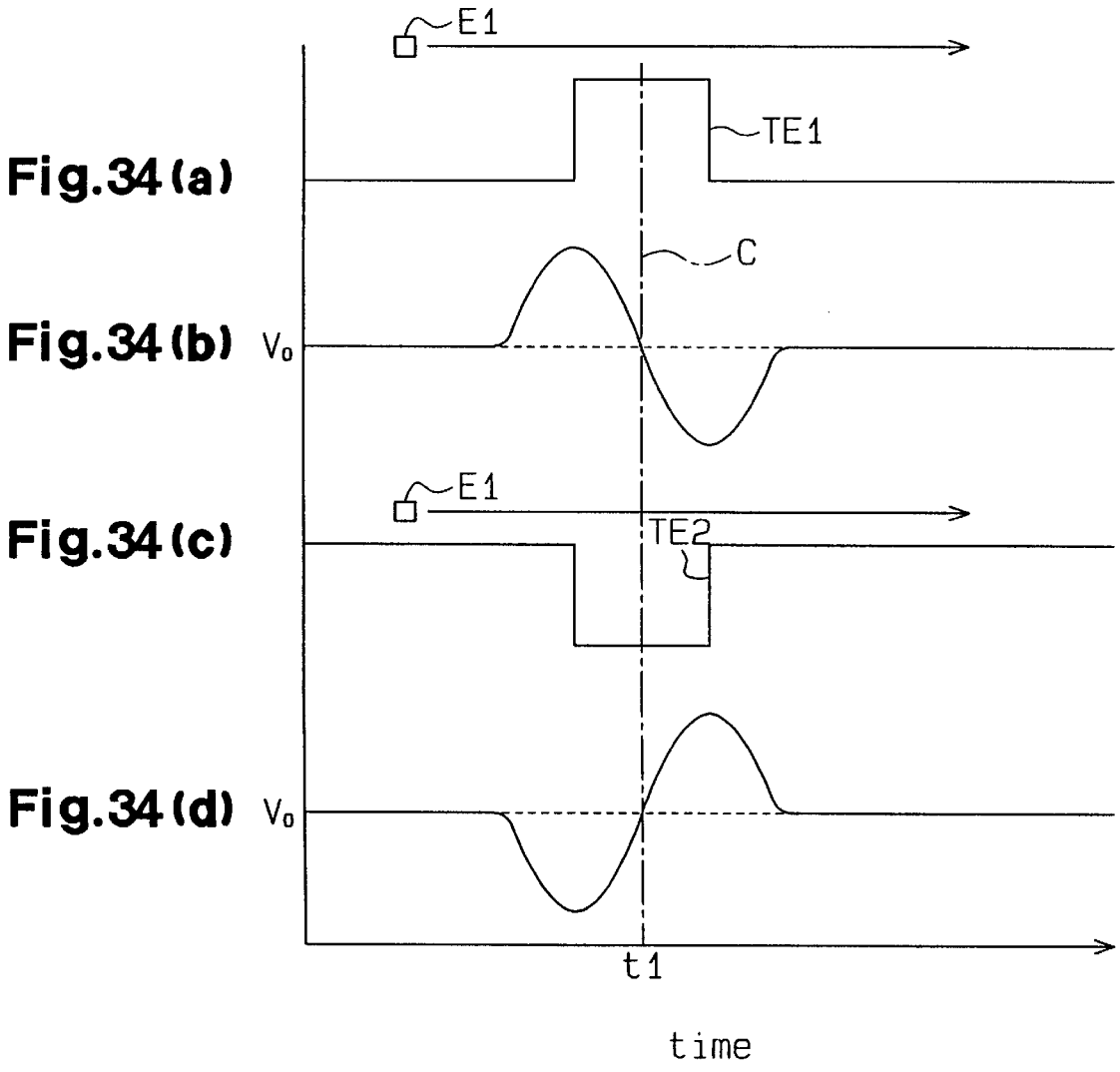
FIGS. 34(*a*)–34(*d*) are timing chart illustrating the principle of a crank position sensor and a cam position sensor.

As shown in FIGS. 34(*a*)–34(*d*), the tooth TE1 may be replaced with a recess TE2. In this case, the element E1 outputs the signal shown in FIG. 34(*d*). The signal of FIG. 34(*d*) is a reference value V0 when the element E1 passes by the center line C of the recess TE2. The signal of FIG. 34(*d*) and the signal of FIG. 34(*b*) are symmetric with respect to the center line C.

Figures 35A, 35B:
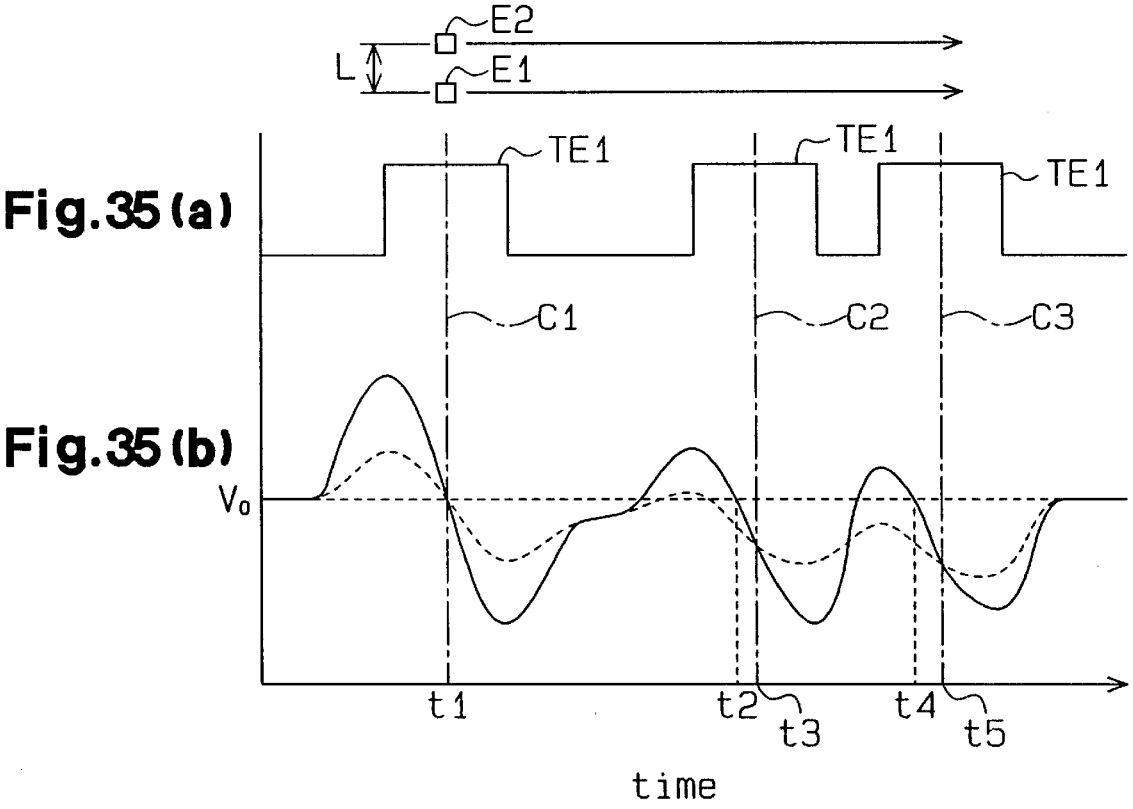
FIGS. 35(*a*) and 35(*b*) are timing chart illustrating the operation of the eighth embodiment.

However, if there are a plurality of teeth TE1 and the distance between the teeth TE1 differs, the element E1 outputs a signal shown by a solid line of FIG. 35(*b*). In this case, times t1, t3, t5, at which the element E1 is aligned with the center lines C1–C3 of the teeth TE1, are not necessarily the same as times t1, t2, t4, at which the signal from the element E1 is the reference value V0. Suppose an element E2 is located above the element E1 and is spaced apart from the element E1 by a predetermined distance L. The element E2 is moved together with the element E1 along the circumference of the magnetic material. In this case, the element E2 outputs a signal shown by the broken line of FIG. 35(*b*). When the elements E1, E2 are aligned with the center line C1–C3 of the teeth TE1, the signals from the elements E1, E2 always have the same values. If the teeth TE1 are replaced recesses TE2, the signals from the elements E1, E2 match with each other when the elements E1, E2 are at the center line of the recess TE2.

In the embodiment of FIGS. 29–43, the above described changes of the signals from the elements E1, E2 are used to detect the passage of the teeth 72, 73, 80, 81 on the crank rotor 54*a* and on the cam rotor 60*a* over the magnetic sensors 54*b*, 60*b*.

Figures 36A, 36B, 36C:
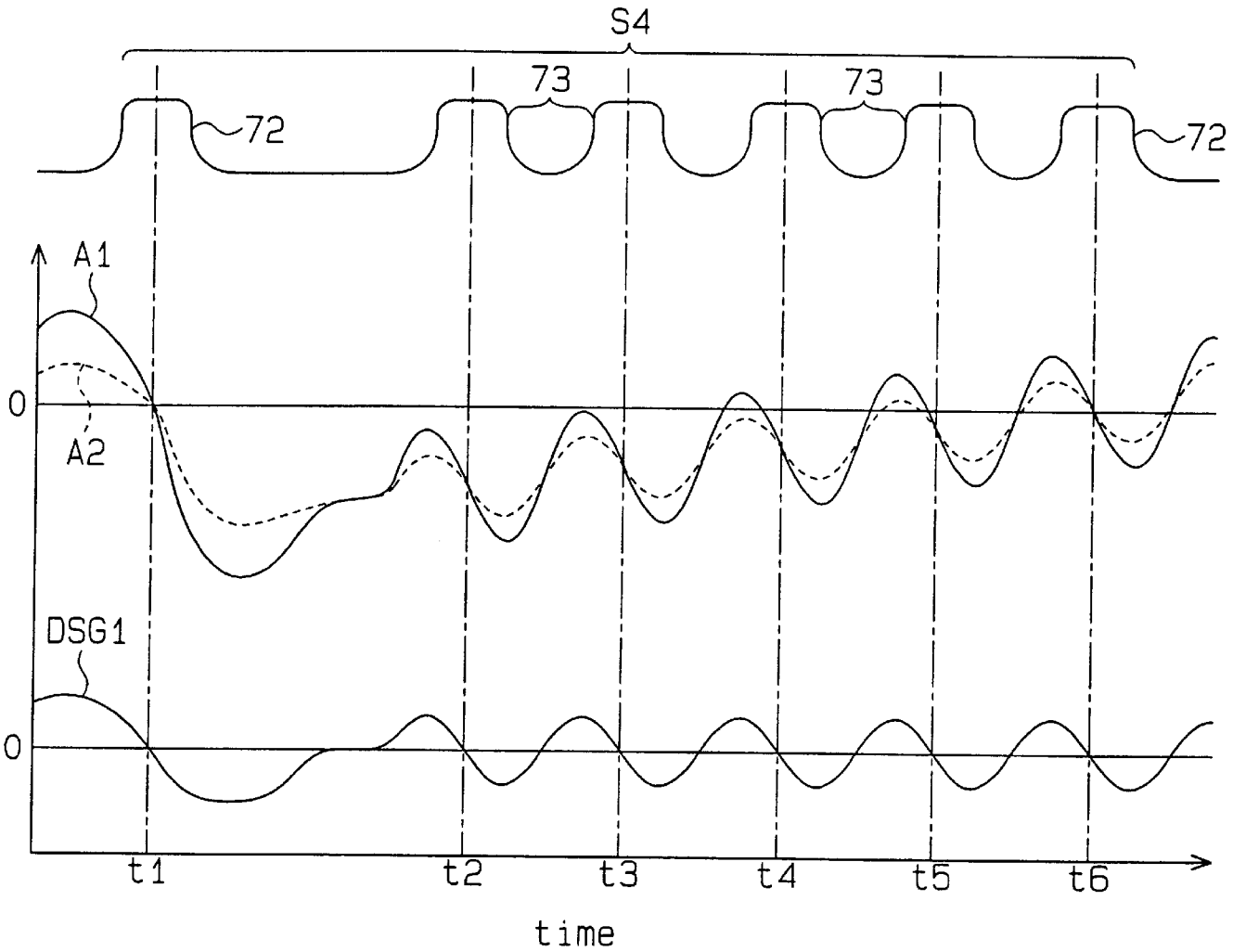
FIGS. 36(*a*)–36(*c*) are timing charts showing changes, over time, of signals in relation with the teeth on the crank rotor of FIG. 29.

Referring to FIGS. 36(*a*) and 36(*b*), changes of signals from the sensing elements 55, 57 will be described. FIG. 36(*a*) shows the reference teeth 72 and the detection teeth 73 in the fourth cylinder detection segment S4. FIG. 36(*b*) shows the signal A1 (a solid line) output from the sensing element 55 and the signal A2 (a broken line) output from the correcting element 57, which corresponds to the sensing element 55.

As shown in FIG. 36(*b*), the amplitude of the signal A2 is smaller than that of the signal A1. This is because the correcting element 57 is located farther from the crank rotor 54*a* than the first sensing element 55. Changes of magnetic field at the correcting element 57 are smaller than those at the sensing element 55.

When the sensing element 55 passes by the center of tooth 72, 71, the signal A1 is not necessarily zero. The shape of each tooth 72, 73 is not symmetrical with respect to its center line. Therefore, the state of magnetic field at the center line of each tooth 72, 73 is different from one tooth to another. Thus, the times at which the signal A1 decreases to zero do not match the times at which the sensing element 55 is at the center line of the teeth 72, 73. The signal processor 48 executes the process described below for correcting such differences.

Specifically, the signal processor 48 generates a difference signal DSG1(A1–A2) of the signals A1 and A2. As shown in FIG. 36(*c*), the difference signal DSG1 is always zero when the sensing elements 55, 57 pass by the center line of each tooth 72, 73 This is because the amplitudes of the signals A1, A2 are the same when the sensing elements 55, 57 are aligned with the center line of each tooth 72, 73 as shown in FIG. 36(*b*). The difference signal DSG1 is used to determine times t1–t6, at which the first sensing element 55 passes by the center of each tooth 72, 73.

The signal processor 48 also generates a difference signal DSG2 of the signals from the second sensing element 56 and the corresponding correcting element 58. Based on the difference signals DSG1 and DSG2, the processor 48 produces pulses in the crank reference angle signal CRSG1 and the crank distinction signal CRSG2.

FIG. 37(*b*) shows changes of the difference signals DSG1 and DSG2 when the teeth 72, 73 of the fourth segment S4 pass by the magnetic sensor 54*b*. As described above, the sensing elements 55, 56 are spaced apart by the distance L2 along the rotational direction R1 of the crank rotor 54*a*. Therefore, the difference signal DSG1, which is generated based on the signals form the sensing elements 55, 57, has a predetermined phase lag with respect to the difference signal DSG2, which is generated based on the signals form the sensing elements 56, 58.

The signal processor 48 generates a first rectangular signal TSG1 shown in FIG. 37(*c*). The signal TSG1 is high when the difference signal DSG1 is greater than zero and is low when the signal DSG1 is equal to zero or smaller. Likewise, the processor 48 generates a second rectangular signal TSG2 shown in FIG. 37(*d*). The signal TSG2 is high when the difference signal DSG2 is greater than zero and is low when the signal DSG2 is equal to or smaller than zero.

The processor 48 produces a pulse in the crank reference angle pulse signal CRSG1 shown in FIG. 37(*e*) if the signal TSG2 is low when the TSG1 changes from high to low (times t1, t6). The processor 48 supplies the signal CRSG1 to the input circuit 46. The processor 48 also produces a pulse in the crank reference angle pulse signal CRSG2 shown in FIG. 37(*f*) if the signal TSG2 is high when the TSG1 changes from high to low (times t2 –t6). The processor 48 the signal CRSG2 to the input circuit 46.

Since the sensing elements 55, 56 are arranged to satisfy the inequality (7), the level of the signal TSG2 when the signal TSG1 falls changes in accordance with the type of tooth passing by the sensing elements 55, 56. That is, as shown in FIGS. 37(*c*) and 37(*d*), the level of the signal TSG2 is low when the signal TSG1 falls if one of the reference teeth 72 is passing by the sensing element 55, 56 and is high if one of the distinction teeth 73 is passing by the sensing elements 55, 56. The signal processor 48 produces a pulse in the crank reference angle signal CRSG1 on detecting one of the reference teeth 72 and produces a pulse in the crank distinction signal CRSG2 on detecting one of the distinction teeth 73.

Signals output from the sensing elements 61–64 of the cam position sensor 60, a cam reference angle signal CASG1 and a cam distinction signal CASG2 will now be described. In the same manner for generating the signals DSG1 and DSG2, the signal processor 48 generates a difference signal DSG3 shown by a solid line in FIG. 38(*b*) based on the signals output from the first sensing element 61 and the corresponding correcting element 63. The processor 48 also generates a difference signal DSG4 shown by a broken line in FIG. 38(*b*) based on the signals from the second sensing element 62 and the corresponding correcting element 64. As described above, the sensing elements 61, 62 are spaced apart by the distance L5 along the rotational direction R2 of the cam rotor 60*a*. Therefore, the difference signal DSG3 has a predetermined phase lag with respect to the difference signal DSG4.

The signal processor 48 generates a third rectangular signal TSG3 shown in FIG. 38(*c*). The signal TSG3 is high when the difference signal DSG3 is greater than zero and is low when the signal DSG3 is equal to zero or smaller. Likewise, the processor 48 generates a fourth rectangular signal TSG4 shown in FIG. 38(*d*). The signal TSG4 is high when the difference signal DSG4 is greater than zero and is low when the signal DSG4 is equal to or smaller than zero.

The processor 48 produces a pulse in the cam reference angle signal CASG1 shown in FIG. 38(*e*) if the signal TSG4 is low when the signal TSG3 changes from high to low (times t1, t3). The processor 48 supplies the signal CASG1 to the input circuit 46. The processor 48 also produces a pulse in the cam distinction pulse signal CASG2 shown in FIG. 38(*f*) if the signal TSG4 is high when the signal TSG3 changes from high to low (time t2). The processor 48 supplies the signal CASG2 to the input circuit 46.

Since the sensing elements 61, 62 are arranged to satisfy the inequality (8), the level of the signal TSG4 when the signal TSG3 falls changes in accordance with the type of tooth passing by the sensing elements 61, 62. That is, as shown in FIGS. 38(*c*) and 38(*d*), the signal TSG4 is low when the signal TSG3 falls if one of the reference teeth 80 is passing by the sensing element 61, 62. The signal TSG4 is high if one of the distinction teeth 81 is passing by the sensing elements 61, 62. The signal processor 48 produces a pulse in the cam reference angle signal CASG1 on detecting one of the reference teeth 80 and produces a pulse in the cam distinction signal CASG2 on detecting one of the distinction teeth 81.

FIGS. 39(*a*)–39(*c*) show changes of the crank reference angle signal CRSG1 and the crank distinction signal CRSG2 in relation with the teeth 72, 73 on the crank rotor 54*a*. The FIGS. 39(*d*)–39(*i*) show changes of the cam reference angle signal CASG1 and the cam distinction signal CASG2 in relation with the teeth 80, 81 of the cam rotor 60*a*. FIGS. 39(*d*)–39(*f*) show the changes of the signals CASG1 and CASG2 when the valve timing of the intake valves 23 is most retarded by the VVT 30. FIGS. 39(*g*)–39(*i*) show the changes of the signals CASG1 and CASG2 when the valve timing of the intake valves 23 is most advanced by the VVT 30.

As shown in FIGS. 39(*d*)–39(*i*), the times at which the signals CASG1 and CASG2 pulse change when the VVT 30 changes the rotational phase of the intake camshaft 20. However, the valve timing of the intake valves 23 is always most retarded by the VVT 30 during a period from when the engine 10 is started to when cylinder distinction is completed. Therefore, as shown in FIGS. 39(*d*)–39(*f*), the cam reference angle signal CASG1 and the cam distinction signal CASG2 pulse when the teeth 72, 73 in cylinder distinction segments S1–S4 are passing by the sensing elements 55, 56.

Figure 40:
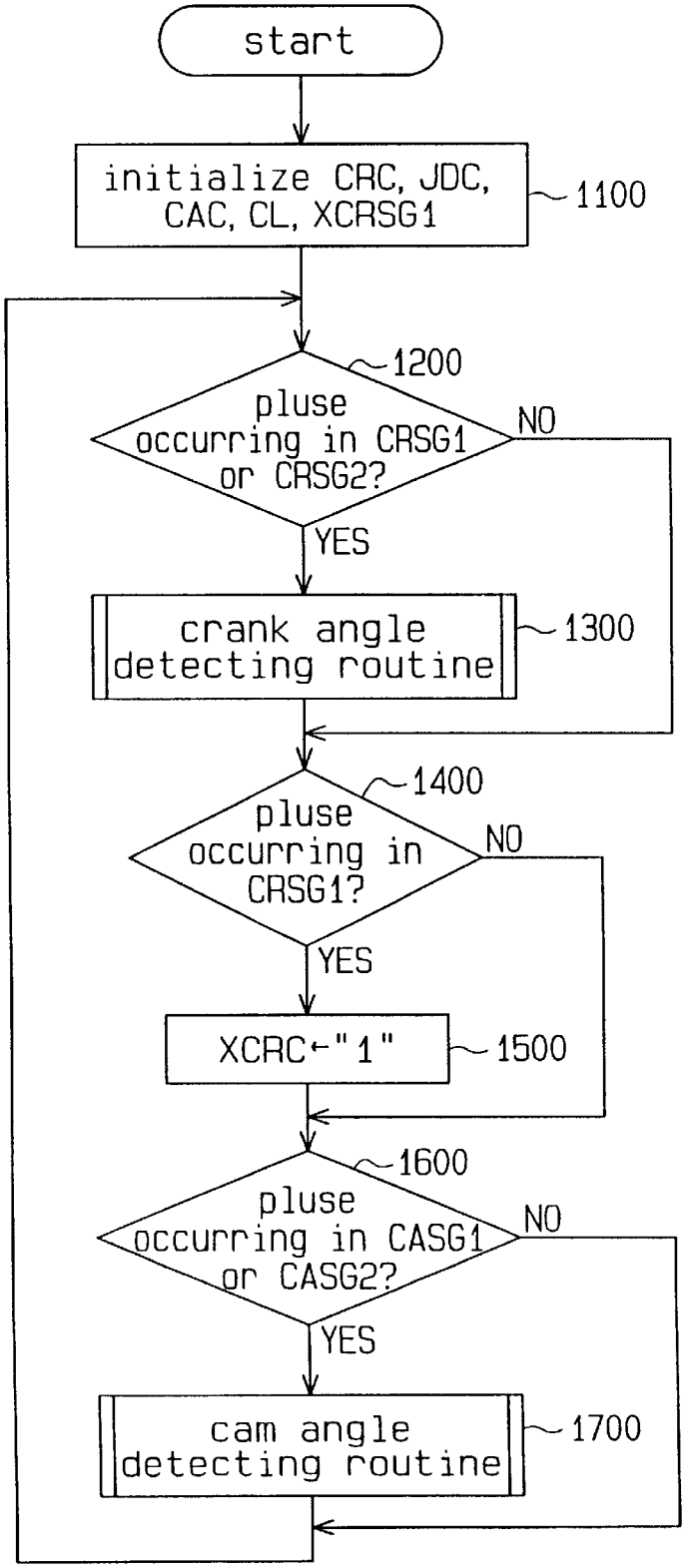
FIG. 40 is a flowchart showing a main routine of the eighth embodiment.

The operation of the crank angle detector will now be described with reference to FIGS. 40–43 A main routine executed by the ECU 40 will first be described with reference to FIG. 40. The main routine is started when the ignition switch (not shown) is moved to the ON position, and is continued until the ignition switch is moved to the OFF position. The flowchart of FIG. 40 only shows steps concerning with the detection of the crank angle.

At step 1100, the ECU 40 initializes a crank counter value CRC, a distinction counter value JDC, a cam counter value CAC, a cam level value CL and a flag XCFSG1 for detecting a crank reference angle. Specifically, the ECU 40 substitutes initial values stored in the backup RAM 44 for the current values CRC. JDC, CAC, CL and XCRSG1. In the embodiment of FIGS. 29–43, the initial value of the crank counter value CRC is one hundred, the initial value of the distinction counter value JDC is zero, the initial value of the cam counter value CAC is one hundred, the initial value of the cam level counter value CL is one hundred and the initial value of the flag XCRSG1 is zero.

At step 1200, the ECU judges whether a pulse is occurring in either of the crank reference angle signal CRSG1 or the crank distinction signal CRSG2. If the determination is positive, the ECU 40 moves to step 1300 and executes a crank angle detection routine. The crank angle detection routine is an interrupt executed every time the teeth 72, 73 pass by the sensing elements 55, 56 of the crank position sensor 54. If the determination is negative at step 1200 or after executing the crank angle detection routine, the ECU 40 moves to step 1400.

At step 1400, the ECU 40 judges whether a pulse is occurring in the crank reference angle signal CRSG1. If the determination is positive, the ECU 40 moves to step 1500. At step 1500, the ECU 40 sets the flag XCRSG1 to one.

The flag XCRSG1 is used to judge whether the crank reference angle signal CRSG1 has pulsed at least once since the ignition switch was moved to the ON position and the main routine was started. Therefore, the flag XCRSG1 is zero from when the main routine is started until when the crank reference angle signal CRSG1 is high. The flag XCRSG1 is set to one when the CRSG1 first pulses. Thereafter, the flag XCRSG1 is maintained at one until the main routine is finished.

If the determination at step 1400 is negative or after executing step 1500, the ECU 40 moves to step 1600. At step 1600, the ECU 40 judges whether a pulse is occurring in any one of the cam reference angle signal CASG1 or the cam distinction signal CASG2. If the determination is positive, the ECU 40 moves to step 1700 and performs a cam angle detection routine. The cam angle detection routine is an interrupt executed every time the teeth 80, 81 of the cam rotor 60*a* pass by the sensing elements 61, 662 of the cam position sensor 60.

If the determination at step 1600 is negative, or after executing the cam angle detection routine, the ECU 40 moves to step 1200.

Figure 41:
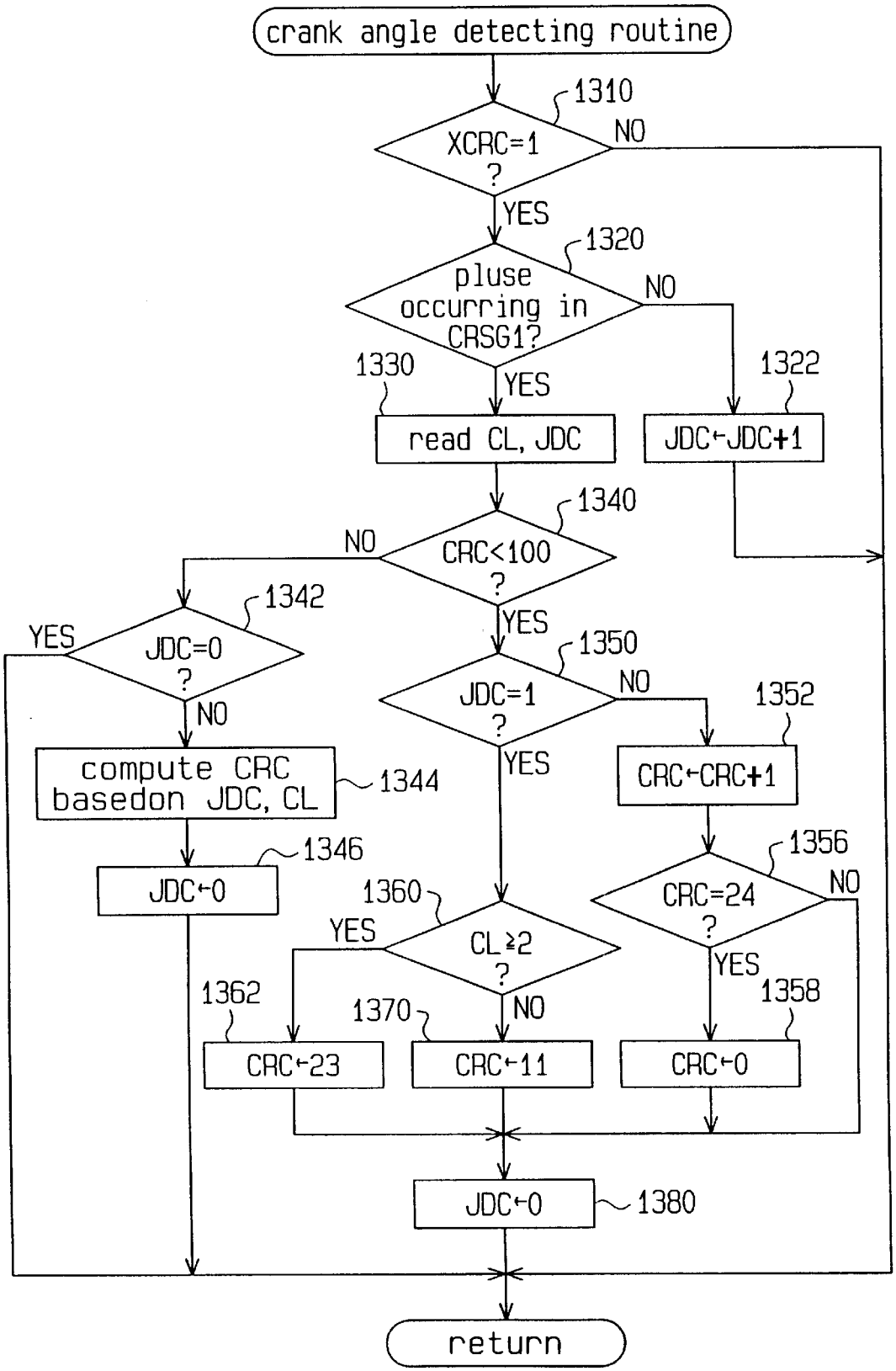
FIG. 41 is a flowchart showing a crank angle detecting routine of the eighth embodiment.

The crank angle detecting routine will now be described with reference to FIG. 41.

At step 1310, the ECU 40 judges whether the flag XCRSG1 is one. If the determination is negative, the ECU 40 judges that the crank reference angle signal CRSG1 has never pulsed and temporarily suspends the current routine.

If the determination is positive at step 1310, the ECU 40 judges that the signal CRSG1 has pulsed at least once and moves to step 1320.

At step 1320, the ECU 40 judges whether a pulse is occurring in the signal CRSG1. If the determination is negative, the ECU 40 judges that the crank discrimination signal CRSG2 is high and moves to step 1322. At step 1322, the ECU 40 increments the distinction counter value JDC by one and stores the incremented value JDC in the RAM 43.

When the leading reference tooth 72 in either of the distinction segments S1–S4 passes by the sensing elements 55, 56, the counter value JDC is incremented each time one of the consecutive distinction teeth 73 passes by the sensing elements 55, 56. Therefore, when the trailing reference tooth 72 passes the sensing elements 55, 56 and the crank reference angle signal CRSG1 is high, the counter value JDC indicates which one of the segments S1–S4 has just passed by the sensing elements 55, 56. That is, the segment (S1–S4) is identified based on the number of the distinction teeth 73 between the corresponding pair of the reference teeth 72. Based on the identification of the segments (S1–S4), the positions of the pistons 13 in the cylinders 12 are determined. After executing step 1322, the ECU 40 temporarily suspends the current routine.

If the determination at step 1320 is positive, the ECU 40 judges that a pulse is occurring in the crank reference angle signal CRSG1, and moves to step 1330.

At step 1330, the ECU 40 reads the cam level value CL and the distinction counter value JDC from the RAM 43. The cam level value CL is used to judge which of the first and second cylinder segments the tooth (80 or 81) that is currently passing by the sensing elements 61, 62 belongs to. In other words, the cam level value CL is used to judge that the crankshaft 15 is either in its first turn or in its second turn. The cam level value CL is determined in a cam angle detection routine, which will be discussed below, and is stored in the RAM 43. If the value CL is two or greater, the crankshaft 15 is in its first turn and if the value CL is smaller than two, the crankshaft 15 is in its second turn.

At step 1340, the ECU 40 judges whether the crank counter value CRC is smaller than one hundred. The crank counter value corresponds to the crank angle, which represents the piston stroke in each cylinder #1–#8. Therefore, based on the crank counter value CRC, the ignition timing and the fuel injection timing are controlled in synchronization with the piston strokes of the cylinders #1–#8. The value CRC is maintained at one hundred until cylinder distinction is finished. When cylinder distinction is finished, the value CRC is incremented from the value at the time of the completion of cylinder distinction by one at every thirty-degree increase of the crank angle. When reaching twenty-four, the value CRC is set to zero, and again, is incremented by one at every thirty-degree increase of the crank angle.

If the determination at step 1340 is negative, the ECU 40 judges that cylinder distinction has not been completed and moves to step 1342. At step 1342 and the subsequent steps, the ECU 40 determines the crank counter value CRC, or performs cylinder distinction. At step 1342, the ECU 40 judges whether the distinction counter value JDC is zero. If the determination is positive, the crank reference angle signal CRSG1 has pulsed at least twice in the current routine but the distinction teeth 73 in one of the segments S1–S4 have not all been detected. In this case, the ECU 40 temporarily suspends the current routine.

If the determination at step 1342 is negative, all the teeth 73 in one of the segments S1–S4 have passed by the sensing elements 61, 62. In this case, the ECU 40 moves to step 1344.

At step 1344, the ECU 40 computes the crank counter value CRC, or performs the cylinder discrimination, based on the counter value JDC and the cam level value CL.

As described above, the position of the pistons 13 in the cylinders #1–#8 are identified by referring to the counter value JDC when all the teeth 72, 73 in one of the segments S1–S4 have passed by the sensing elements 55, 56. However, the crank angle for a certain piston stroke cannot be determined referring only to the position of each piston 13 in the associated cylinder #1–#8. This is because the piston 13 is at the same position twice during each rotation of the crankshaft.

Thus, the ECU 40 refers to the cam level value CL as well as to the counter value JDC. If, for example, the piston 13 in one of the cylinders #1–#8 is at the top dead center, the ECU 40 judges whether the piston 13 is at the compression top dead center or at the intake top dead center.

The ROM 41 stores a function map defining the relationship between the counter value JDC, and the cam level value CL and the crank counter value CRC. The ECU 40 refers to the map to compute the crank counter value CRC.

Chart 2 below shows the crank counter value CRC in relation with the relationship between the discrimination counter value JDC and the cam level value CL. For example, if the counter value JDC is one and the cam level value CL is one, the ECU 40 sets the crank counter value to eleven. If the counter value JDC is two and the cam level value CL is two, the ECU 40 sets the crank counter value CRC to two.

CHART 2

| | CRC | |
|---|---|---|
| JDC | CL = 2 | CL = 1,0 |
| 1 | 23 | 11 |
| 2 | 2 | 14 |
| 3 | 17 | 5 |
| 4 | 20 | 8 |

After computing the crank counter value CRC at step 1344, the ECU 40 moves to step 1346. At step 1346, the ECU 40 sets the distinction counter value JDC to zero and temporarily suspends the current routine.

If the determination is positive at step 1340, that is, if cylinder distinction has been completed and the crank counter value CRC is a value other than one hundred, the ECU 40 moves to step 1350. At step 1350, the ECU 40 judges whether the counter value JDC is one. In other words, the ECU 40 judges whether the teeth 72, 73 of the first segment S1 have just passed by the sensing elements 55, 56. If the determination is negative, the ECU 40 moves to step 1352. Step 1352 and the subsequent steps 1356 and 1358 are designed for incrementing the crank counter value CRC by one every time a pulse occurs in the crank reference angle signal CRSG1, or every time the crankshaft 15 is rotated by thirty degrees.

At step 1352, the ECU 40 increments the current crank counter value CRC by one. At step 1356, the ECU 40 judges whether the counter value CRC is twenty-four. If the determination is positive, the ECU 40 sets the counter value CRC to zero at step 1358. If the determination is negative at step 1356, or after executing step 1358, the ECU 40 moves to step 1380.

If the determination is positive at step 1350, the ECU 40 moves to step 1360. At step 1360, ECU 40 judges whether the cam level value CL is equal to two or greater. If the determination is positive, the tooth 80, 81 passing by the sensing elements 61, 62 belongs to the first cylinder segment and the crankshaft 15 is in its first turn. In this case, the ECU 40 moves to step 1362. At step 1362, the ECU 40 sets the crank counter value CRC to twenty-three.

If the determination at step 1360 is negative, the tooth 80, 81 passing by the sensing elements 61, 62 belongs the second cylinder segment and the crankshaft 15 is in its second turn. In this case the ECU 40 moves to step 1370. At step 1370, the ECU 40 sets the crank counter value CRC to eleven. After executing step 1370 or after executing step 1362, the ECU 40 moves to step 1380.

The steps 1350, 1360, 1362 and 1370 are executed for correcting the crank counter value CRC every time the teeth 72, 73 in the first segment S1 pass by the sensing elements 55, 56 of the crank position sensor 54. If noise produces a pulse in the crank reference angle signal CRSG1 or in the crank distinction signal CRSG2 regardless of passing of the teeth 72, 73 by the sensing elements 55, 56, the crank counter value CRC may have an incorrect value. In this case, steps 1350, 1360, 1362 and 1370 correct the crank counter value CRC during one turn of the crankshaft 15.

At step 1380, the ECU 40 sets the counter value JDC to zero and temporarily suspends the current routine.

Figure 42:
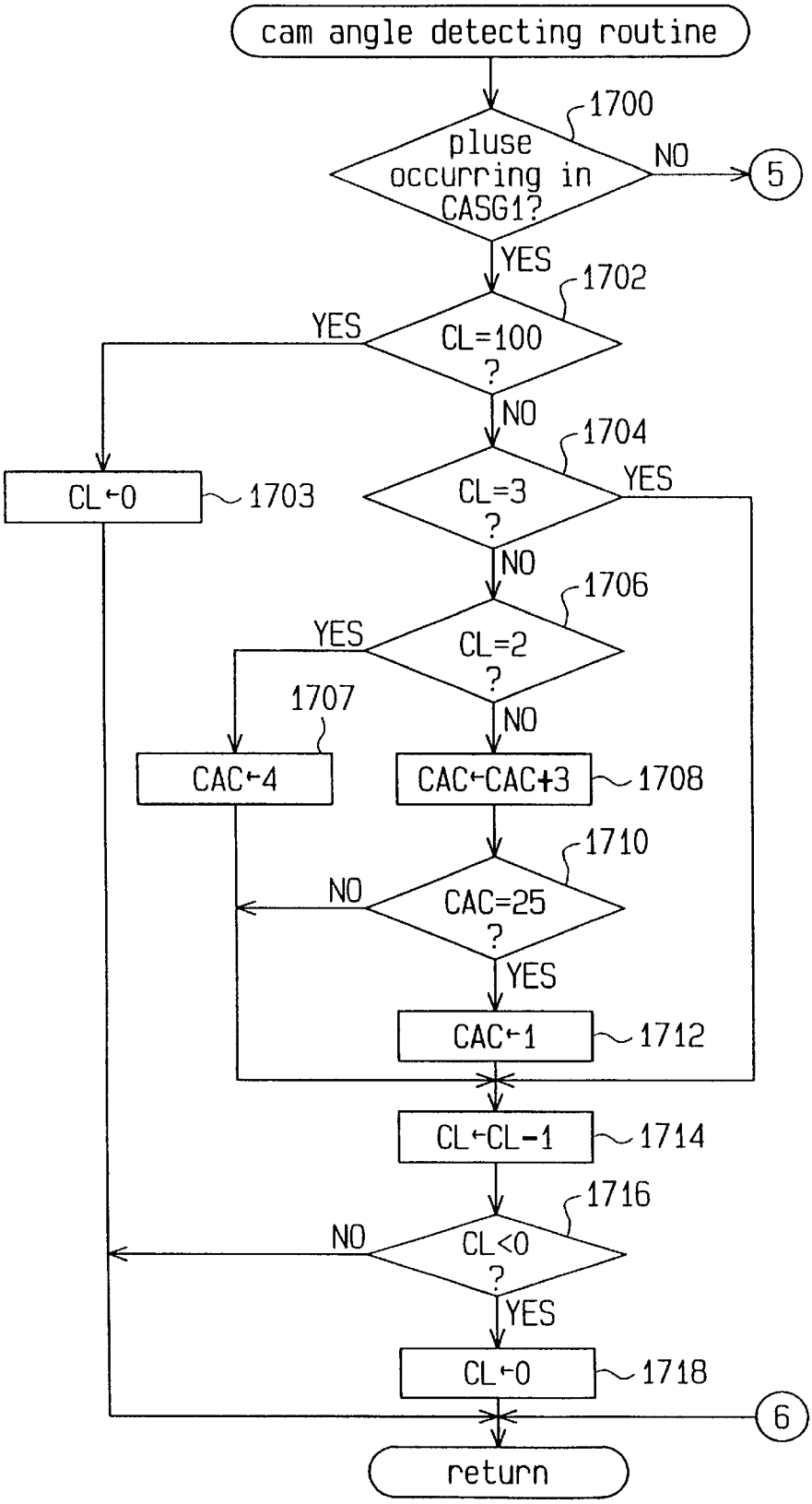
FIG. 42 is a flowchart showing a cam angle detecting routine of the eighth embodiment.
Figure 43:
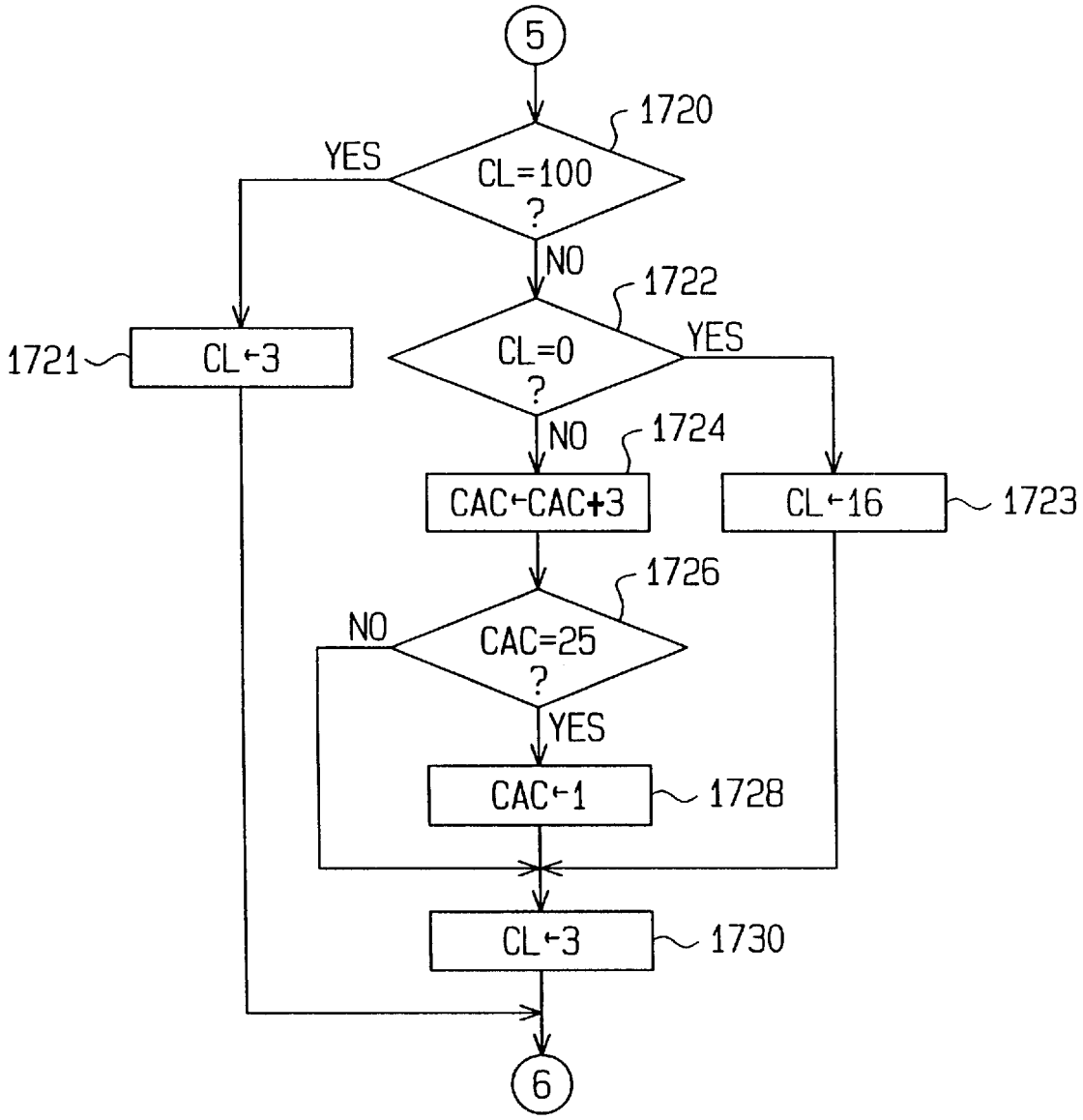
FIG. 43 is a flowchart showing a cam angle detecting routine of the eighth embodiment.

The cam angle detecting routine will now be described with reference to FIGS. 42 and 43. At step 1700, the ECU 40 judges whether a pulse is occurring in the cam reference angle signal CASG1. If the determination is positive, the ECU 40 moves to step 1702.

At step 1702, the ECU 40 judges whether the cam level value CL is one hundred. If the determination is positive, the ECU 40 moves to step 1703. At step 1703, the ECU 40 sets the cam level value CL to zero and temporarily suspends the current routine.

If the determination is negative at step 1702, the ECU 40 moves to step 1704. At step 1704, the ECU 40 judges whether the cam level value CL is three. If the determination is negative, the ECU 40 moves to step 1706.

At step 1706, the ECU 40 judges whether the cam level value CL is two. If the determination is positive, the ECU 40 moves to step 1707. At step 1707, the ECU 40 sets the cam counter value CAC to four.

If the determination at step 1706 is negative, that is, if the cam level value CL is one or zero, the ECU 40 moves to step 1708. At step 1708, the ECU 40 increments the cam counter value CAC by three.

The cam counter value CAC is incremented by three every time the crankshaft 15 rotates ninety degrees (every time the intake camshaft 20 rotates forty-five degrees). In other words, the counter value CAC is incremented by three every time a pulse occurs in the cam reference angle signal CASG1. As described above, the intake camshaft 20 is rotated relative to the crankshaft 15 by the VVT 30. Therefore, there is no one-to-one correspondence between the cam angle and the crank angle (the crank counter value CRC). Thus, the crank angle detector of the embodiment of FIGS. 29–43 directly detects the rotational angle of the intake camshaft 20 to detect the cam angle (the cam counter value CAC). When the crank angle (the cam counter value CAC) cannot be detected due to a malfunction of the crank position sensor 54, the cam counter value CAC is used as a substitute for the crank counter value CRC.

At step 1710, the ECU 40 judges whether the cam counter value CAC is twenty-five. If the determination is positive, the ECU 40 moves to step 1712. At step 1712, the ECU 90 sets the cam counter value CAC to one.

If the determination at step 1704 is positive, if the determination at step 1710 is negative or after executing steps 1707 or 1712, the ECU 40 moves to step 1714.

At step 1714, the ECU 40 decrements the cam level value CL by one. At step 1716, the ECU 40 judges whether the cam level value CL is smaller than zero. If the determination is positive, the ECU 40 moves to step 1718 and sets the value CL to zero.

If the determination at step 1716 is negative or after executing step 1718, the ECU 40 temporarily suspends the current routine. If the determination at step 1700 is negative, that is, if a pulse is occurring in the cam discrimination signal CASG2, the ECU 40 moves to step 1720 (see FIG. 43).

At step 1720, the ECU 40 judges whether the cam level value CL is one hundred. If the determination is positive, the ECU 40 moves to step 1721. At step 1721, the ECU 40 sets the cam level value CL to three and temporarily suspends the current routine.

If the determination at step 1720 is negative, the ECU 40 moves to step 1722. At step 1722, the ECU 40 judges whether the cam level value CL is zero. If the determination is positive, the ECU 40 moves to step 1723 and sets the cam counter value to sixteen. If the determination at step 1722 is negative, the ECU 40 moves to step 1724.

At step 1724, the ECU 40 increments the cam counter value CAC by three. In step 1726, the ECU 40 judges whether the cam counter value CAC is twenty-five. If the determination is positive, the ECU 40 moves to step 1728 and sets the cam counter value CAC to one.

If the determination 1726 is negative or after executing step 1723 or step 1728, the ECU 40 moves to step 1730. At step 1730, the ECU 40 sets the cam level value CL to three and temporarily suspends the current routine.

As described above, in the crank angle detecting routine and the cam angle detecting routine, the crank counter value CRC, which corresponds to the crank angle, and the cam counter value CAC, which corresponds to the cam angle, are computed. The ECU 40 executes the ignition timing control, the fuel injection control and the valve taming control based on the crank counter value CRC and the cam counter value CAC.

In the embodiment of FIGS. 29–43, the crank rotor 54*a* has four detection segments S1–S4, each of which has different number of detection teeth 73. The number of the teeth 73 in each detection segment S1–S4 is detected by the sensing elements 55, 56 and is stored in the RAM 43 as the distinction counter value JDC. The crank counter value CRC is determined based on the counter value JDC and the cam level value CL. The detection segments S1–S4 are spaced apart by ninety degrees. Therefore, during one turn of the crankshaft 15, the crank counter value CRC is determined four times. That is, the cylinder detection is performed four times. For example, if the engine 10 is started at the time t1 of FIG. 39, cylinder distinction is performed at the time t3, at which all the teeth 72 of the second detection segment 52 have passed by the sensor 54. If the engine 10 is started at a time t2, at which some of the teeth 72 of the detection segment S2 have already passed by the sensor 54, the crank angle is determined at a time t4, at which the teeth 72 of the third segment S3 have passed by the sensor 54.

Therefore, cylinder distinction is positively performed while the crankshaft 15 rotates at least one hundred twenty degrees. As a result, the ignition timing control and other controls performed in accordance with the piston strokes of the cylinders #1–#8 are started soon after the engine 10 is started. This improves the starting of the engine 10.

The shape of each tooth 72, 73 is not symmetrical with respect to its center line. Therefore, the state of magnetic field at the center line of each tooth 72, 73 is different from one tooth to another. Thus, the times at which the signals from the sensing elements 55, 56 decrease to zero do not match the times at which the sensing elements 55, 56 are aligned with the center line of the teeth 72, 73. The detection of passages of the teeth 72, 73 by the sensing elements 55, 56 may be inaccurate if the detection is executed based solely on the signals from the sensing elements 55, 56. However, the crank position sensor 54 according to the embodiment of FIGS. 29–43 has correcting sensing elements 57, 58. The signals from the first and second sensing elements 55, 56 are corrected based on the signals form the correcting elements 57, 58. The corrected signals DSG1, DSG2 are used to determine whether the teeth 72, 73 in one of the segments S1–S4 have passed the sensor 54. This allows the times at which the sensing elements 55, 56 are aligned with the center line of the teeth 72, 73 to be accurately detected.

As for the cam position sensor 60, the correcting sensing elements 63, 64 correct the signals from the first and second sensing elements 61, 62. Therefore, the times at which the sensing elements 61, 62 are aligned with the center line of the teeth 80, 81 are accurately detected.

The passages of the teeth 72, 73, 80, 81 over the sensors 54*a*, 60*a* are accurately detected, which improves the accuracy of the crank angle detection.

Further, in the embodiment of FIGS. 29–43, the valve timing of the intake valve 23 is most retarded by the VVT 30 when the engine 10 is started. A pulse occurs in the cam reference angle signal CASG1 or in the cam distinction signal CASG2 when a pulse occurs in the crank reference angle signal CRSG1 or in the crank discrimination signal CRSG2.

If the valve timing of the intake values 23 is most advanced (see FIGS. 39(*g*)–39(*i*)), the signal CASG1 or the signal CASG2 do not pulse during the segments S1–S4. In this case, if the engine 10 is started at the time t1, cylinder distinction is not started until the time t4. That is, unlike the embodiment of FIGS. 29–43, cylinder distinction is not completed at the time t3. This is because the cam reference angle signal CASG1 or the cam distinction signal CASG2 do not pulse during the period from the time t1 to time t3 and the cam level value CL is not determined during the period.

However, in the embodiment of FIGS. 29–43, the cam level value CL is determined when the teeth 72, 73 of any one of the detection segments S1–S4 are detected. At this point, the crank counter value CRC is determined. As a result, the crank angle is quickly determined, which improves the starting of the engine 10.

A ninth embodiment of the present invention will now be described. The differences from the embodiment of FIGS. 29–43 will mainly be discussed below and the same construction, process, operation and advantages as the embodiment of FIGS. 29–43 will be omitted. The crank position sensor 54, the magnetic sensor 54*b*, the cam position sensor 60 and the magnetic sensor 60*b* are different from those of the embodiment of FIGS. 29–43.

Figure 44:
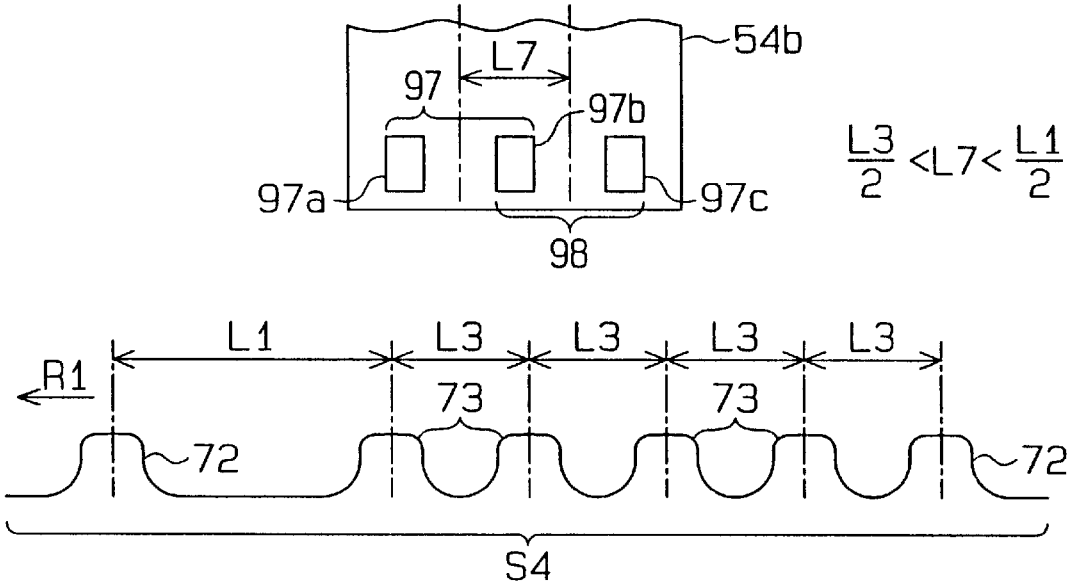
FIG. 44 is a schematic view illustrating the arrangement of sensing elements in a crank position sensor according to a ninth embodiment.

As shown in FIG. 44, the magnetic sensor 54*b* has first to third sensing element 97*a*, 97*b*, 97*c*, which are magnetic reluctance elements. The sensor 54*b* does not have the correcting sensing elements such as the elements 57, 58 in the embodiment of FIGS. 29–43. The first and second sensing elements 97*a*, 97*b* constitute a first element group 97 and the second and third elements 97*b*, 97*c* constitute a second element group 98. The elements 97*a*–97*c* detect the force of the magnetic field along the rotational direction of the crank rotor 54*a*. The elements 97*a*–97*c* satisfy the following inequality (9).

$$L3/2<L7<L1/2 \quad (9)$$

The distance L7 represents the distance between the midpoint of the first element 97*a* and the second element 97*b* and the midpoint of the second element 97*b* and the third element 97*c*.

Figure 45:
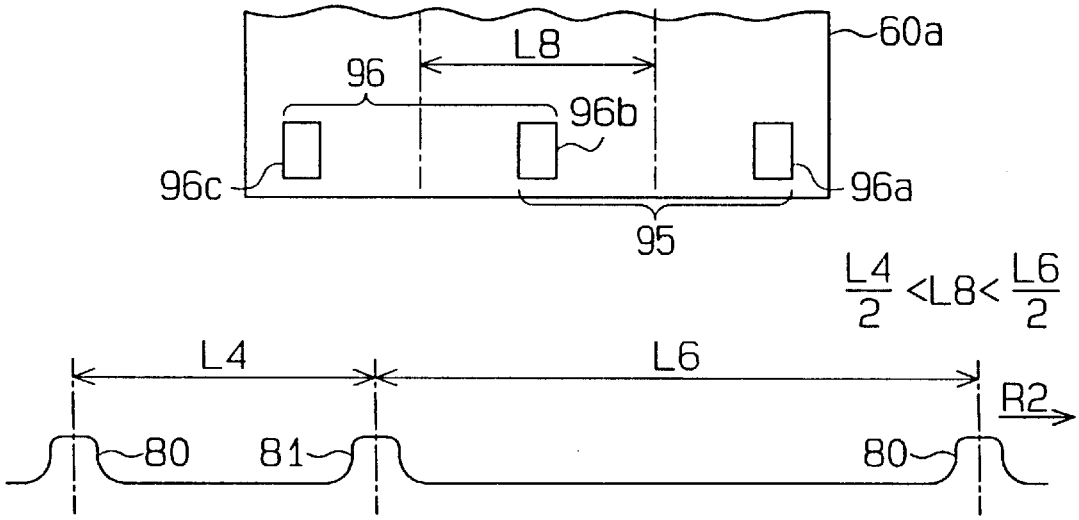
FIG. 45 is a schematic view illustrating the arrangement of sensing elements in a cam position sensor of the a ninth embodiment.

As shown in FIG. 45, the magnetic sensor 60*b* has first to third sensing elements 96*a*, 96*b*, 96*c*, which are magnetic reluctance elements, but does not have the correction sensing elements such as the elements 63, 64 of the embodiment of FIGS. 29–43. The first and second sensing elements 96*a*, 96*b* constitute a first element group 95 and the second and third elements 96*b*, 96*c* constitute a second element group 96. The elements 96*a*–96*c* detect the force of the magnetic field along the rotational direction of the crank rotor 60*a*. The elements 96*a*–96*c* satisfy the following inequality (10).

$$L4/2<L8<L6/2 \quad (10)$$

The distance L8 represents the distance between the midpoint of the first element 96*a* and the second element 96*b* and the midpoint of the second element 96*b* and the third element 96*c*.

A crank reference angle signal CRSG1 and a crank distinction signal CRSG2 will now be described. The signals CRSG1 and CRSG2 are generated by the signal processor 48 based on the signals from the element groups 97 and 98 of the crank position sensor 54.

Figure 46:
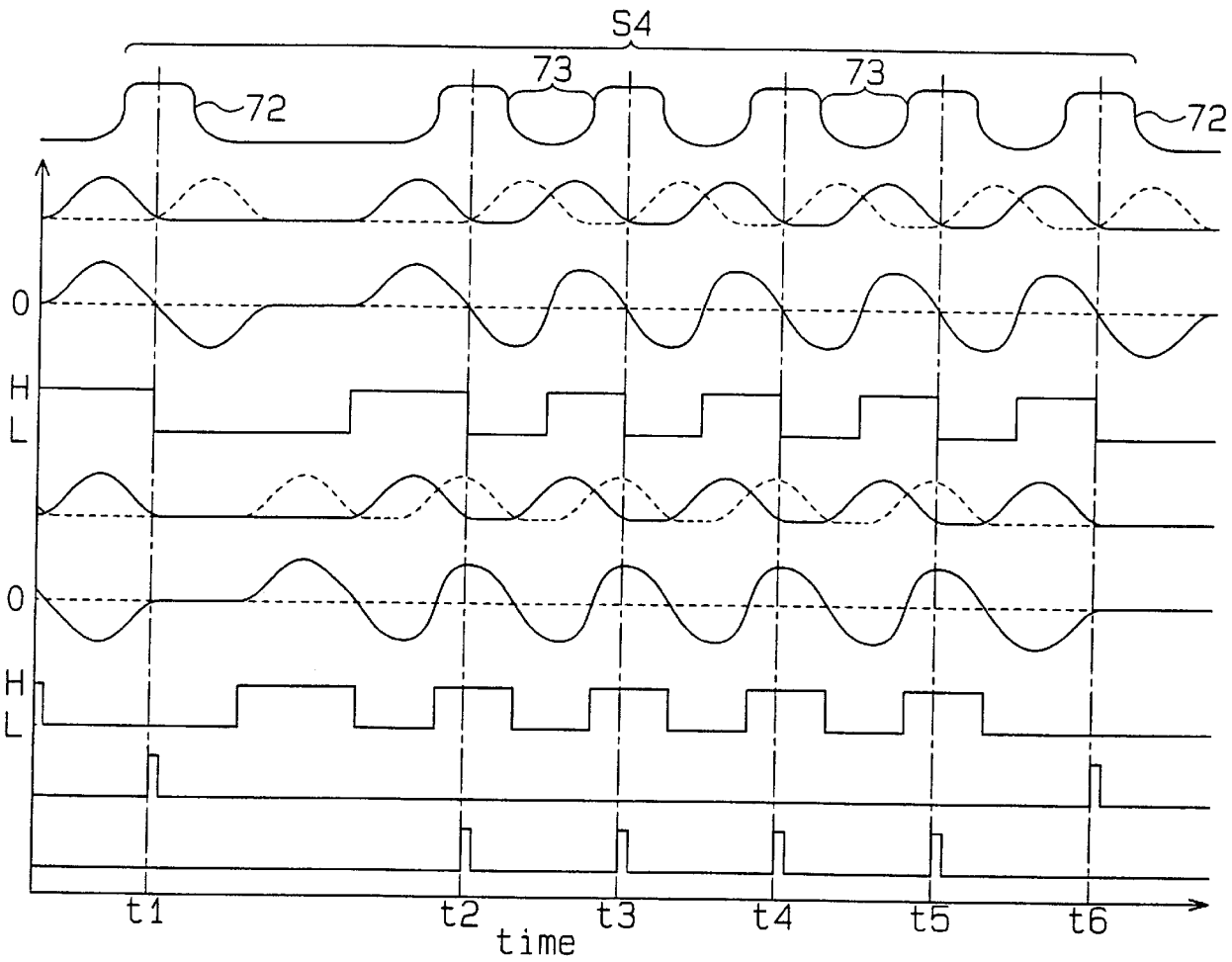
FIGS. 46(*a*)–46(*i*) are timing charts showing changes, over time, of signals in relation to the teeth on the crank rotor of FIG. 44.

FIGS. 46(*b*) and 46(*e*) show changes of signals output from the sensing elements 97*a*, 97*b* when the teeth 72, 73 of the fourth segment S4 pass by the sensor 54*b*. A broken line of FIG. 46(*b*) shows the signal B1 output from the first element 97*a*. A solid line of FIG. 46(*b*) shows a signal B2 output from the second element 97*b*. A broken line of FIG. 46(*e*) shows a signal B3 output from the third element 97*c*. A solid line of FIG. 46(*e*) shows a signal B2 output from the second element 97*b*.

The signal processor 48 subtracts the signal B1 from the signal B2 to generate a difference signal DSG1 (B2–B1) shown in FIG. 46(*c*). The processor 48 also generates a first rectangular signal TSG1, which is high when the signal DSG1 is greater than zero and is low when the signal DSG1 is equal to or smaller than zero. As shown in FIG. 46(*d*), the first rectangular signal TSG1 changes from high to low when the center of the first element group 97 is aligned with the center line of each tooth 72, 73.

Further, the signal processor 48 subtracts the signal B2 from the signal B3 to generate a difference signal DSG2 (B3–B2) shown in FIG. 46(*f*). The processor 48 also generates a second rectangular signal TSG2, which is high when the signal DSG2 is greater than zero and is low when the signal DSG2 is equal to or smaller than zero.

As in the embodiment of FIGS. 29–43, the signal processor 48 produces pulses in the crank reference angle signal CRSG1 shown in FIG. 46(*h*) and in a crank detection signal CRSG2 shown in FIG. 46(*i*) based on the rectangular signals TSG1, TSG2. The processor 48 supplies the signals CRSG1, CRSG2 to the input circuit 46.

Since the element groups 97, 98 are arranged to satisfy the inequality (9), the level of the signal TSG2 when the signal TSG1 falls changes in accordance with the type the tooth passing by the sensing elements 97, 98. That is, the level of the signal TSG2 when the signal TSG1 falls is low if one of the reference teeth 72 is passing by the element groups 97, 98 and is high if one of the distinction teeth 73 is passing by the element groups 97, 98. Therefore, the signal processor 48 produces a pulse in the crank reference angle signal CRSG1 on detecting one of the reference teeth 72, and produces a pulse in the crank distinction signal CRSG2 on detecting one of the distinction teeth 73.

Signals output from the element groups 95, 96 of the cam position sensor 60 and a cam reference angle signal CASG1 and a cam distinction signal CASG2 will now be described.

Figure 47:
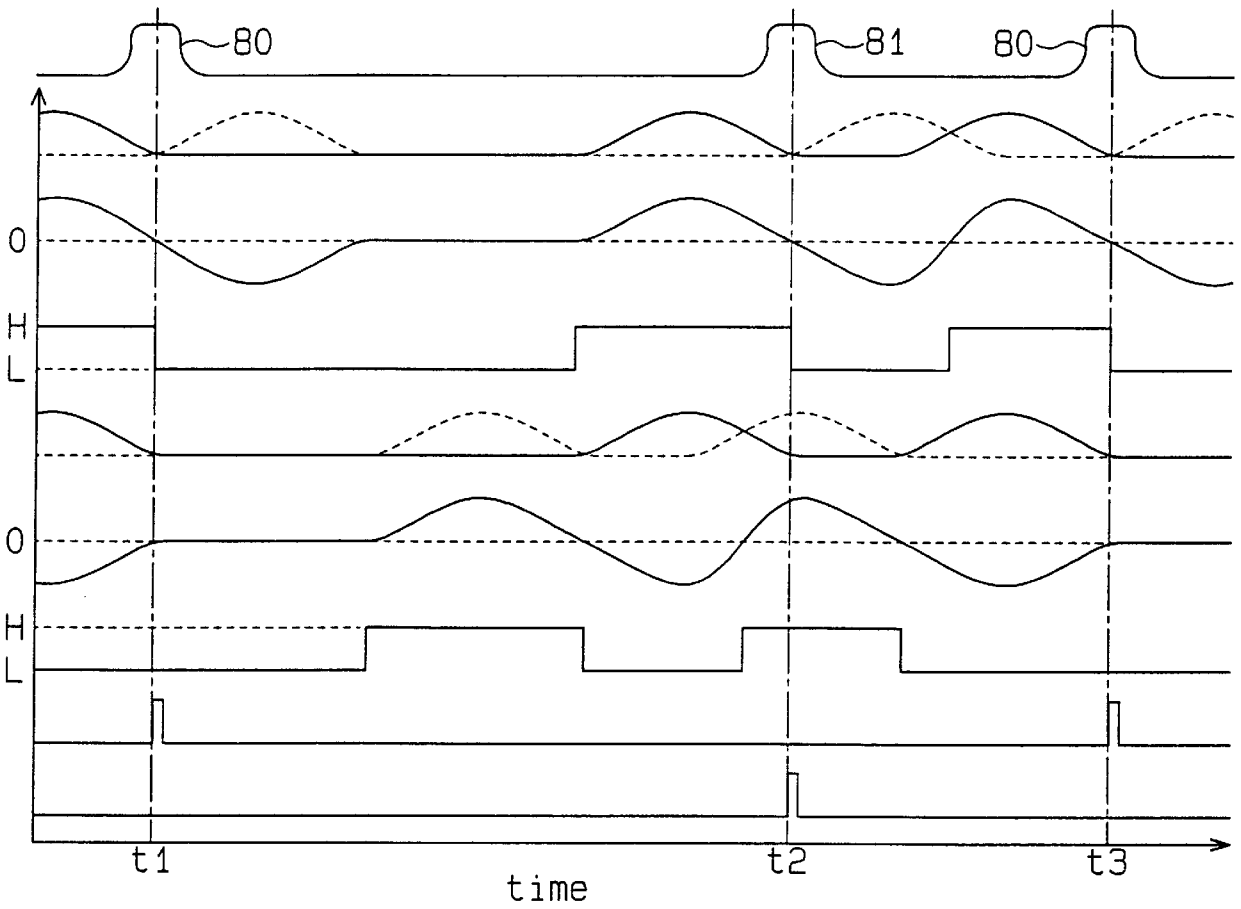
FIGS. 47(*a*)–47(*i*) are timing charts showing changes, over time, of signals in relation to the teeth on the cam rotor of FIG. 45.

FIGS. 47(*b*) and 47(*e*) show changes of signals output from the sensing elements 96*a*, 96*b* when the teeth 80, 81 of the cam rotor 60*a* pass by the sensor 60*b*. A broken line of FIG. 47(*b*) shows the signal C1 output from the first element 96*a* and the solid line shows a signal C2 output from the second element 96*b*. A broken line of FIG. 47(*e*) shows a signal C3 output from the third element 96*c* and a solid line shows a signal C2 output from the second element 96*b*.

The signal processor 48 subtracts the signal C1 from the signal C2 to generate a difference signal DSG3 (C2–C1) shown in FIG. 47(*c*). Further, as shown in FIG. 47(*f*), the signal processor 48 subtracts the signal C2 from the signal C3 to generate a difference signal DSG4 (C3–C2) shown in FIG. 47(*f*). In the same manner for producing the rectangular signals TSG1, TSG2, the processor 48 produces third and fourth rectangular signals TSG3, TSG4 shown in FIGS. 47(*d*), 47(*g*) based on the difference signals DSG3, DSG4. Further, as in the embodiment of FIGS. 29–43, the processor 48 produces pulses in the cam reference angle signal CASG1 shown in FIG. 47(*h*) and in the cam distinction signal CASG2 shown in FIG. 47(*i*) based on the rectangular signals TSG3, TSG4. The processor 48 supplies the signals CASG1, CASG2 to the input circuit 46.

Since the element groups 95, 96 are arranged to satisfy the inequality (10), the level of the signal TSG4 when the signal TSG3 falls changes in accordance with the type of the tooth passing by the sensing elements 95, 96. That is, the level of the signal TSG4 when the signal TSG3 falls is low if one of the reference teeth 80 is passing by the element groups 95, 96 and is high if one of the distinction teeth 81 is passing by the element groups 95, 96. Therefore, the signal processor 48 produces a pulse in the cam reference angle signal CASG1 on detecting one of the reference teeth 80 and produces a pulse in the crank distinction signal CASG2 on detecting one of the distinction teeth 81.

The ECU 40 executes the main routine, the crank angle detection routine, the cam angle detection routine based on the crank reference angle signal CRSG1, the crank detection signal CRSG2, the cam reference angle signal CASG1 and the cam detection signal CASG2.

In the embodiment of FIGS. 44–47, the element groups 97, 98, 95, 96 of the crank position sensor 54 and the cam position sensor 60 include magnetic reluctance elements for detecting the force of magnetic field along the rotational directions of the rotors 54*a*, 60*a*. Therefore, the sensors 54, 60 of the embodiment of FIG. 44–47 do not require the correcting elements such as the elements 57, 58, 63, 64 of the embodiment of FIG. 29–43. In other words, the sensors 54, 60 of the ninth embodiment have a simple structure.

In the embodiment of FIGS. 44–47, the distance between the first and second elements 97*a* and 97*b* may be different from the distance between the second and third elements 97*b* and 97*c*.

In the embodiment of FIGS. 44–47, the second sensing element 97*b* is used both in the first element group 97 and the second element group 98. However, each of the element groups 97 and 98 may be constituted by two different sensing elements. That is, the first group 97 may be constituted by first and second sensing elements and the second group 98 may be constituted by third and fourth sensing elements.

A tenth embodiment of the present invention will now be described. The differences from the embodiment of FIGS. 29–43 will mainly be discussed below and the same construction, process, operation and advantages as the eighth embodiment will be omitted. The shape of the crank rotor 54*a* and the shape of the cam rotor 60*a* are different from those of the embodiment of FIGS. 29–43.

Figure 48:
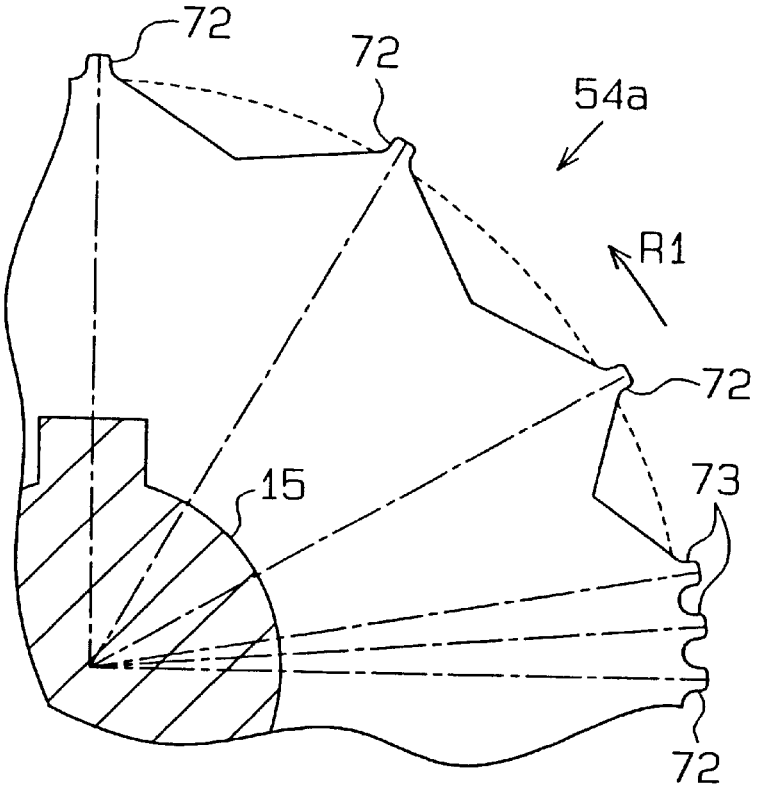
FIG. 48 is a partial view showing a crank rotor according to a tenth embodiment.

FIG. 48 illustrates a part of a crank rotor 54*a*. A V-shaped recess is formed between each pair of adjacent reference teeth 72. Also, a V-shaped recess is formed between detection tooth 73 and a reference tooth 72 that is located adjacent to the detection tooth 73 along the rotational direction RI of the crank rotor 54*a*. This structure of the crank rotor 54*a* constantly changes the direction of the magnetic field detected by the sensing elements 55–58. As a result, signals output from the sensing elements 55–58 are not affected by noise.

Figure 49:
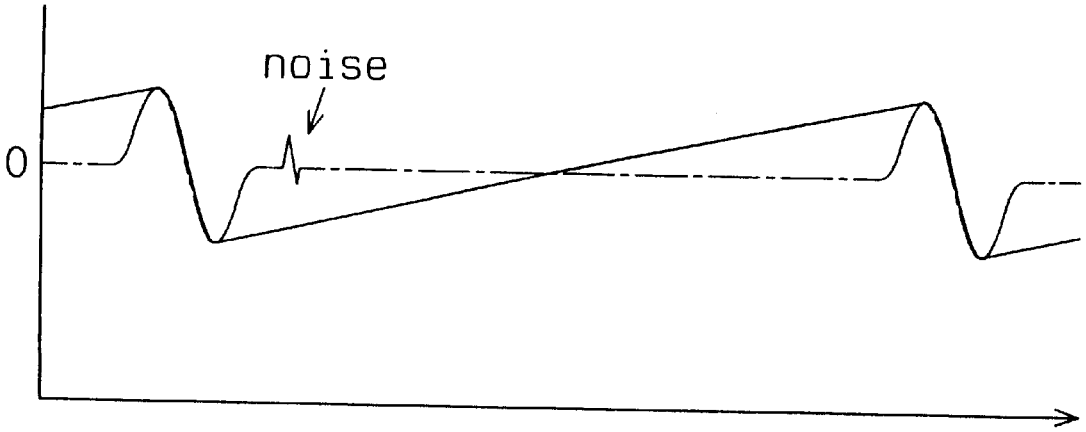
FIG. 49 is a chart showing a signal output from the crank position sensor of the tenth embodiment.

If the crank rotor 54*a* has a shape shown by a broken line in FIG. 48, signals from the sensing elements 55–58 have a value of zero during certain period as shown by a dashed line in FIG. 49. This is because when the part of the crank rotor 54*a* illustrated by the broken line passes by the sensing elements 55–58, the direction of the magnetic field at the sensing elements 55–58 is always aligned with the radial direction of the crank rotor 54*a*. If the signal is fluctuated by noise, a crank reference angle signal CRSG1 or a crank detection signal CRSG2 may pulse regardless whether the teeth 72, 73 pass by the sensing elements 55–58.

Figure 50:
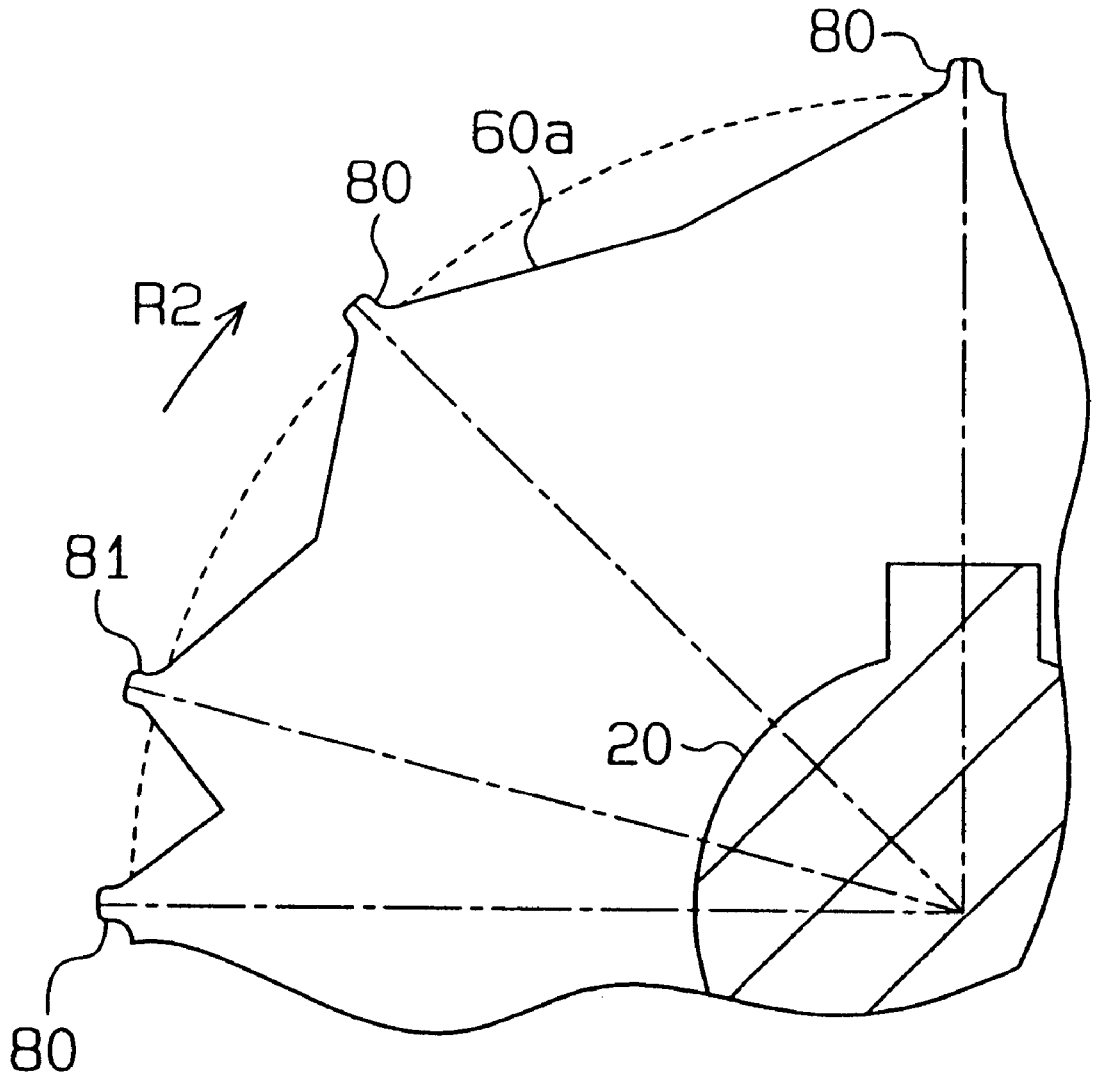
FIG. 50 is a partial view showing a cam rotor according to a tenth embodiment.

However, in the embodiment of FIGS. 48–50, signals from the sensing elements 55–58 constantly change as illustrated by a solid line in FIG. 49. The signal is not maintained to zero. Therefore, if the signal is fluctuated by noise, the signals CRSG1 and CRSG2 do not pulse.

Also, as shown in FIG. 50, the cam rotor 60*a* has V-shaped recess between the teeth 80, 81. This structure prevents the cam reference angle signal CASG1 and the cam detection signal CASG2 from pulsing unless the teeth 80, 81 pass by the sensing elements 61, 62.

As a result, the crank position sensor 54 and the cam position sensor 60 are less vulnerable to noise, which results in accurate crank angle detection.

It should be apparent to those skilled in the art that the present invention may be embodied in many other specific forms without departing from the spirit or scope of the invention. Particularly, it should be understood that the invention may be embodied in the following forms.

In the embodiments of FIGS. 1–47, the teeth 70, 72, 73 on the crank rotor 54*a* may be replaced with other indicia such as recesses. In this case, the passage of the recesses is detected by the magnetic sensor 54*b*. Likewise, the cam rotors 60*a*, 90*a*, 91*a* may have recesses.

In the embodiments of FIGS. 1–28, the teeth 70 of the crank rotor 54*a* do not have to be spaced apart by equal angular intervals. Instead, the teeth 70 may be spaced apart by uneven angular intervals. Likewise, the teeth 71, 92 on the cam rotors 60*a*, 90*a*, 91*a* may be spaced apart by uneven angular intervals. In the embodiments of FIGS. 29–50, the teeth 73, 81 may be spaced apart by uneven angular intervals as long as the inequalities (7)–(10) are satisfied.

In the embodiments of FIGS. 1–50, the distance between each pair of the teeth 70, 72 on the crank rotor 54*a* may be altered. The number of the teeth 71, 80 on the cam rotor 60*a* may be altered.

In the embodiments of FIGS. 1–50, the VVT 30, 93 and 94 may be omitted. Alternatively, a VVT may be used to change the valve timing of the exhaust valve 24 of the engine 10. In this case, a cam rotor having the same construction as the cam rotor 60*a* is secured to the exhaust camshaft 21. Further, a VVT that changes the valve timing of the intake and exhaust valves 23, 24 may be mounted on the engine 10. A cam rotor may be mounted on the intake camshaft 20 and on the exhaust camshaft 21.

In the embodiments of FIGS. 15–26, the sensing elements 55, 56 are arranged to satisfy the inequality (3) and the signals A1, A2 from the sensing elements 55, 56 are compared with the reference value V1 to generate the comparison signal C1. The inequality (3) and the reference value V1 may be changed to satisfy the following inequality (5) and the equation (6).

$$\alpha X1 < Z1 < \alpha Y1 \tag{5}$$

$$V1 = V\min + \alpha(V\max - V\min) \tag{6}$$

The value at is a constant that satisfies an inequality ($0<\alpha<1$).

In the embodiments of FIGS. 1–28, the sensing elements 61, 62 of the cam position sensor 60 may be constituted by magnetic reluctance elements instead of Hall elements.

In the embodiments of FIGS. 29–50, the number of cylinder distinction segments S1–S4 is four. However, the number of the segments S1–S4 may be changed.

In the embodiments of FIGS. 29–50, the number of the crank detection signal CRSG2 is counted by the ECU 40 (CPU 42) and the counted number is stored in the RAM 43 as the detection counter value JDC. However, the ECU 40 may have an independent counter. In this case, the crank detection signal CRSG2 is input into the counter and the ECU 40 generates the counter value JDC by reading the number of inputs of the value CRSG2. This construction reduces the load of computation on the ECU 40 (CPU 42).

Therefore, the present examples and embodiments are to be considered as illustrative and not restrictive and the invention is not to be limited to the details given herein, but may be modified within the scope and equivalence of the appended claims.

What is claimed is:

1. A crank angle detecting apparatus for an internal combustion engine, wherein the engine has a plurality of cylinders, each cylinder retaining a piston, and wherein a crankshaft is operationally coupled to the pistons such that the crankshaft rotates twice per engine cycle and the position of each piston depends upon the rotational position of the crankshaft, the crank angle detecting apparatus comprising:

a crank rotor provided on the crankshaft to rotate with the crankshaft, the crank rotor having a plurality of angular segments, each angular segment includes a group of indicia of different lengths as measured in the circumferential direction of the crankshaft, the group of indicia in each angular segment having a distinct combination;

a detector facing the indicia for detecting passage of the indicia when the crank rotor rotates;

a crank angle signal generator for receiving signals from the detector and for generating a crank angle signal, wherein the crank angle signal changes in accordance with the combination of the indicia;

a first memory for storing the changes of the crank angle signal;

a camshaft that is rotated once per engine cycle by the crankshaft, the camshaft including a first one hundred eighty degree segment and a second one hundred eighty degree segment;

a cam angle signal generator that detects rotation of the camshaft for generating a cam angle signal, wherein the cam angle signal indicates which one of the first and second one hundred eighty degree segments corresponds to a currently detected portion of the camshaft; and a discriminator for discriminating the angular position of the crankshaft, which is indicative of the current point in the engine cycle, based on stored changes of the crank angle signal and of the cam angle signal.

2. The apparatus according to claim 1, wherein the cam angle signal generator generates a cam angle pulse signal every time the camshaft rotates by a predetermined angle when the detected portion of the camshaft corresponds to the first one hundred eighty degree segment and while the crank angle generator is outputting the crank angle signal.

3. The apparatus according to claim 2, wherein the cam angle signal generator stops generating the cam angle signal when the detected portion of the camshaft corresponds to the second one hundred eighty segment.

4. The apparatus according to claim 1, wherein the indicia include a first indicium, which is relatively short in the rotational direction of the crank rotor, and a second indicium, which is relatively long in the rotational direction of the crank rotor; and wherein the detector includes first and second detecting elements, which are arranged generally in the circumferential direction of the crank rotor, the first and second detecting elements satisfying the inequality $X<Z<Y$, in which X is the length of the first indicium in the circumferential direction of the crankshaft, Y is the length of the second indicium in the circumferential direction of the crankshaft and Z is the distance between the first and second detecting elements.

5. The apparatus according to claim 4, wherein the crank angle signal generator detects which of the first and second indicia has just passed the first and second detecting elements based on signals from the detecting elements, and wherein the crank angle signal generator generates a crank angle signal indicative of the detected indicium.

6. The apparatus according to claim 5, wherein each group of indicia includes a pair of long teeth defining the size of the segment and two intermediate teeth between the long teeth, wherein the two intermediate teeth are a combination of long and short teeth.

7. The apparatus according to claim 4, further comprising:

a cam rotor provided on the camshaft to integrally rotate with the camshaft;

the cam rotor including third indicia formed in the first one hundred eighty degree segment and fourth indicia formed in the second one hundred eighty degree segment, and the cam angle signal generator being located in the vicinity of the cam rotor, wherein the cam angle signal generator generates signals corresponding to the third and fourth indicia.

8. The apparatus according to claim 7, wherein the third indicia are equally spaced apart and relatively long in the circumferential direction of the cam rotor, and wherein the fourth indicia are equally spaced apart and relatively short in the circumferential direction of the cam rotor.

9. The apparatus according to claim 1, wherein the angular segments on the crank rotor include four angular segments that are equally spaced apart, and wherein the central angle of each angular segment is thirty degrees.

10. The apparatus according to claim 1, wherein the indicia include a first type of indicium that is relatively short in the direction of the crank rotor and a second type of indicium that is relatively long in the circumferential direction of the crank rotor; and wherein the detector includes first and second detecting elements, which are arranged along the circumferential direction of the crank rotor and have the same output characteristics, and wherein the detection elements satisfy the inequality $\alpha X<Z<\alpha Y$ where $\alpha$ is between zero and one, X is the length of one indicium of the first type in the circumferential direction of the crankshaft, Y is the length of one indicium of the second type in the circumferential direction of the crankshaft, and Z is the distance between the first and second detecting elements.

11. The apparatus according to claim 10, wherein each indicium includes leading and trailing edges, which define the length of the corresponding indicium, wherein the detector generates a signal that has a maximum value when the leading edge of each indicium passes by the detector and has a minimum value when the trailing edge of each indicium passes by the detector; and wherein the crank angle signal generator determines whether an indicium of the first or second type is generating signals output from the detecting elements by comparing the amplitude of the signal output from the second detecting element with a predetermined value V when the signal output from the first detecting element is minimum, wherein the predetermined value V is computed by an equation $V=V_{min}+\alpha(V_{max}-V_{min})$, in which $\alpha$ is a constant, $V_{max}$ is the maximum value of signals output from the detecting elements, and $V_{min}$ is the minimum value of the signals output from the detecting elements;

wherein the crank angle signal generator generates a crank angle signal, which differs according to whether the first type or the second type of indicium is being detected.

12. The apparatus according to claim 11, wherein the crank angle signal generator generates a signal indicative of the rotational direction of the crankshaft based on the rate of change of a signal output from the second detecting element when a signal output from the first detecting element has the minimum value; and wherein the discriminator discriminates the angular position of the crankshaft based on the stored changes of the crank angle signal, the cam angle signal and on the signal indicative of the rotational direction of the crankshaft.

13. The apparatus according to claim 12, further comprising a crank counter that determines the angular position of the crankshaft and thereafter counts a count value indicative of the rotational angle of the crankshaft;

a second memory for storing the count value, wherein the second memory retains the count value after the engine is stopped; and wherein the crank counter keeps renewing the count value until the rotation of the crankshaft stops after a driver turns the engine off, wherein the renewed count value is stored in the second memory, and wherein the discriminator discriminates the angular position of the crankshaft when the engine is started again using the stored count value.

14. The apparatus according to claim 13, wherein the crank counter increments the count value when the crankshaft is rotating in a normal direction, and decrements the count value when the crankshaft is rotating in a reverse direction.

15. The apparatus according to claim 14, wherein the crank counter detects reverse rotation of the crankshaft and decrements the count value after the driver turns the engine off.

16. The apparatus according to claim 10, wherein each indicium includes leading and trailing edges, which define the length of the corresponding indicium, wherein the detector generates a signal that has a maximum value when the leading edge of each indicium passes by the detector and has a minimum value when the trailing edge of each indicium passes by the detector; and wherein the crank angle signal generator determines whether an indicium of the first or second type is generating signals output from the detecting elements based on the rate of change of a signal output from the second detecting element when the amplitude of a signal output from the first detecting element is equal to a predetermined value V and the amplitude of a signal output from the second detecting element is greater than the predetermined value V, wherein the predetermined value V is computed by an equation $V=V_{min}+\alpha(V_{max}-V_{min})$, in which $\alpha$ is a constant, $V_{max}$ is the maximum value of signals output from the detecting elements, and $V_{min}$ is the minimum value of signals output from the detecting elements.

17. The apparatus according to claim 16, wherein the crank angle signal generator detects which of the first and second types is passing by when the detector detects the passage of the center of an indicium, and wherein the crank angle signal generator generates a crank angle signal indicative of the detected indicium type.

18. The apparatus according to claim 16, wherein the crank angle signal generator generates a signal indicative of the rotational direction of the crankshaft based on the rate of change of a signal output from the first detecting element when the amplitude of a signal output from the first detecting element is equal to the predetermined value V and the amplitude of a signal output from the second detecting element is greater than the predetermined value V; and wherein the discriminator discriminates the angular position of the crankshaft based on the stored changes of the crank angle signal, the cam angle signal and on the signal indicative of the rotational direction of the crankshaft.

19. The apparatus according to claim 18, wherein the crank angle signal generator generates a signal indicative of the rotational direction of the crankshaft when the detector detects the passage of the center of an indicium.

20. The apparatus according to claim 1, wherein the indicia include projections.

21. The apparatus according to claim 1, wherein the indicia include recesses.

22. The apparatus according to claim 1, further including a device for changing the rotational phase of the camshaft relative to the crankshaft.

23. The apparatus according to claim 22, wherein the phase changing device maintains the camshaft at the most retarded phase position when the engine is being cranked.

24. A crank angle detecting apparatus for an internal combustion engine, wherein the engine has a plurality of cylinders, each cylinder retaining a piston, and wherein a crankshaft is operationally coupled to the pistons such that the crankshaft rotates twice per engine cycle and the position of each piston depends upon the rotational position of the crankshaft, the crank angle detecting apparatus comprising:

a crank rotor provided on the crankshaft to rotate with the crankshaft, the crank rotor having a plurality of angular segments, each angular segment includes a pair of first indicia that define the size of the segment and at least one second indicia located between the first indicia, wherein the number of the second indicia is different in each segment;

a detector facing the indicia for generating a signal corresponding to the indicia in each segment when the crank rotor rotates;

a counter for counting the number of second indicia in each segment based on signals from the detector;

a camshaft that is rotated once per engine cycle by the crankshaft, the camshaft including a first one hundred eighty degree segment and a second one hundred eighty degree segment;

a cam angle signal generator that detects rotation of the camshaft for generating a cam angle signal, wherein the cam angle signal indicates which one of the first and second one hundred eighty degree segments corresponds to a currently detected portion of the camshaft; and a discriminator for discriminating the angular position of the crankshaft, which is indicative of the current point in the engine cycle based on the count value of the counter and the cam angle signal.

25. The apparatus according to claim 24, wherein the cam rotor further includes regions between the angular segments, wherein the first indicia are provided on the entire circumference of the cam rotor, which includes the angular segments and the regions, and wherein the first indicia are spaced apart by equal angular intervals.

26. The apparatus according to claim 25, wherein the first and second indicia comprise either projections or recesses, wherein the crank rotor, which includes the first and second indicia, is made of magnetic material, wherein the detector includes first and second detecting elements, the first detecting element detecting the direction of the magnetic field created in the vicinity of the circumference of the crank rotor, the second detecting element being radially aligned with the first detecting element and spaced apart from the first detecting element by a predetermined distance, and wherein the passage of each indicium is detected when the levels of signals from the detecting elements are the same.

27. The apparatus according to claim 26, wherein the detector further includes a third detecting element, which is spaced apart from the first detecting element in the circumferencial direction of the crank rotor, and a fourth element, which is radially aligned with the third detecting element and is spaced apart from the third detecting elementby a predetermined distance, correcting means for generating a correction signal by correcting a signal from the third detecting element based on a signal from the fourth element, and wherein an indicium passing by the detector is determined to be one of the first indicia or the second indicia based on the level of the correction signal when signals from the first and second detecting elements match.

28. The apparatus according to claim 27, wherein the first detecting element and the third detecting element are arranged to satisfy the inequality $L/2<N<M/2$, in which L is the distance between a pair of the second indicia, M is the distance between the first and third detecting elements and Z is the distance between the first and second indicia.

29. The apparatus according to claim 25, wherein the first and second indicia comprise projections, the crank rotor is made of magnetic material, the detector generates a reference value when the direction of the magnetic field in the vicinity of the circumference of the crankshaft is parallel to the radial direction of the crank rotor, wherein the direction of the magnetic field changes as each indicium passes by the detector, wherein the detection signal increases and decreases from the reference value in accordance with changes in the direction of the magnetic field, and wherein the passage of an indicium is detected when the detection signal returns to the reference value.

30. The apparatus according to claim 29, wherein a recess is formed in a circumferencial portion of the crank rotor between a pair of the indicia such that the distance between the periphery of the crank rotor and the detector constantly changes when the crank rotor is rotating.

31. The apparatus according to claim 25, wherein the first and second indicia comprise either projections or recesses, wherein the crank rotor, which includes the first and second indicia, is made of magnetic material, wherein the detector includes first, second and third detecting elements that are linearly arranged and are equally spaced apart, wherein the first, second and third detecting elements detect the direction of the magnetic field created in the vicinity of the circumference of the crank rotor, and wherein the passage of each indicium is detected based on signals from the detecting elements.

32. The apparatus according to claim 31, further comprising distinction means for generating a signal in accordance with passage of an indicium, wherein the distinction means detects the passage of an indicium based on signals output from the first and second detecting elements, and wherein the distinction means judges whether a passing indicium is one of the first or second indicia based on signals from the second and third detecting elements when detecting the passage of an indicium.

33. The apparatus according to claim 25, wherein the angular segments on the crank rotor include four angular segments that are equally spaced apart, and wherein the central angle of each angular segment is thirty degrees.

* * * * *